US011625982B2

(12) United States Patent
La Guardia et al.

(10) Patent No.: US 11,625,982 B2
(45) Date of Patent: Apr. 11, 2023

(54) SYSTEM AND METHOD OF PROVIDING A HOLD AND SPIN FEATURE GAME WITH REEL EXPANSION

(71) Applicant: Aristocrat Technologies, Inc., Las Vegas, NV (US)

(72) Inventors: Chad La Guardia, Austin, TX (US); Daniel Marks, Decatur, GA (US); Kaitlin Sheridan, Alameda, CA (US); Edward Hugar, Oakland, CA (US); Juan Lopez, San Francisco, CA (US); Edmond Ye, San Francisco, CA (US); Courtni Wong, San Francisco, CA (US); Christopher Decker, Oakland, CA (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 0 days.

(21) Appl. No.: 16/805,551

(22) Filed: Feb. 28, 2020

(65) Prior Publication Data

US 2021/0056810 A1 Feb. 25, 2021

Related U.S. Application Data

(60) Provisional application No. 62/890,499, filed on Aug. 22, 2019.

(51) Int. Cl.
*G07F 17/34* (2006.01)
*G07F 17/32* (2006.01)

(52) U.S. Cl.
CPC ..... *G07F 17/3265* (2013.01); *G07F 17/3209* (2013.01); *G07F 17/3213* (2013.01);
(Continued)

(58) Field of Classification Search
CPC ..... G07F 17/3265; G07F 17/3209; G07F 17/3213; G07F 17/34
(Continued)

(56) References Cited

U.S. PATENT DOCUMENTS 9,928,691 B2 3/2018 Olive
10,339,761 B2 7/2019 Olive
(Continued)

FOREIGN PATENT DOCUMENTS

AU 2015210489 2/2016
AU 2016100230 3/2016
(Continued)

*Primary Examiner* — Jay Trent Liddle
*Assistant Examiner* — Ryan Hsu
(74) *Attorney, Agent, or Firm* — Weaver Austin Villeneuve & Sampson LLP

(57) ABSTRACT

A gaming machine provides a spinning reel game having a base game, from which a hold and spin feature game may be triggered when a determined number of configurable symbols are displayed in a base game outcome. When the feature game is triggered, the configurable symbols may be held in place. The player may be provided one or more spins during the feature game in which to collect additional configurable symbols. Any additional configurable symbols may be retained on the display during subsequent spins until the feature game is completed. A trigger symbol, which may or may not be a configurable symbol, may cause reel expansion. The reel expansion may involve adding a row or a column. In some examples, the trigger symbol also may alter the value of at least some configurable symbols. For example, the trigger symbol may cause the value of a configurable symbol to increment.

20 Claims, 54 Drawing Sheets

(52) U.S. Cl.
CPC ..... *G07F 17/34* (2013.01); *G07F 17/3239* (2013.01); *G07F 17/3267* (2013.01)

(58) Field of Classification Search
USPC ..... 463/20
See application file for complete search history.

(56) References Cited

U.S. PATENT DOCUMENTS

| | | | | |
|---|---|---|---|---|
| 10,535,229 | B2 | 1/2020 | Olive | |
| 10,600,286 | B2 | 3/2020 | Marks | |
| 10,629,030 | B2 | 4/2020 | Marks | |
| 10,636,251 | B2 | 4/2020 | Marks | |
| 10,657,770 | B2 | 5/2020 | Marks | |
| 2005/0143164 | A1* | 6/2005 | Duhamel | G07F 17/3211 463/20 |
| 2008/0318668 | A1* | 12/2008 | Ching | G07F 17/3258 463/25 |
| 2010/0029381 | A1* | 2/2010 | Vancura | G07F 17/3244 463/30 |
| 2014/0256402 | A1* | 9/2014 | Caputo | G07F 17/3227 463/20 |
| 2015/0031436 | A1* | 1/2015 | Suda | G07F 17/3248 463/20 |
| 2016/0042597 | A1 | 2/2016 | Olive | |
| 2016/0253873 | A1 | 9/2016 | Olive | |
| 2019/0318578 | A1 | 10/2019 | Olive | |
| 2020/0074800 | A1 | 3/2020 | Olive | |
| 2020/0074801 | A1 | 3/2020 | Olive | |
| 2020/0074814 | A1 | 3/2020 | Marks | |
| 2020/0090467 | A1 | 3/2020 | Marks | |
| 2020/0105101 | A1 | 4/2020 | Olive | |
| 2020/0105102 | A1 | 4/2020 | Olive | |
| 2020/0111312 | A1 | 4/2020 | Olive | |
| 2020/0143635 | A1 | 5/2020 | Olive | |
| 2020/0152012 | A1 | 5/2020 | Olive | |

FOREIGN PATENT DOCUMENTS

| | | |
|---|---|---|
| AU | 2016202727 | 5/2016 |
| AU | 2017101730 | 1/2018 |
| AU | 2017101731 A4 | 1/2018 |
| AU | 2018203489 | 10/2019 |

* cited by examiner

SYSTEM AND METHOD OF PROVIDING A HOLD AND SPIN FEATURE GAME WITH REEL EXPANSION

BACKGROUND

Electronic gaming machines ("EGMs") or gaming devices provide a variety of wagering games such as slot games, video poker games, video blackjack games, roulette games, video bingo games, keno games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical wagering games use a random number generator (RNG) to randomly determine the outcome of each game. The wagering game is designed to return a certain percentage of the amount wagered back to the player (RTP=return to player) over the course of many plays or instances of the game. The RTP and randomness of the RNG are critical to ensuring the fairness of the games and are, therefore, highly regulated. Upon initiation of play, the RNG randomly determines a game outcome and symbols are then selected which correspond to that outcome. Notably, some games may include an element of skill on the part of the player and are, therefore, not entirely random.

In existing gaming systems, feature games, secondary or bonus games, may be triggered for players in addition to the base game. A feature game gives players an additional opportunity to win prizes, or the opportunity to win larger prizes, than would otherwise be available in the base game. Feature games can also offer altered game play to enhance player enjoyment.

The popularity of such gaming machines with players is heavily dependent on the entertainment value of the machine relative to other gaming options and the player's gambling experience. Operators of gaming businesses therefore strive to provide the most entertaining, engaging, and exciting machines to attract customers to use the machines while also providing a machine that allows the player to enjoy their gambling experience. Accordingly, there is a continuing need for gaming machine manufacturers to develop new games in order to maintain or increase player enjoyment.

SUMMARY

Aspects of the present disclosure relate to gaming machines and electronic gaming methods in which a feature game may be triggered during play of a base game.

In an embodiment, a video slot machine includes a base game and a feature game that may be triggered by the base game.

In some embodiments, the base game may use a plurality of symbol display positions arranged in a matrix or an array of rows and columns. In some embodiments, the columns may be reels that spin and stop to populate the display matrix with game symbols.

In some embodiments, the symbols appearing in the display positions can produce a scatter pay award. In some embodiments, the scatter pay award may be based on the appearance of special symbols ("scatter symbols") in the display matrix. The particular symbols do not need to appear in any predefined order or orientation relative to the symbol positions of the array.

In response to the appearance of the special symbols to form a scatter pay award, a scatter pay bonus feature may be conducted to determine the amount of the award to the player.

In some embodiments, the appearance of a number, such as six (6) or more, of special symbols in a base game outcome in the display matrix will trigger the scatter pay bonus feature.

In an embodiment, the special symbols may include configurable symbols that have at least a common component and a variable component, wherein the variable component is indicative of a value of a prize that is associated with a respective configurable symbol.

In some embodiments, the configurable symbols may include value symbols, which each display a respective numeric value, e.g., a number of credits or currency.

In some embodiments, the configurable symbols may include jackpot symbols, which each display the name of a particular jackpot, e.g., a MINI jackpot, MINOR jackpot, MAXI jackpot, MAJOR jackpot or GRAND jackpot. In some embodiments, at least some of the jackpots may have fixed values. In some other embodiments, at least some of the jackpots may be progressive jackpots whose value increases for each wager that is placed on a base game by an amount proportional to said wager.

In various embodiments, a predetermined number of spins are awarded to the player in the scatter pay bonus feature. In some embodiments, the scatter pay bonus feature game may be a hold and spin feature game where all of the configurable symbols are held in place in the display matrix for the predetermined number of spins and the symbols in the remaining symbol positions are spun. The spin of symbols in the remaining symbol positions may be accomplished by individual reel strips. The resulting spin may produce additional configurable symbols which are, in turn, added to the "hold" symbols and remain fixed for any remaining spins. After the predetermined number of spins are completed, the sum total value of all "hold" symbols is awarded to the player.

Some aspects of this disclosure may be implemented in a gaming device that includes a user interface system, a display system and a control system. The user interface system may be configured for receiving an indication to initiate one or more instances of a base game. The base game may be a slot game or may include a slot game. The display system may include one or more display devices. The control system may include one or more processors. The control system may be configured for controlling the gaming device to present the one or more instances of the base game.

Presenting an instance of the base game may involve determining a base game outcome and corresponding display symbols. The display symbols may be selected from a symbol set that includes configurable symbols and non-configurable symbols. Presenting an instance of the base game may involve controlling the display system to display the corresponding display symbols at a plurality of display symbol positions on a display device of the display system. In some examples, the plurality of display symbol positions may be arranged in a plurality of display symbol rows and columns. Presenting an instance of the base game may involve determining that a triggering number of configurable symbols is displayed in a base game outcome.

In response to a determination that a triggering number of configurable symbols is selected and/or displayed, the control system may be configured for controlling the gaming device to present one or more instances of a feature game. Presenting an instance of the feature game may involve holding each displayed configurable symbol at its corresponding display symbol position. Presenting an instance of the feature game may involve selecting and displaying replacement symbols for non-configurable symbols in a plurality of display symbol positions not occupied by the held configurable symbols.

The control system may be configured for determining that one of the displayed symbols is a trigger symbol. The trigger symbol may, for example, be selected and displayed during a base game. For example, the trigger symbol may be one of the triggering number of configurable symbols displayed in a base game outcome. Alternatively, or additionally, a trigger symbol may be selected and displayed during an instance of a feature game.

In response to the selection and/or display of a trigger symbol, the control system may be configured for controlling the display system to add at least one row and/or at least one column to the plurality of display symbol positions. In some examples, the number of added rows and/or columns may correspond with the number of trigger symbols.

According to some implementations, the control system may be configured for controlling the display system to alter a value of one or more displayed configurable symbols in response to the trigger symbol. In some such implementations, the control system may be configured for controlling the display system to alter the value of one or more displayed configurable symbols before adding the at least one row or column to the plurality of display symbol positions.

BRIEF DESCRIPTION OF THE DRAWINGS

Features and advantages of certain embodiments of the present disclosure will become apparent from the following description of embodiments thereof, by way of example only, with reference to the accompanying drawings, in which.

Figure 1:
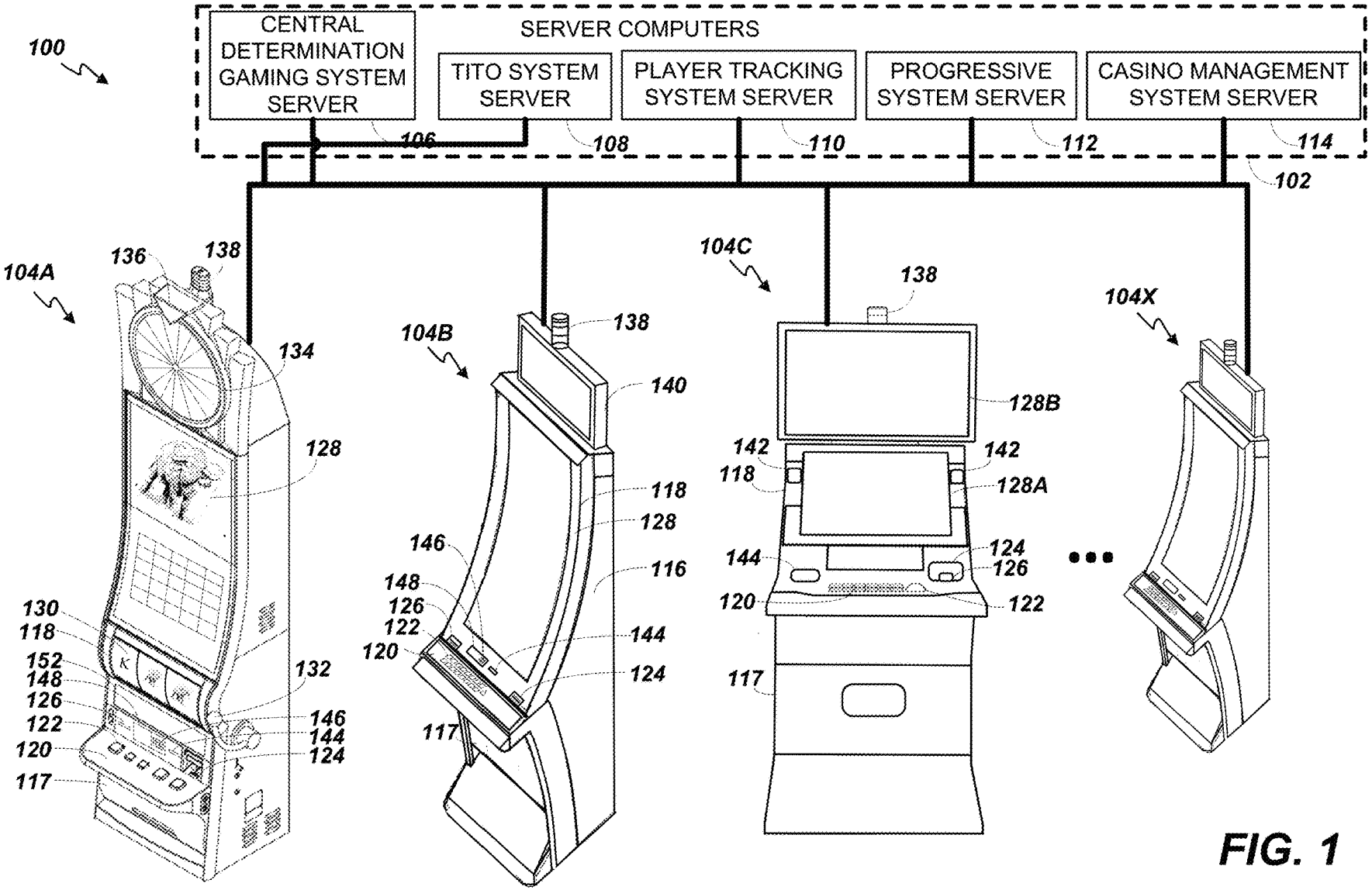
FIG. 1 is an example diagram showing several EGMs networked with various gaming-related servers.

The foregoing summary, as well as the following detailed description of certain embodiments of the present disclosure, will be better understood when read in conjunction with the drawings and appendices. For the purpose of illustrating the disclosure, certain embodiments are shown in the drawings and appendices. It should be understood, however, that the present invention is not limited to the arrangements and instrumentality shown in the attached drawings and appendices.

DETAILED DESCRIPTION

Referring to the drawings, there are shown example embodiments of gaming machines having components which enable the implementation of a base game from which a hold and spin feature game may be triggered.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console, although such devices may require specialized software and/or hardware to comply with regulatory requirements regarding devices used for wagering or games of chance in which monetary awards are provided.

Communication between the gaming devices 104A-104X and the server computers 102, and among the gaming devices 104A-104X, may be direct or indirect, such as over the Internet through a web site maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the server computers 102 described herein.

Moreover, in some implementations at least some of the EGMs may be "thin-client" or "thick-client" EGMs that are not configured for stand-alone determination of game outcomes, etc. Such client EGMs may be configured for communication with one or more of the different server computers 102 described herein, including but not limited to the central determination gaming system server 106. Some such client EGMs may, for example, be configured to accept tickets and/or cash (e.g., via a bill validator that also functions as a ticket reader) to load credits onto the client EGM, a "ticket-out" printer for outputting a credit ticket when a cash out button is pressed, a player tracking card reader, etc. Some client EGMs may include a transceiver for wireless communication with a player's mobile device, (e.g., for communication with a player's smartphone, tablet and/or mobile gaming device) a keypad 146, and/or an illuminated display 148 for reading, receiving, entering, and/or displaying player tracking information. A client EGM may include a display system, an audio system, etc., for presenting attract sequences, game presentations, etc. The game presentations may include game outcomes determined by another device, such as the central determination gaming system server 106.

The server computers 102 also may include a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over a network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 117 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 127 which may be used to determine an outcome to the game.

In many configurations, the gaming device 104A may have a main display 128 (e.g., video display monitor) mounted to, or above, the gaming display area 127. The main display 128 can be, e.g., a high-resolution LCD, plasma, LED, or OLED panel which may be flat or curved as shown, a cathode ray tube, or other conventional electronically controlled video monitor. The main display 128 may be of one or more various orientations (i.e., landscape or portrait), aspect ratios and resolutions. In some implementations, the main display 128 may include a touchscreen.

In some embodiments, the bill validator 124 may also function as a "ticket-in" reader that allows the player to use a casino-issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. The gaming device 104A may have hardware meters for purposes including ensuring regulatory compliance and monitoring the player credit balance. In addition, there can be additional meters that record the total amount of money wagered on the gaming machine, total amount of money deposited, total amount of money withdrawn, and total amount of winnings on gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in the EGM 104A. In such embodiments, a game controller (not shown in FIG. 1) within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2A:
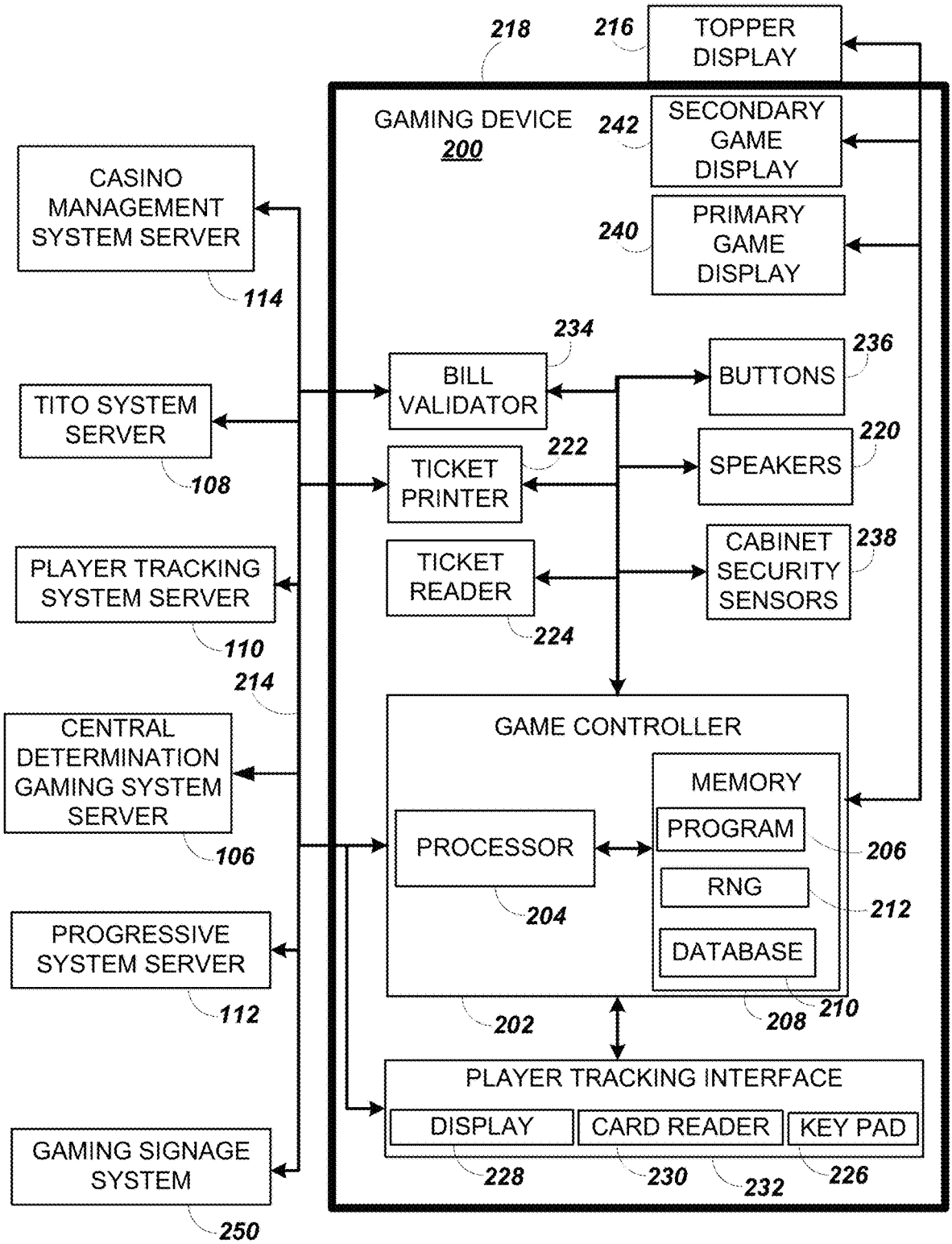
FIG. 2A is a block diagram showing various functional elements of an example EGM.

Many or all of the above-described components can be controlled by circuitry (e.g., a gaming controller) housed inside the main cabinet 116 of the gaming device 104A, the details of which are shown in FIG. 2A.

Note that not all gaming devices that are suitable for implementing embodiments of the present disclosure necessarily include top wheels, top boxes, information panels, cashless ticket systems, and/or player tracking systems. Further, some suitable gaming devices may have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that, where possible, reference numerals identifying similar features of the gaming device 104A embodiment are also identified in the gaming device 104B embodiment using the same reference numbers. Gaming device 104B does not include physical reels, but instead shows game play functions on main display 128. An optional topper screen 140 may be used as a secondary game display for bonus play to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 117 which opens to provide access to the interior of the gaming device 104B. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape-style main display 128A may have a curvature radius from top to bottom, or alternatively, from side to side. In some embodiments, main display 128A is a flat panel display. Main display 128A is typically used for primary game play while secondary display 128B is typically used for a bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class II or Class III, etc.

FIG. 2A is a block diagram depicting examples of internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (a play or round of the game) may be generated on a remote gaming device such as the central determination gaming system server 106 (not shown in FIG. 2A but shown in FIG. 1). The game instance may be communicated to gaming device 200 via the network 214 and then displayed on gaming device 200. Gaming device 200 may execute game software, such as, but not limited to, video streaming software that allows the game to be displayed on gaming device 200. When a game is stored on gaming device 200, it may be loaded from the memory 208 (e.g., from a read only memory (ROM)) or from the central determination gaming system server 106 to memory 208. The memory 208 may include random access memory (RAM), ROM or another form of storage media that stores instructions for execution by the processor 204.

The gaming device 200 may include a topper display 216 or another form of a top box (e.g., a topper wheel, a topper screen, etc.) which sits above main cabinet 218. The cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Some gaming devices, such as gaming devices 104A-104X, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming device 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player can view the game outcome on the primary game display 240 and/or the secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using a player interface system, which may include the player input buttons 236, the primary game display 240 (which may include a touch screen), or some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

In this example, the gaming device 200 is also configured for communication with a gaming signage system 250 via the network 214. Various examples of gaming signage systems 250 are provided herein. According to some examples, the gaming signage system 250 may be configured for communication with other elements of a gaming system via the network 214, such as the central determination gaming system server 106, the progressive system server 112, the player tracking system server 110 the casino management system server 114 and/or the TITO system server 108.

When the player is done, he/she cashes out the credit balance (typically by pressing a cash-out button to receive a ticket from the ticket printer 222). The ticket may be redeemed for money or inserted into another machine to establish a credit balance for play.

While an example gaming device 200 has been described in regard to FIG. 2A, certain aspects of the present disclosure may be implemented by gaming devices that lack one or more of the above-described components. For example, not all gaming devices suitable for implementing aspects of the present disclosure necessarily include top boxes, information panels, cashless ticket systems, and/or player tracking systems. Further, some suitable gaming devices may include a single game display having mechanical reels or a video display. Moreover, other embodiments may be designed for bar tables and have displays that face upwards.

Many different types of wagering games, including mechanical slot games, video slot games, video poker, video black jack, video pachinko, keno, bingo, and lottery, may be provided by the gaming device 200. In particular, the gaming device 200 may be operable to provide many different instances of games of chance. The instances may be differentiated according to themes, sounds, graphics, type of game (e.g., slot game vs. card game vs. game with aspects of skill), denomination, number of paylines, maximum jackpot, progressive or non-progressive, bonus games, class 2 or class 3, etc.

The gaming device 200 may allow a player to select a game of chance, skill, or combination thereof, to play from a plurality of instances available on the gaming device 200. For example, the gaming device 200 may provide a menu with a list of the instances of games that are available for play on the gaming device 200 and a player may be able to select, from the list, a game that they wish to play.

Figure 2B:
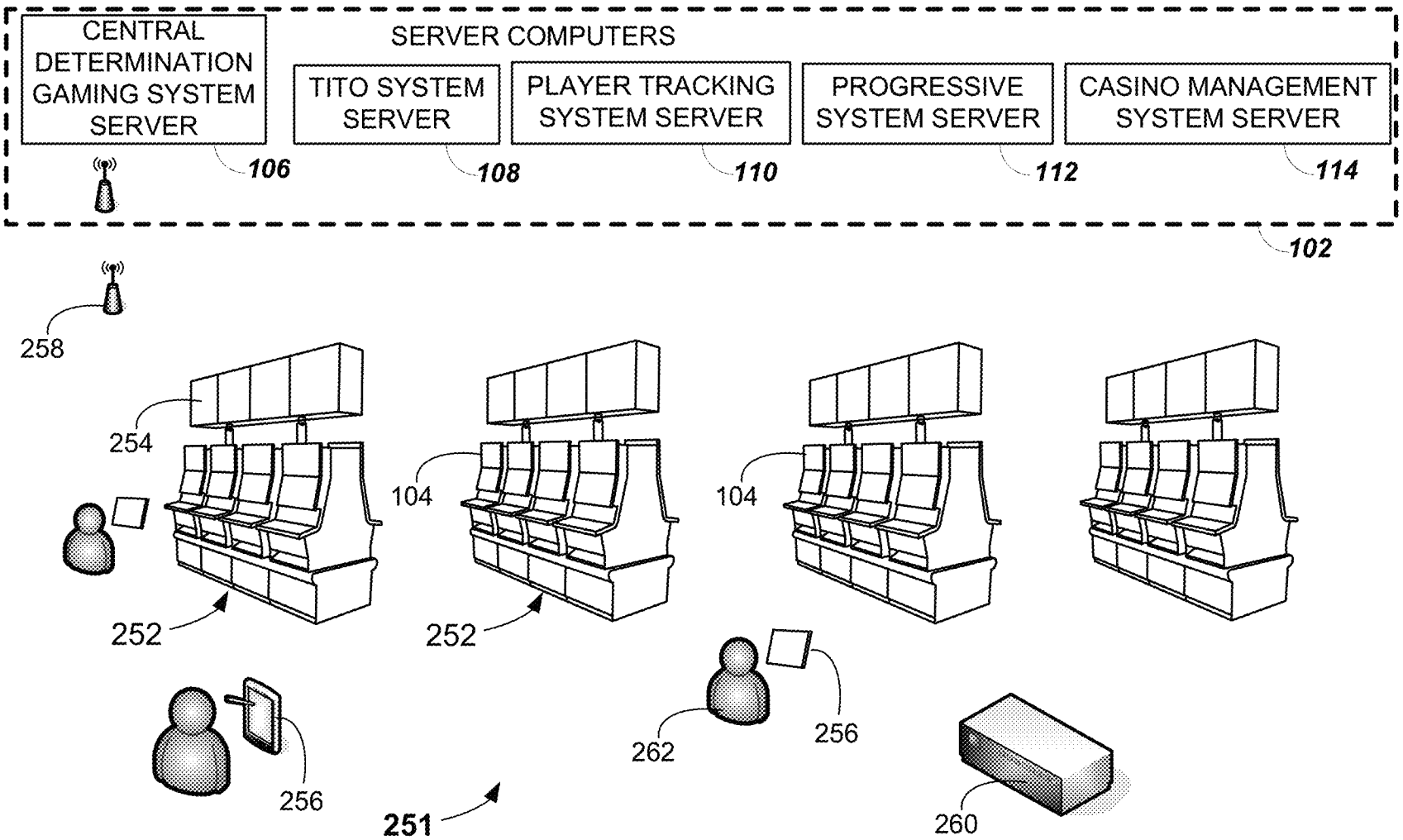
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254. According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
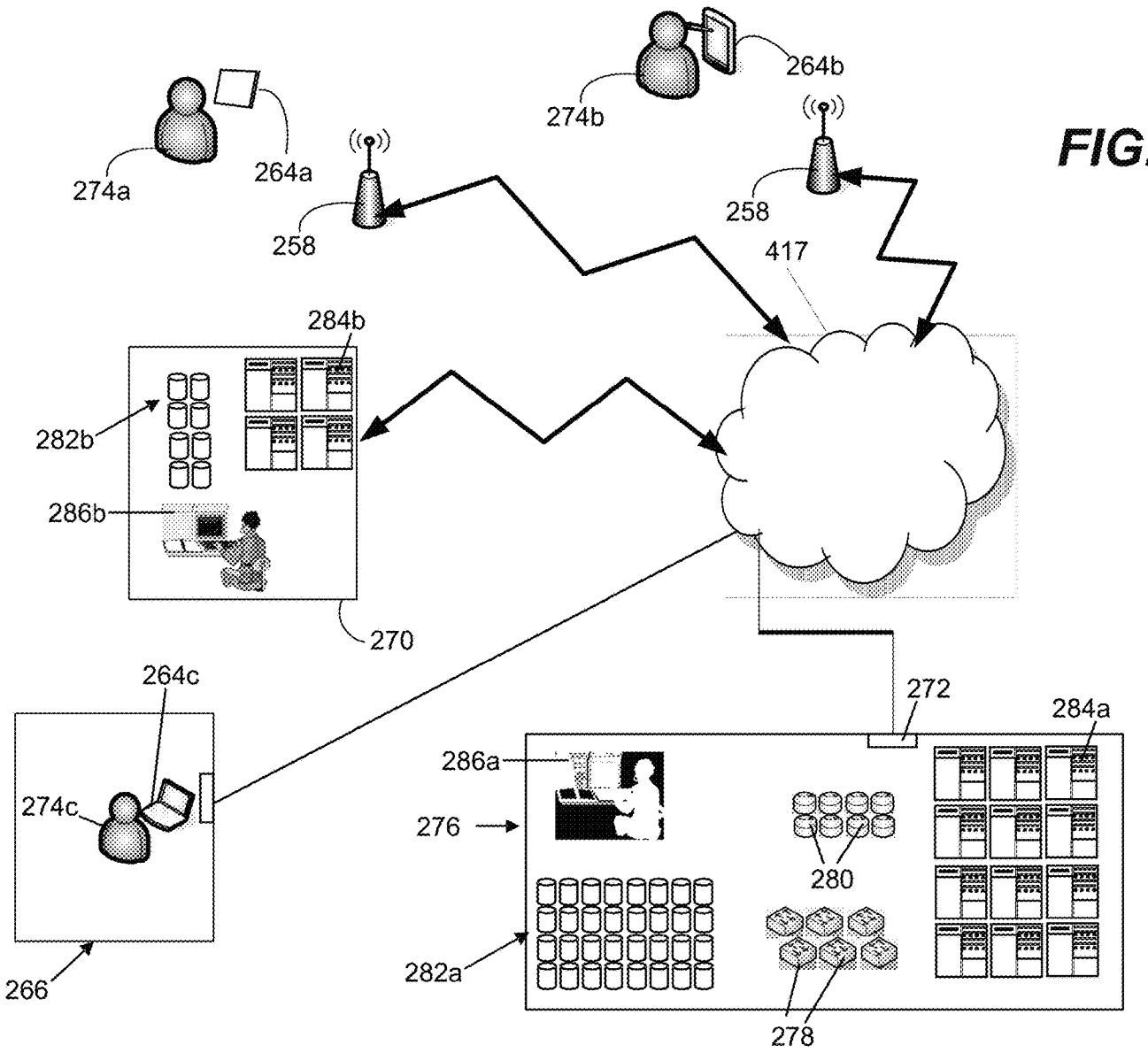
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3:
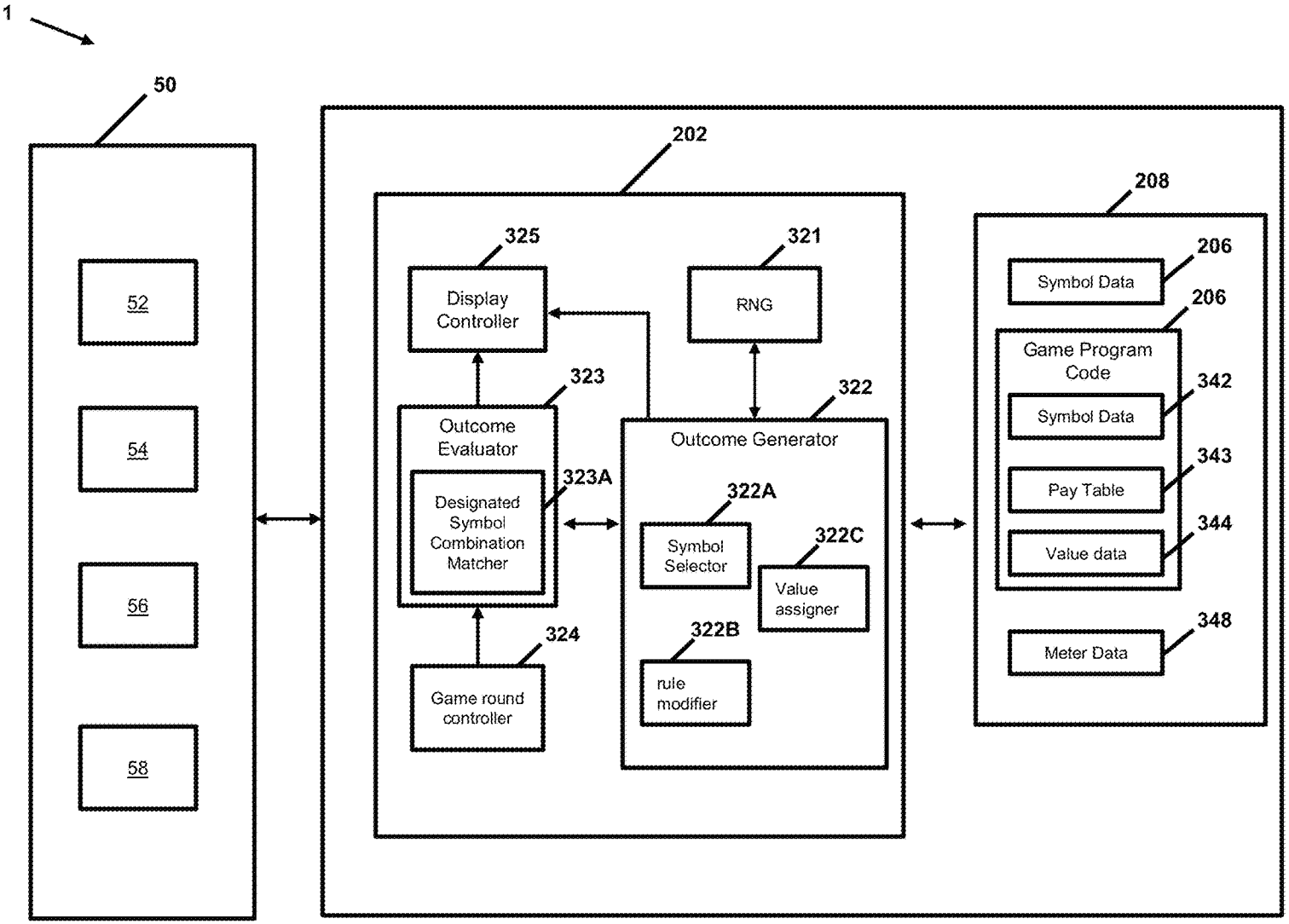
FIG. 3 is a further block diagram showing various functional elements of an embodiment of the game controller of FIG. 2A.

In FIG. 3, the processor 204 of game controller 202 of gaming device 200 is shown implementing a number of modules based on game program code 206 stored in memory 208. Persons skilled in the art will appreciate that several of the modules could be implemented in some other way, for example, by a dedicated circuit. The game controller 202 is an example of what may be referred to herein as a "control system." In some implementations, the control system also may include the memory 208. Other examples of control systems are disclosed herein.

According to this example, these modules include an outcome generator 322 which operates in response to the player's operation of player input buttons 236 to place a wager and initiate a play of the game and generates a game outcome which will then be evaluated by outcome evaluator 323. In some examples, the first part of forming the game outcome may be for a symbol selector 322A to select symbols from a set of symbols specified by symbol data 342 using a random number generator 321. The selected symbols may be advised to the display controller 325, which causes them to be displayed as a symbol display on primary game display 240 at a set of display positions.

In certain embodiments, the symbol data 342 includes one or more virtual reels that correspond to one or more reels displayed by the primary game display 240. The virtual reels may include an arrangement of symbols selected from symbol data 342 in, for example, a predetermined or random manner. The symbol selector 322A may select a stop position for the one or more virtual reels based on one or more outcomes of the random number generator 321. The stop position of the one or more reels then determines the symbols that are selected on the primary game display 240. In some alternative implementations, the functionality of one or more of the modules shown in FIG. 3 may be implemented in another device, e.g., in a server. For example, the functionality of the RNG 321, the outcome generator 322, the outcome evaluator 323 and/or the game round controller 324 may be implemented in a device that is configured for communication with the gaming device 200.

In the embodiment described below, the display positions of the symbol display are arranged in a rectangular matrix comprising a plurality of columns and a plurality of rows. However, other arrangements known in the gaming industry could be employed in embodiments of the disclosure. For example, in some arrangements, there are more symbols in some columns than in others, such as 3-4-3-4-3 arrangement of seventeen display positions corresponding to respective ones of five reels. In such arrangements, the columns of four symbols can be arranged so that they are off-set or staggered relative to the columns having two symbols so that the middle two symbols in the columns of four symbols share boundaries with two symbols of each neighboring reel.

Figure 4:
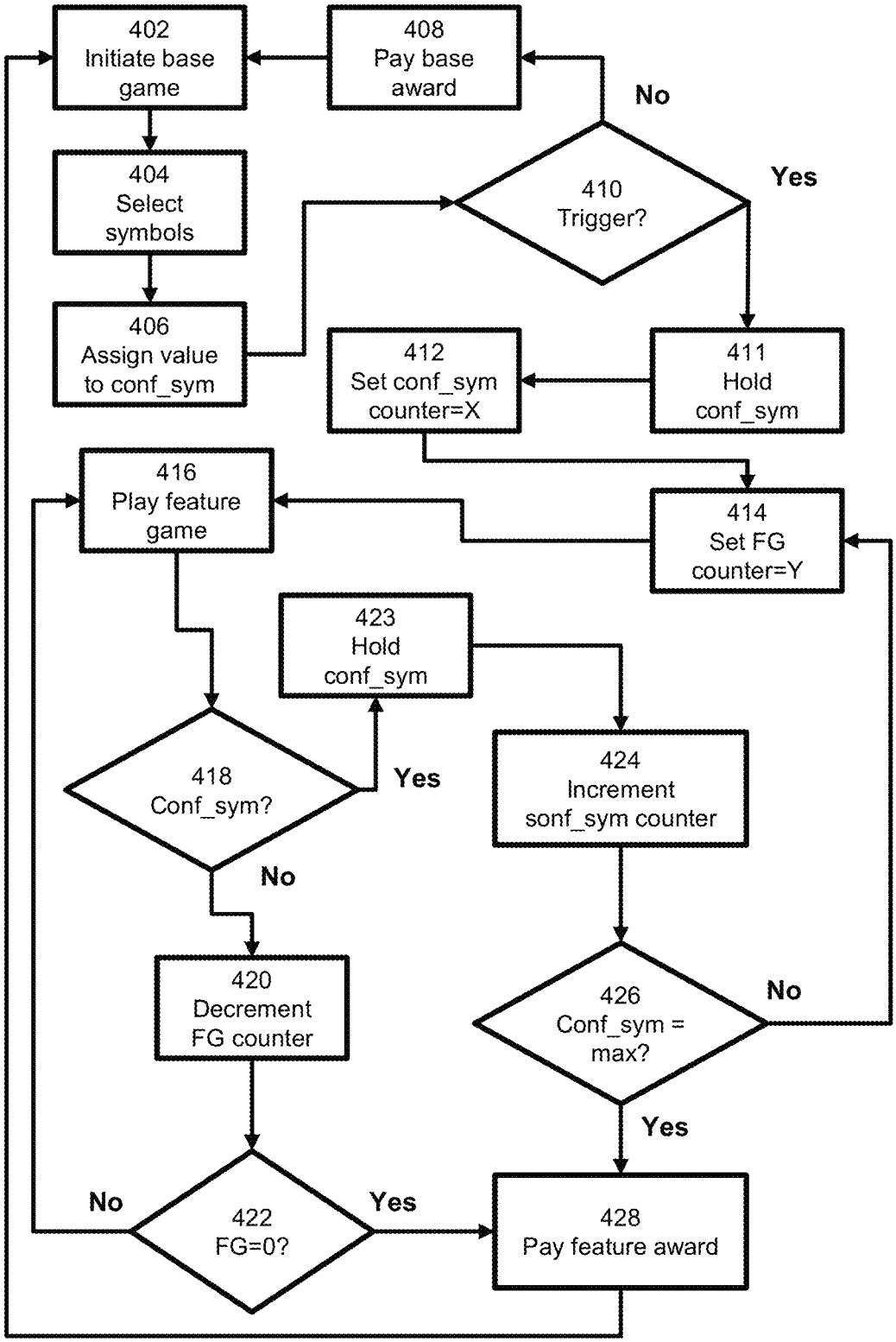
FIG. 4 is a flow diagram for an example embodiment of a process for operating the EGM of FIG. 2A in accordance with various aspects of the present disclosure.

FIG. 4 shows a flow diagram of one embodiment in which a feature game may be triggered from play of the base game at step 402. In this embodiment, the base game comprises using symbol selector 322A of FIG. 3 to select a plurality of symbols from a set of symbols to display at the respective display positions arranged on primary game display 240 at step 404. The set of symbols, which are stored as symbol data 342 in memory 208 according to this example, comprises a plurality of configurable symbols and non-configurable symbols.

Figures 6A, 6B, 6C:
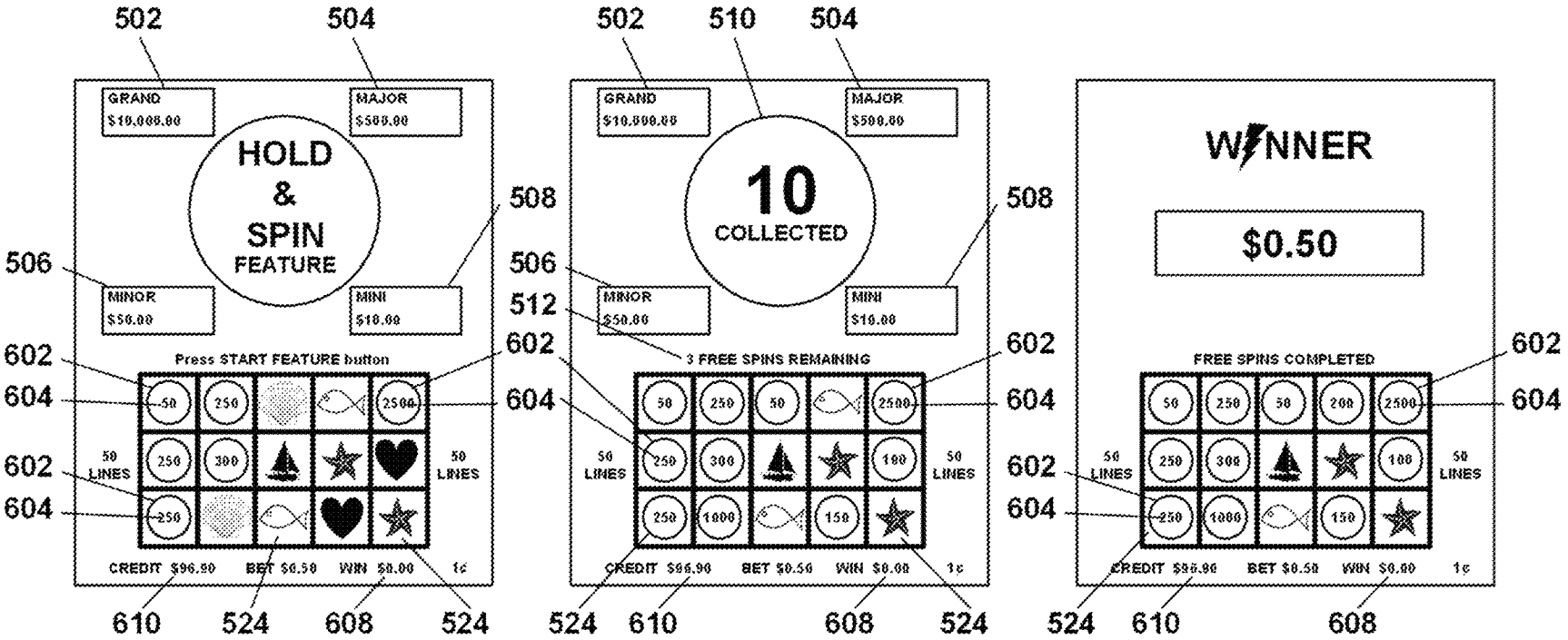
FIGS. 6A to 6C are screenshots of an embodiment of the feature game of FIG. 4.
Figure 7B:
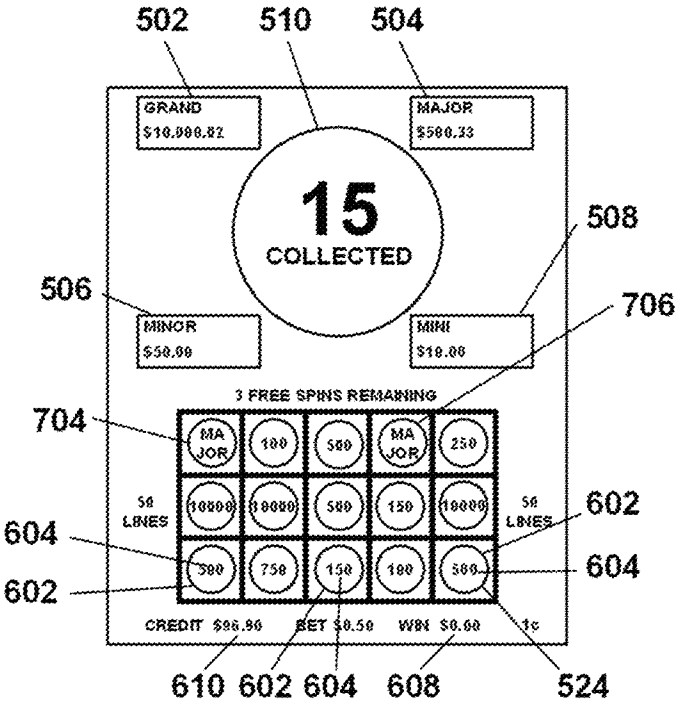
FIGS. 7A and 7B are screenshots of an embodiment of the feature game of FIG. 4, showing one of the progressive jackpots being awarded.
Figure 7A:
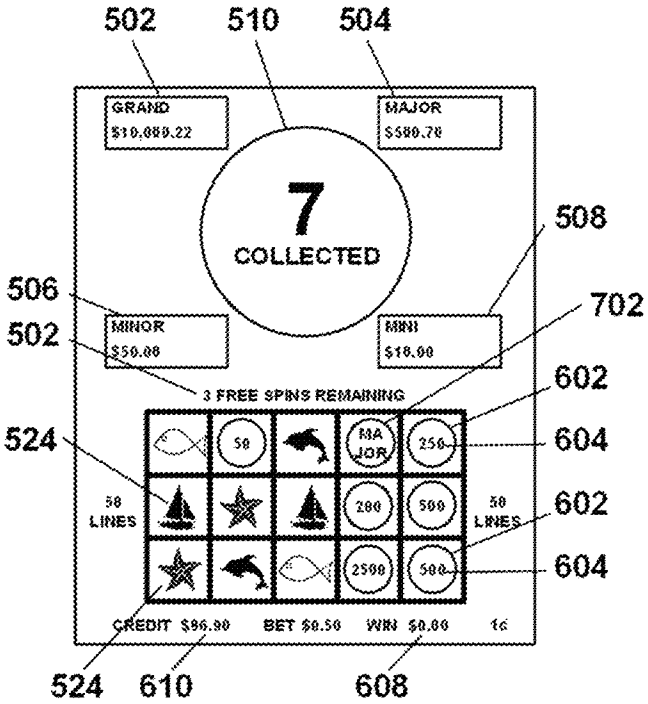

In an embodiment, the configurable symbols each comprise at least a common component and at least a variable component. The variable component is indicative of a value of a prize that is associated with each of the configurable symbols. An example of a configurable symbol is shown in FIGS. 6A-6C in the form of a pearl symbol. The common component is the pearl itself 602, while the variable component is the indicia 604 overlaying pearl 602. In this case, indicia are numerals directly indicative of the value of the prize. In other embodiments, as shown in FIGS. 7A-7B, the indicia indirectly indicates the value of the prize, such as "major" indicia 702, "minor" indicia 704 or "mini" indicia 706. It will be appreciated that the indicia can also be in other forms which may also be indicative of a prize. For example, a car icon may indicate that the player has the opportunity to, or has, won a car. In some embodiments, the indicia may indicate only a portion of a prize. Continuing with the car example, the car icon may be split into four portions, each portion being assigned to a different configurable symbol. In such embodiments, all four portions of the car icon are required to be selected for display in order for the car prize to be won.

In some embodiments, at least one value of the respective prizes is generated by randomly selecting one of a plurality of defined multipliers that is applied to an amount wagered on the base game from which the feature is game triggered. According to some such embodiments, this may be accomplished at step 406 using value assigner 322C, which selects the predefined multipliers from value data 344 using a value obtained from the random number generator (RNG) 321, applies the multiplier to the initial wager to obtain a prize value and assigns the prize value to each of the configurable symbols selected by symbol selector 322A. The plurality of defined multipliers in some such embodiments may be selected at random according to a weighted probability based at least in part on the amount wagered on the base game. That is, the value assigner 322C may obtain a value from RNG 321 and may use this value to determine from the weighted table which value to assign to a configurable symbol. In an embodiment, the assignment of values to the configurable symbols is performed by the value assigner 322C after the symbols have been selected and the game controller knows they will be displayed but before they are displayed on the display. In another embodiment, the assignment occurs after the symbols have been displayed on display 240. In another embodiment, values are assigned to all configurable symbols irrespective of whether they will be displayed.

In this or other embodiments, at least one value of the respective prizes may comprise a defined value and/or a jackpot. As used herein, the term "jackpot," as opposed to "prize," refers to a progressive prize which accumulates over multiple plays of the base game and/or the feature game. As will be appreciated, the jackpot may be funded from a variety of sources including from only the gaming machine 200 itself, or from a plurality of gaming devices 200—a so-called "link". Furthermore, the jackpot may be triggered by any means known in the art, such as by using a mystery trigger or by using the Hyperlink™ system developed by the applicant.

In another embodiment, the variable prizes may be randomly selected (e.g., under the control of value assigner 322C) from a set of available prizes. Specific prizes may be weighted so as to control the probability of certain prizes occurring. In some embodiments, there may be a plurality of sets of prizes and the value assigner 322C may be configured to choose the set of prizes from which values will be randomly selected on the basis of a player's wager in the base game.

Returning to FIG. 4, at step 410, play of the base game is monitored (e.g., by the outcome evaluator 323) and it is determined whether a trigger event has occurred. In this embodiment, a trigger event occurs when six configurable symbols appear on primary game display 240. If a trigger event has not occurred, play of the base game continues and control reverts to step 402 once any awards are paid at step 408. However, if a trigger event does occur, the feature game (which may also be referred to herein as a "feature" or a "feature game round") initiates by first holding the configurable symbols in their respective display positions 524 at step 411. In this example, outcome generator 322 causes the feature game to be displayed on display 240 by retrieving symbol data 342 from memory 208 and passing the data to display controller 325, which controls display 240 to display the feature game. In other embodiments, more than or less than six symbols will be required to trigger the feature game. Alternatively, or additionally, the feature game may be modified in a way that is proportional to the number of configurable symbols that are displayed to trigger the feature game. For example, the average or total prize achievable in the feature game may be increased in proportion to the number of configurable symbols appearing.

Figure 5:
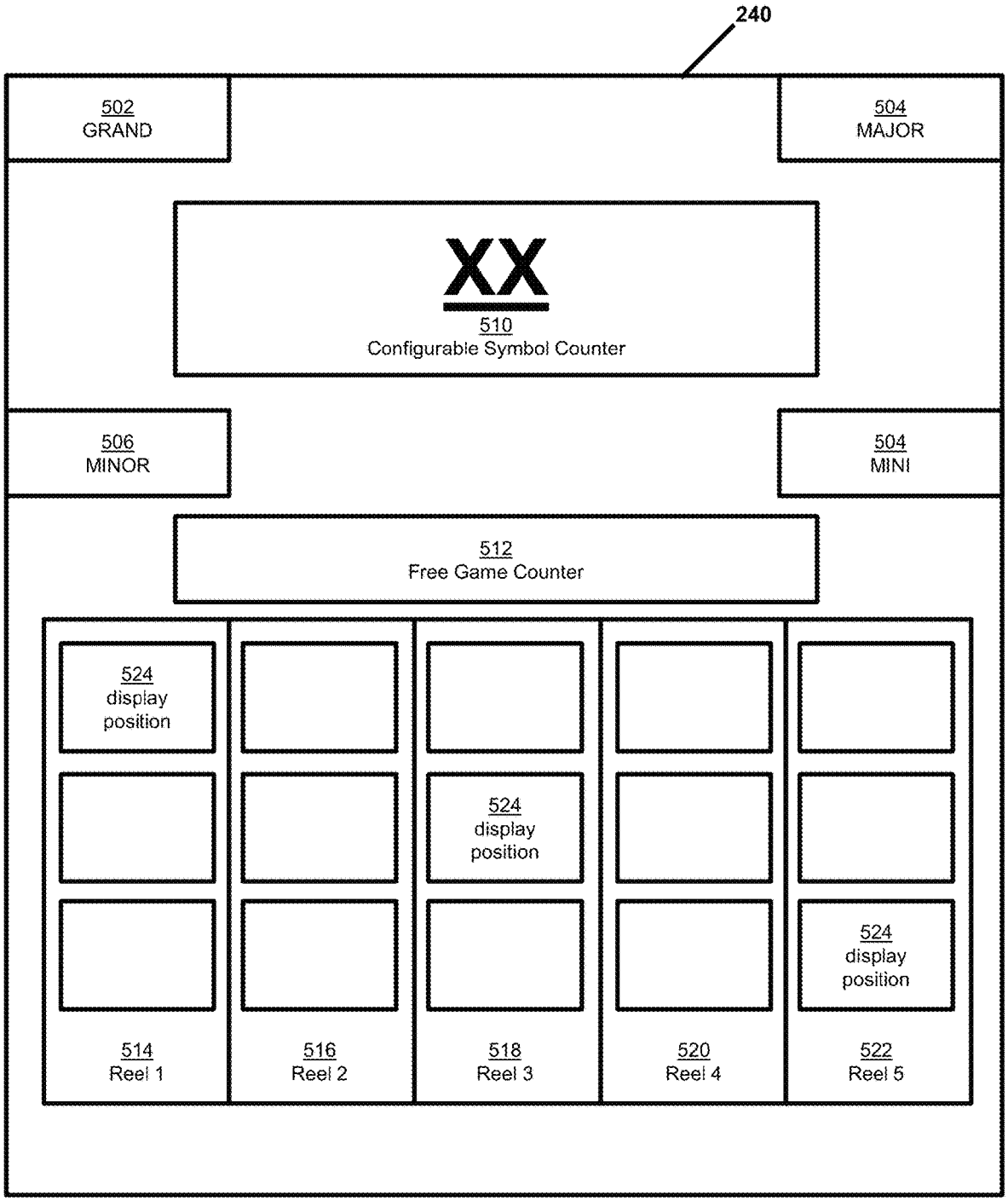
FIG. 5 is a representation of an example screen of the feature game of FIG. 4.

When the feature game starts, in various embodiments, the configurable symbol counter 510 of FIG. 5 is set to the number of configurable symbols that are held on reels 514-522 at step 412. In some embodiments, this is also the number of configurable symbols which originally triggered the feature game. That is, in some such embodiments, the configurable symbol counter 510 is initially set to 6, as six configurable symbols trigger the feature game. Alternatively, for example, if seven configurable symbols are selected for display, but only six are required for triggering the feature game, the configurable symbol counter 510 may be initially set to seven.

Once configurable symbol counter 510 is set, control moves to step 414 (FIG. 4) which sets free game counter 512 to the defined number of free games. In an embodiment, the preferred number of free games is three, so free game counter 512 is set to three. In other embodiments, the number of free games may be more than or less than three. For example, in some embodiments the number of free games may be 2, 4, 5, 6, 7 of 8. According to some implementations, the number of free games may be derived (e.g., by the game controller) from the number of configurable symbols that appear. For example, an additional free game may be offered for each configurable symbol that appears in addition to a predefined minimum number of configurable symbols (for example, six) that may be required to trigger the feature game.

Then, similar to the base game, symbols may be selected from symbol data (e.g., the symbol selector 322A may select symbols from symbol data 342) to be displayed in the other display positions 524 not already displaying a configurable symbol (e.g., via display controller 325) at step 416. Note that in certain embodiments, symbols in the feature game may be selected from a full set of available symbols (e.g., the full set of symbols defined by symbol data 342), including any configurable symbols. In other embodiments, the symbols may be selected from a reduced set of symbols, taking into account any configurable symbols already held. For example, in one or more embodiments, only value symbols and blank symbols, i.e., a reel strip position not having any symbol, may be available for selection (e.g., by the symbol selector 322A). In an alternative embodiment, the symbols may be selected from an increased set of symbols. For example, symbols may be purchased or otherwise awarded for addition to the reel strip prior to initiating the feature game round. If one or more configurable symbols are selected, in this example value assigner 322C assigns randomly selected values to each configurable symbol.

According to this example, outcome evaluator 323 then monitors play of the feature game to determine whether a configurable symbol is selected and displayed at step 418. If a configurable symbol is not displayed, free game counter 512 is decremented by a defined amount, such as one, at step 420 in this example. In other embodiments, the free game counter 512 may be decremented by an amount, such as one, regardless of whether a configurable symbol is displayed.

If there are a number of free games remaining (for example, as determined by controller 202) at step 422, control returns to step 416 to continue the feature game round. On the other hand, once the number of free games is depleted, that is, when the free game counter 512 reaches zero, the feature game round ends and control returns to step 402 after any prizes are paid at step 428. In one embodiment, the accumulated value of all the individual prizes as indicated by the variable components of the collected configurable symbol is paid at step 428.

Returning to step 418, if it is determined (e.g., by outcome evaluator 323) that at least one configurable symbol is displayed on reels 514-522, then that symbol is held on the reel, at step 423, and the configurable symbol counter 510 is incremented at step 424. According to this example, it is then determined (e.g., by outcome evaluator 323) whether a defined number of configurable symbols has been displayed on reels 514-522 at step 426 and, if the defined number has been reached, a jackpot is paid at step 428.

The defined number of configurable symbols required to trigger a jackpot in certain embodiments is fifteen. That is, in certain embodiments in which a game is implemented using a 5×3 matrix, configurable symbols must be selected and displayed in all the matrix positions of reels 514-522. In other embodiments, the defined number may be more than or less than fifteen. For example, in a 3-4-3-4-3 matrix configuration as discussed above, the number of configurable symbols required to fill all matrix positions would be 17. In yet other embodiments, not all of the matrix positions need to necessarily be filled, and the number of configurable symbols required may be determined randomly.

In the above embodiments, the feature game ends when the Grand jackpot 502 is triggered at step 426. In other embodiments, the feature game round does not necessarily end at this point. In such embodiments, one or more of reels 514-522 are configured to expand and display additional configurable or non-configurable symbols when configurable symbol counter 510 reaches the defined number. For example, a game implemented using a 5×3 matrix may expand to a different configuration such as a 3-4-3-4-3 configuration. In such embodiments, a prize in addition to the Grand jackpot 502 is paid if configurable symbols are also selected for display in those additional positions.

Alternatively, if it is determined (e.g., by outcome evaluator 323) that the defined number of configurable symbols has not been reached at step 426, the feature game round may continue in some examples. In the embodiment of FIG. 4, each time a configurable symbol is displayed and the jackpot is not won, free game counter 512 is reset to the initial quantity by returning control to step 414, which, in this embodiment, is three as noted above. Therefore, the number of free games awarded by the outcome evaluator 323 is indefinite and is not determined by a defined limit.

In some embodiments, if no additional configurable symbols appear on reels 514-522 in any of the free games initially awarded, free games counter 512 is reset. Such embodiments ensure the player is guaranteed to win a prize over and above the prize payable for triggering the feature game.

In the above embodiments, the jackpot paid in response to configurable symbol counter 510 reaching the defined threshold is Grand prize 502. The Grand prize in this embodiment is a linked jackpot which receives contributions from a plurality of linked gaming machines and incremented based on the turnover of the linked machines. A linked jackpot may be a single site progressive (SSP), a multiple site progressive (MSP) or a wide area progressive (WAP). In some embodiments, a lower threshold of configurable symbols may be required for Major prize 504, Minor prize 506 or Mini prize 508 to be won. Alternatively, or additionally, as shown in FIGS. 7A and 7B, Major, Minor and Mini prizes may be paid by assignment of those prizes to one of the configurable symbols, such as "major" indicia 702, "minor" indicia 704 or "mini" indicia 706.

Note that in some embodiments, one or all of the Grand prize 502, Major prize 504, Minor prize 506 and Mini prize 508 may be implemented as jackpots, as fixed bonus amounts that do not increment or as a mixture of both. In the embodiment of FIGS. 6A to 7B, as noted above, Grand prize 502 is implemented as a linked progressive jackpot, while Major prize 504 is implemented as a stand-alone progressive (SAP) jackpot which only takes contributions from the gaming machine itself, incrementing the jackpot as a function of turnover. Minor prize 506 and Mini prize 508 are implemented as fixed bonus amounts in proportion to the initial bet wagered. In some embodiments, Grand prize 502 may also be implemented as an SAP or the Major prize 504 may also be implemented as a linked jackpot.

This embodiment implements Grand prize 502 and Major prize 504 are jackpots and, while both may be awarded simultaneously, neither can be awarded more than once in the same feature game. However, in other embodiments, either jackpot may be won multiple times within the same feature game. In such embodiments, players are awarded a seed value (i.e., reset value) of the jackpot for subsequent triggers of that same jackpot.

As some embodiments of the feature game described above automatically adjust awards based on turnover and proportionality to the initial wager, such embodiments may be particularly suited to variable denomination games. Therefore, in some embodiments, controller 202 allows player selection of the minimum bet denomination. For example, before play of the game, controller 202 causes display controller 325 to output a message on display 240 requesting the player to select a minimum bet denomination. The player makes a selection through the game play mechanism 56 in response to which controller 202 adjusts the amount contributed to Grand prize 502 and Major prize 504 and the magnitude of Minor prize 506 and Mini prize 508. Controller 202 also adjusts the weightings of the values in value data 344 from which value assigner 322C may assign to the configurable symbols. In one embodiment, there are four denominations available for selection, 1c, 2c, 5c, and 10c. Those skilled in the art will appreciate that the denominations are not limited to four, but instead may include any suitable amount in any given currency. Note also that in this embodiment, while the selected denomination affects the magnitude of the Minor prize 506 and Mini prize 508, it does not affect the magnitude of the Grand prize 502 and Major prize 504.

EXAMPLES

More specific examples of embodiments of the present disclosure are now described with reference to FIGS. 6A to 7B. In general, as shown in these figures, the embodiment has a traditional 3×5 grid layout and is referred to in the examples below as the "hold and spin" feature.

Referring to FIG. 6A, the hold and spin feature is triggered when six (6) pearl symbols 602 are selected for display. When triggered, pearls 602 are held in their respective display positions, being all of column 1, column 2 at rows 1 and 2, and column 5 at row 1, and the controller 202 waits for a player instruction to initiate the game through player input buttons 236. In some embodiments, controller 202 will wait indefinitely while in other embodiments, controller 202 will wait for a predefined period of time before automatically initiating the game.

At this point, configurable symbol counter 510 is set to 6, and the player is guaranteed to win the accumulated value as indicated by the indicia 604 of the six pearls 602. That is, even before play of hold and spin starts, the player has won 3,600 credits in the embodiment of FIG. 6A.

Moving on to FIG. 6B, the player has spun an additional four (4) pearls 602. Accordingly, configurable symbol counter 510 is incremented from 6 to 10 and free games counter 512 is reset to the initial quantity, which is 3 feature games in this embodiment. As compared to FIG. 6A, the additional pearls 602 are selected for display at display positions C2R3, C3R1, C4R3 and C5R2, and are also held at those positions for the subsequent games. In various embodiments, instead of resetting the free games counter to the initial quantity, the free games counter may be decremented by one for every spin that does not result in additional configurable symbols being displayed, and may not decrement by one when additional configurable symbols are displayed.

Over the remaining feature games, the player spins only one (1) additional pearl 602, displayed at C4R1, as shown in FIG. 6C. Accordingly, the free games end and the player wins the accumulated value of the values indicated on pearls 602. In this case, the total award is the 4,300 credits for the six (6) pearls 602 that originally triggered the hold and spin game, plus the additional five (5) pearls 602 selected during play of the hold and spin game—5,100 credits. In this embodiment, the accumulated award is totaled at the end of the hold and spin game and first transferred to the win meter 608 before being transferred to the credit meter 610 by the controller 202. Meter data 348 is adjusted accordingly before the next game can be initiated at step 402. In alternative embodiments, the accumulated award may bypass the win meter and be credited directly to the credit meter.

FIGS. 7A and 7B are examples showing the jackpots being won. In FIG. 7A, value assigner 322C has assigned "Major" indicia 702 to pearl 602, which has been selected for display at C4R1. This triggers Major prize 504 which, in one embodiment, is paid directly into credit meter 610 rather than first into win meter 608. That is, jackpot wins may be paid immediately when they are won rather than being accumulated at the end of the hold and spin game as per the other prizes described above. Thus in the FIG. 7A embodiment, Major jackpot 504 is paid when the associated pearl 602 is selected, while the remaining 4,000 credits will be accumulated and paid at the completion of the feature game, in addition to any new pearls 602 that are selected and displayed in the remaining free games. In alternative embodiments, the Major jackpot may be accumulated at the end of the feature game along with the other 4,000 credits, and the accumulated total may be paid first into win meter 608 or directly into credit meter 610.

FIG. 7B shows Grand jackpot 502 being triggered, as fifteen (15) pearls 602 have been selected for display in the matrix by the end of the feature game. Again, the Grand prize 502 is first accounted for and paid directly into credit meter 610, and the remaining prizes indicated by indicia 604 on pearls 602 are then accumulated and paid into win meter 608 before being transferred to credit meter 610. Therefore, in this FIG. 7B embodiment, the total winnings is made up of the initial Grand jackpot 502, plus 33,500 credits indicated by indicia 604 and Minor prize 506 and Mini prize 508 indicated by "Minor" indicia 704 and "Mini" indicia 706. Again, in alternative embodiments, the Grand jackpot may be accumulated at the end of the feature game along with the other 33,500 credits, Minor prize 506 and Mini prize 508, and the accumulated total may be paid first into win meter 608 or directly into credit meter 610. In various embodiments, since all available symbol display positions display the configurable symbols, e.g., pearls, at the end of the feature game, an additional prize such as a multiplier may be applied. The multiplier may be predetermined, such as a 2× multiplier, or randomly determined.

In another example, the configurable symbols may only be provided during part of the game, such as a feature game. In another example, after a feature game is triggered, a feature game may be initiated (e.g., by the game controller 202) using different reels to those used in the base game. Depending on the embodiment, the trigger may be the configurable symbol trigger described above or some other trigger, e.g., a symbol combination. In this example, in the feature game, individual reels are associated with each of the symbol display positions. That is, if there are fifteen symbol display positions, fifteen reels are used. Each of the reels may include a mixture of non-configurable symbols and configurable symbols. Before the free games, in some examples the configurable symbol counter is set to zero and none of the configurable symbols that trigger the free game are held over to the free game. In the first free game, the symbol selector determines stopping positions for all of the reels in some such examples. If any of the reels are stopped with a configurable symbol in place, that configurable symbol may be held in position by holding/locking the reel (i.e., not spinning the reels in a subsequent free game). That is, in subsequent free games according to this example, only the reels corresponding to symbol positions where a configurable symbol has not been displayed are re-spun. Each configurable symbol is assigned a value by value assigner by selecting a prize value from a set of prize values. The set of prize values from which values are selected depends on the player's wager in the base game. As in the example described above, a player is awarded the sum of the values of the configurable symbols at the end of the free games and may be awarded an additional prize such as a jackpot prize depending on what value the counter reaches during the free games.

In various embodiments, the prize value of each of the configurable symbols is predetermined on the basis of a selected wager amount and/or selected denomination value. In various embodiments, the prize value of each of the configurable symbols is determined (e.g., by the game controller 202) in response to a wager. In certain of these embodiments, the prize value may be determined on the basis of the selected wager amount and/or selected denomination.

In another example, the configurable symbol may have an alternative visual representation, for example, a door which opens once the configurable symbol is displayed in a display position to reveal the assigned prize value.

As indicated above, the method may be embodied in program code. The program code could be supplied in a number of ways, for example, on a non-transitory computer readable storage medium, such as a disc or a memory device, e.g. an EEPROM, (for example, that could replace part of memory 103). In some examples, the program code may be provided via data signals (for example, by transmitting the program code from a server). Further, different parts of the program code can be executed by different devices, for example, in a client-server relationship. Persons skilled in the art will appreciate that program code provides a series of instructions executable by a control system, e.g., via one or more processors.

Repeater Symbols & Mystery Symbols

FIGS. 8A to 8M are screen shots of a display, such as the primary game display 240, at different phases during play of a base game and an ensuing feature game according to an embodiment of the present disclosure. Instead of a pearl as described above, the configurable symbol in this embodiment is illustrated as a rectangle overlying a diamond. As will be appreciated, the configurable symbols can take a variety of other forms in accordance with the theme of the underlying game.

Figure 8A:
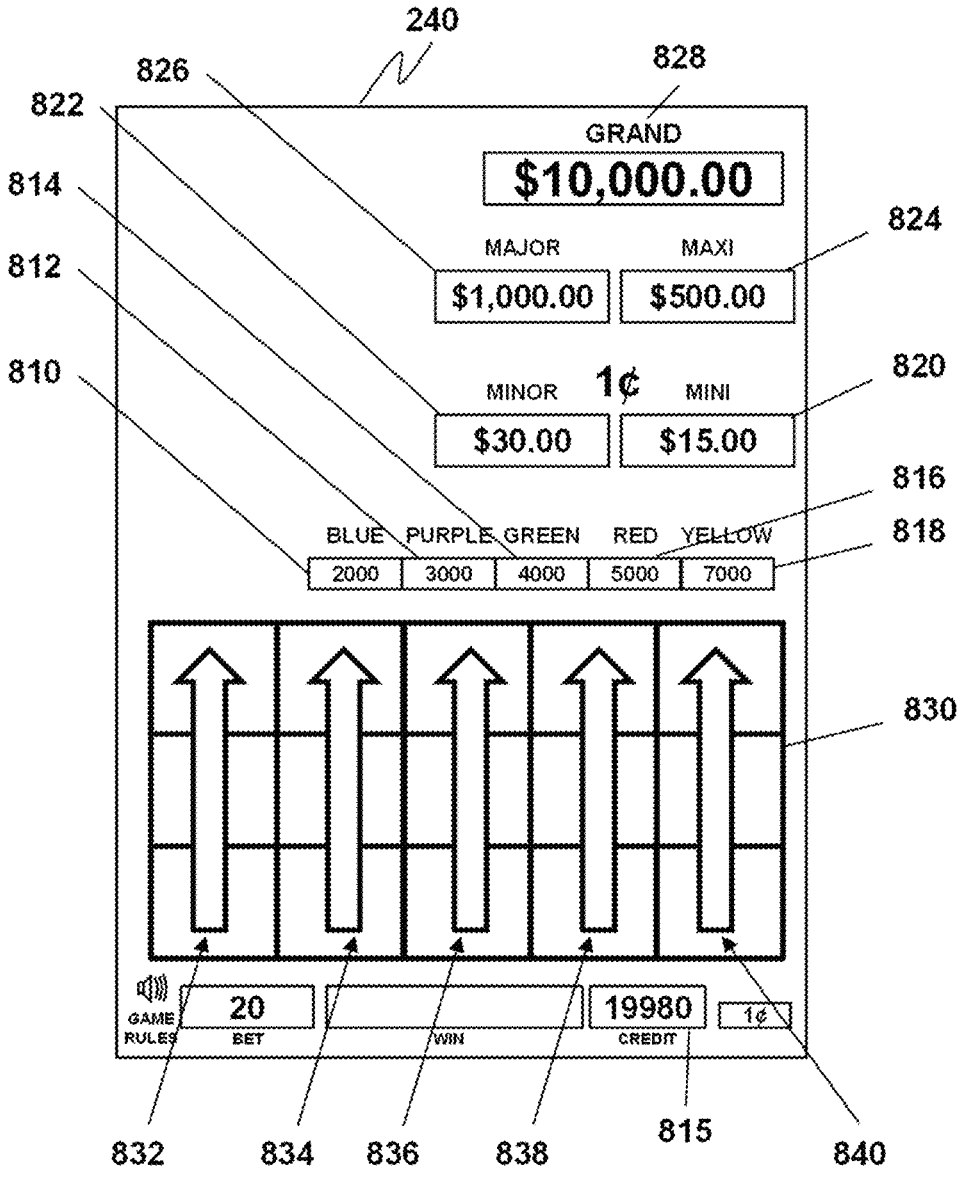
FIGS. 8A to 8M are screen shots of another embodiment of a feature game.
Figure 8B:
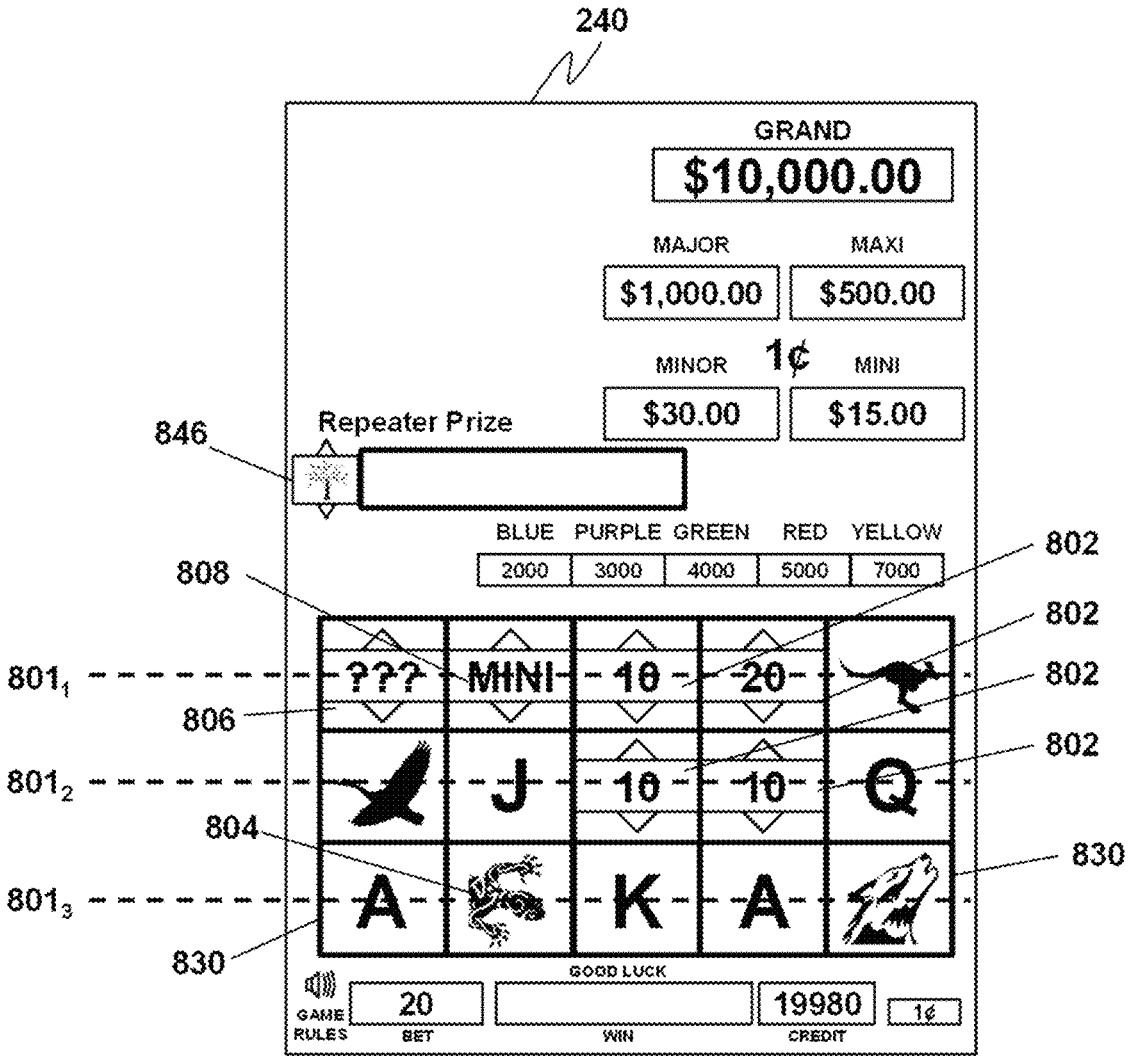

In this embodiment, there may be multiple types of configurable symbols, including value symbols 802 (see, e.g., FIG. 8B), repeater symbols 804 (see, e.g., FIG. 8H), mystery symbols 806 (see, e.g., FIG. 8B), and jackpot symbols 808 (see, e.g., FIG. 8B). Each value symbol 802 displays a numeric value, e.g., a number of credits or currency. The repeater symbol 804 and mystery symbol 806 each display a respective generic symbol but no associated value. In the illustrated embodiment, the repeater symbol 804 displays a tree and the mystery symbol 806 displays question marks. Each jackpot symbol 808 displays the name of a particular jackpot, e.g., a MINI jackpot 820, MINOR jackpot 822, MAXI jackpot 824, MAJOR jackpot 826 or GRAND jackpot 828.

In various embodiments, there may be different levels of the configurable symbols that allow a player to play for different payout levels, for example. The illustrated embodiment, for example, includes 5 different levels of configurable symbols that are designated by different colored configurable symbols, namely, blue configurable symbols 810, purple configurable symbols 812, green configurable symbols 814, red configurable symbols 816, and gold configurable symbols 818.

The color level that is played during a game may be selected based on a player input, such as a betting denomination or an ante bet. In an embodiment, the player places a base bet and in addition may make an ante bet, where the amount of the ante bet entitles the player to increased values on the value symbols and/or different levels of configurable symbols. In the illustrated embodiment, there are five different ante bets where each is associated with a different colored configurable symbol. Larger ante bets entitle the player to configurable symbols with larger credit values and larger jackpot symbols. For example, a first ante bet amount may be associated with blue configurable symbols that carry values up to 2000 credits and MINI jackpot symbols, a second ante bet amount may be associated with purple configurable symbols that carry values up to 3000 credits and MINOR jackpot symbols, a third ante amount bet may be associated with green configurable symbols that carry values up to 5000 credits and MAXI jackpot symbols, a fourth ante bet amount may be associated with red configurable symbols that carry values up to 5000 credits and MAJOR jackpot symbols, and a fifth ante bet amount may be associated with gold configurable symbols that carry values up to 7000 credits and Grand jackpot symbols. Other ranges of values may be used, as will suggest itself. Thus, the player makes an ante bet that causes the reels to carry configurable symbols in a particular range of values.

In addition, the player may select a particular denomination from a plurality of denominations. For example, the player may select a denomination of 1 cent, 2 cents, 5 cents or 10 cents. In some embodiments, the number of configurable symbols required to trigger the feature game may vary depending on the denomination selected by the player. For example, a selection of a denomination of 1 cent or 2 cents may require 6 (six) configurable symbols to appear in the base outcome in order to trigger the feature game, while a denomination selection of 5 cents or 10 cents may cause the feature game to be triggered when 5 (five) configurable symbols appear in the base game outcome.

Alternatively, the selection of the denomination may provide some kind of incentive with respect to some element of the game. For example, a selection of a high denomination may add a new jackpot to the game, or may add more spins to the feature game.

Alternatively, when an ante bet is made, rather than providing configurable symbols of only one color level, e.g., blue, the ante bets may provide multiple levels of configurable symbols, e.g., both blue and purple. That is, an ante bet of 1 credit may cause a selection of blue configurable symbols, while an ante bet of 2 credits will cause a selection of both blue and purple configurable symbols; while an ante bet of 3 credits will cause a selection of blue, purple, and green configurable symbols. All 5 types of configurable symbols may be provided with a particular ante bet.

FIGS. 8A and 8B illustrate the primary game display 240 during play of the base game. Briefly, the display 240 presents a game outcome using a 3×5 display matrix 830, where each column represents a different reel 832-840. The reels 832-840 are displayed as spinning and then stopping to present the matrix of display symbols representing a game outcome. FIG. 8A illustrates the reels spinning and FIG. 8B illustrates the reels in their stopped position to provide a base game outcome.

While the display matrix 830 is described in the context of a spinning reel game, it will be appreciated that display matrix 830 may be used in other types of games. For example, particularly in the context of a video display, the display matrix 830 may be presented and populated by symbols without providing any representation of reels spinning.

During play of the base game, the gaming device 200 may utilize one or more paylines to determine whether the display matrix 830 contains any winning symbol combinations. In particular, a gaming device 200 may provide one or more paylines and may allow the player to make a wager on each payline in a play of the primary game. For example, the gaming device 200 may include 1, 3, 5, 9, 15, 25, or some other number of paylines upon which the player may wager or otherwise activate. The gaming device 200 may allow players to make wagers of substantially different amounts on each play of the primary or base game ranging, for example, from one credit up to 125 credits (e.g., five credits on each of 25 separate paylines).

The paylines may be horizontal (see, e.g., paylines $\mathbf{801}_1$, $\mathbf{801}_2$, $\mathbf{801}_3$ of FIG. 8B), vertical, circular, diagonal, angled, zigzagged, or any combination thereof. Each payline identifies a subset of symbols or display positions of the display matrix 830. For example, FIG. 8B depicts an embodiment having three horizontal paylines $\mathbf{801}_1$, $\mathbf{801}_2$, $\mathbf{801}_3$. The top payline $\mathbf{800}_1$ corresponds to the top row of display positions in the display matrix. The center payline $\mathbf{800}_2$ corresponds to the center row of display positions in the display matrix. The bottom payline $\mathbf{80}_3$ corresponds to the bottom row of display positions. In some embodiments, paylines $\mathbf{801}_1$, $\mathbf{801}_2$, $\mathbf{801}_3$ are selectively activated based on, for example, a player's wager or gaming outcomes. In such embodiments, the gaming device 200 may only award prizes or trigger game events based on symbols aligned with activated paylines $\mathbf{801}_1$, $\mathbf{801}_2$, $\mathbf{801}_3$.

The value of the mystery symbol may be determined and revealed at any time following its appearance in a game outcome. For example, in some embodiments, mystery symbols may be available during both the base game and the feature game. If a mystery symbol appears as part of a triggering game outcome in a base game, its value may be determined and revealed prior to initiation of the feature game so that the determined value of the mystery symbol may be included in the values accumulated to determine the repeater prize value. Alternatively, in some embodiments, the value of one or more of the mystery symbol(s) may not be determined and revealed until the feature game is completed.

Figure 9A:
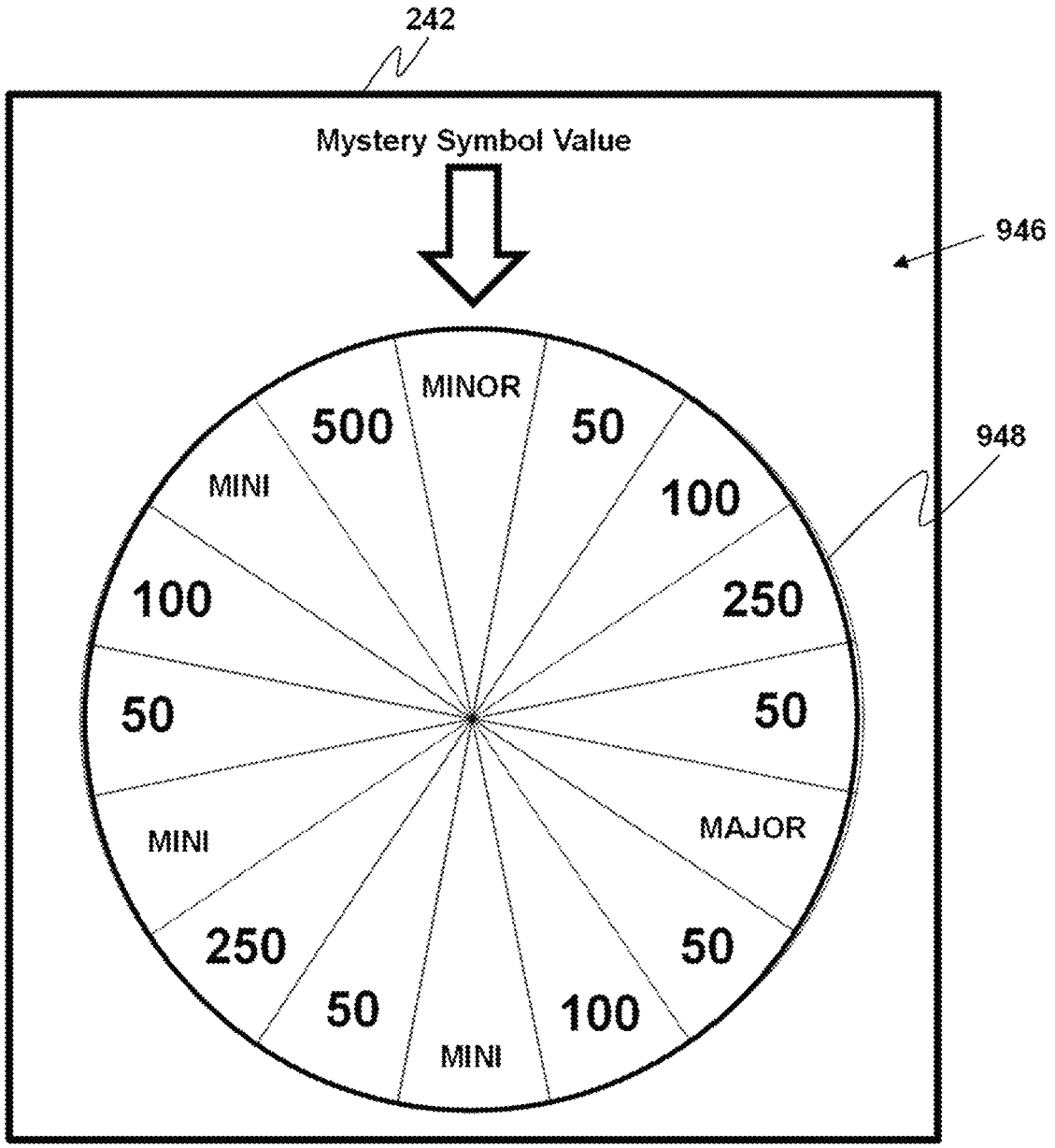
FIGS. 9A and 9B are screenshots of first and second spinning wheel games that may be employed in certain embodiments of the present disclosure.

In some embodiments, the value of the mystery symbol may be determined using a first valuation game, which may, for example, be in the form of a first spinning wheel game. The first spinning wheel game may be presented via a spinning wheel display 946 (see, e.g., FIG. 9A). The first spinning wheel display 946 includes a segmented wheel 948, where each wheel segment displays a numeric value (e.g., a number of credits or currency) or a jackpot label (e.g., MINI, MINOR, MAXI, MAJOR, and GRAND). The wheel 948 is shown as spinning and stopping (randomly) at one of the segments to indicate the value that is to be awarded for the mystery symbol. The indicated value is then used to replace the question marks on one or more of the displayed mystery symbols. The spins during the first spinning wheel game may occur automatically or the player may be prompted to spin the wheel. In some embodiments, a single random determination (e.g., wheel spin) may be used to set the value for all of the displayed mystery symbols. Alternatively, the values of each mystery symbol may be separately determined or determined in subgroups. In some embodiments, the first spinning wheel display 946 (or other valuation game) may be displayed to the player on the secondary game display 242, for example. Alternatively, the first spinning wheel display 946 (or other valuation game) may be presented on the primary game display 240, for example.

In other embodiments, the value of the mystery symbols may be set in other ways. For example, there may be a player skill feature where the skill level of the player is determined or is based on particular data regarding the particular player, and the value of the mystery symbol is set accordingly. Also, a selection mechanic may be used to determine the value of the mystery symbol where a quantity of selections are displayed to the player and the player may select one or more of the displayed selections via the input device. Further, in various embodiments, the value of the mystery symbol may be randomly determined without any player input or a valuation game. Also, different levels of mystery symbols may be used, such that some levels are of higher average value than others. For example, red mystery symbols may use a red wheel with lower average values and gold mystery symbols may use a gold wheel with higher average values.

As discussed above, a hold and spin feature game is triggered when a determined number of configurable symbols appear in the outcome of a base game. For illustration purposes, a feature game is triggered when six (6) of the configurable symbols appear in the base game outcome. Accordingly, in addition to evaluating the base game outcomes for winning symbol combinations, the gaming device 200 also evaluates the base game outcome to determine whether the base game outcome triggers the feature game, e.g., because it includes at least six (6) configurable symbols. In this regard, the base game outcome shown in FIG. 8B triggers the feature game because it includes 6 (six) configurable symbols in the form of a mystery symbol 806, a MINI jackpot symbol 808 and four value symbols 802 (10 credits, 10 credits, 10 credits and 20 credits).

As discussed above, the configurable symbols may also include repeater symbols whose value is not determined until a feature game is triggered. When a feature game is triggered, the gaming device 200 determines the value of repeater prize to be assigned to the repeater symbols based on the value(s) of one or more of the configurable symbols that triggered the feature game. In a preferred embodiment, the value of the repeater prize is determined by summing (accumulating) the values of the configurable symbols that triggered the feature game.

In various embodiments, the value of the repeater prize is determined by summing some of the values of the configurable symbols that triggered the feature game. In various other embodiments, the value of the repeater prize is determined by summing some or all of the values of the configurable symbols that are displayed at the conclusion of the feature game. In some of these embodiments, a multiplier may be randomly determined, predetermined, selected by a player using a selection mechanic, determined using a skill or pseudo-skill game.

In various embodiments, the feature game is triggered with configurable symbols except with the repeater symbol. During play of the feature game, one or more repeater symbols can be displayed. The value of the repeater prize can then be determined when the repeater symbol is first displayed in the feature game by summing the prize values of all of the other configurable symbols displayed in the feature game when the repeater symbol is first displayed.

When the triggering symbols include one or more mystery symbols, as in the illustrated example, the gaming device may determine the value(s) of any mystery symbols, e.g., via the first valuation game, before determining the value of the repeater prize. In this regard, the value of the mystery symbol 806 has been updated in FIG. 8C to reflect the awarding of a MINI jackpot by the mystery symbol valuation game. Accordingly, in the example, the value of the repeater prize is 3050 credits, which is the sum (1500+1500+10+10+10+20) of the six (6) configurable symbols that triggered the feature game. (Note, in the illustrated embodiment, the MINI jackpot has a value of $15.00 and the game is a 1 cent game where each credit has a value of 1 cent. Accordingly, the MINI jackpot symbol has a corresponding value of 1500 credits.

Figure 8C:
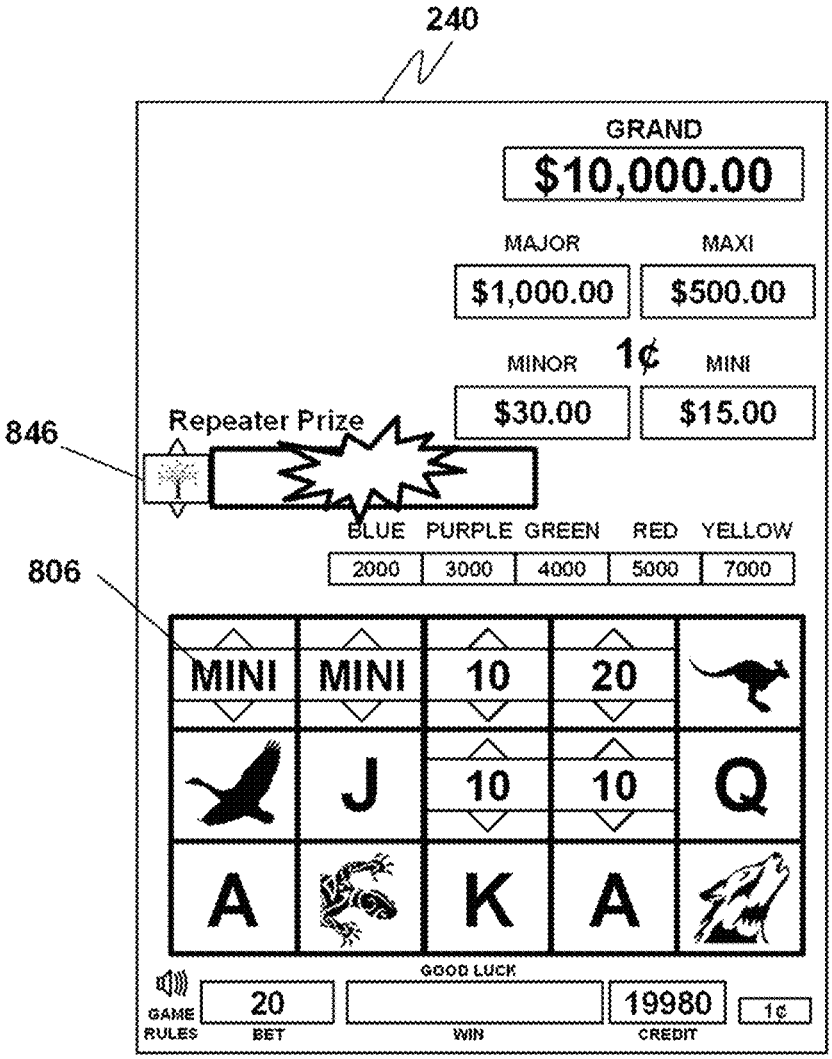
Figure 8D:
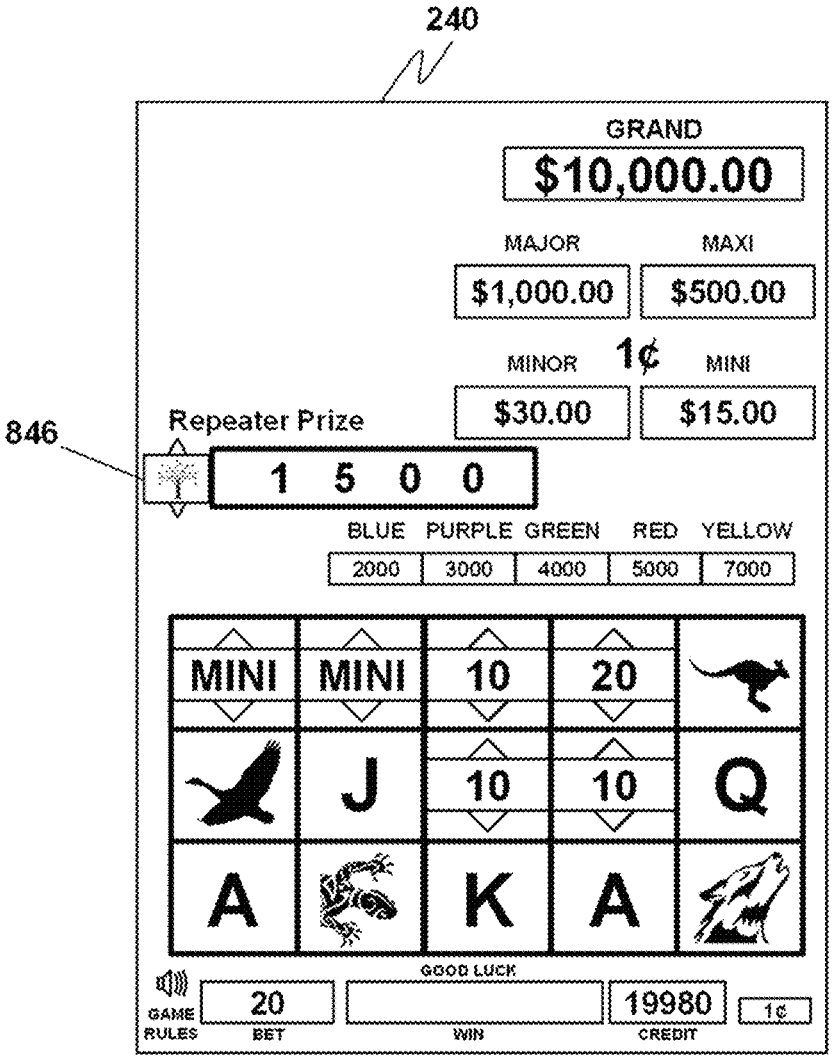
Figure 8E:
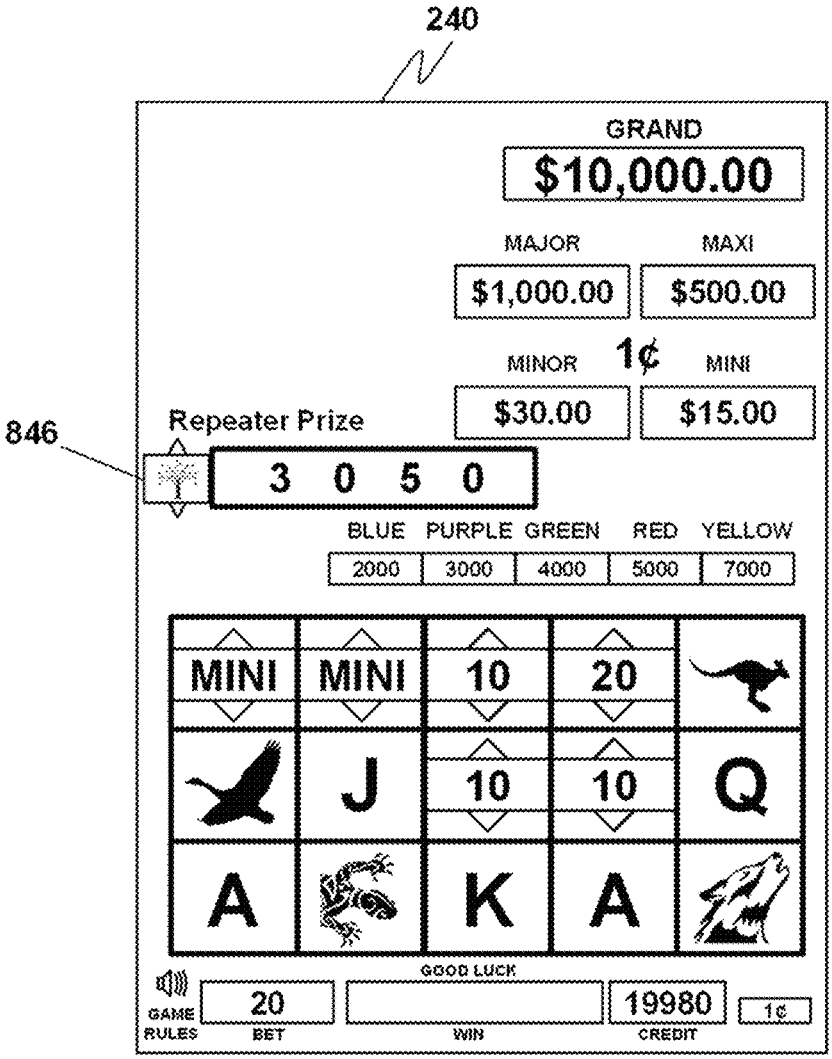

An animation may be provided to visually display the credits being accumulated (or summed) from the triggering symbols to determine the value of the repeater prize during the ensuing feature game. For example, as is shown in FIGS. 8C and 8D, the animation may display rockets (not shown) or other elements sequentially moving from each respective configurable symbol to a repeater prize meter 846. When a respective rocket reaches the meter, it may explode and the value from the originating configurable symbol may be added to the repeater prize meter. For example, in FIG. 8C, a rocket moves from a MINI jackpot prize symbol 808 to the repeater prize meter 846 where it explodes. FIG. 8D shows the repeater prize meter 846 updated to reflect that the 1500 credits (the value of the MINI jackpot) have been accumulated towards the repeater prize. The animation may continue with rockets shooting from each of the individual configurable symbols until all of the credits have been accumulated to the repeater prize meter, see, e.g., FIG. 8E where the repeater prize meter 846 displays 3050 credits.

Figure 8F:
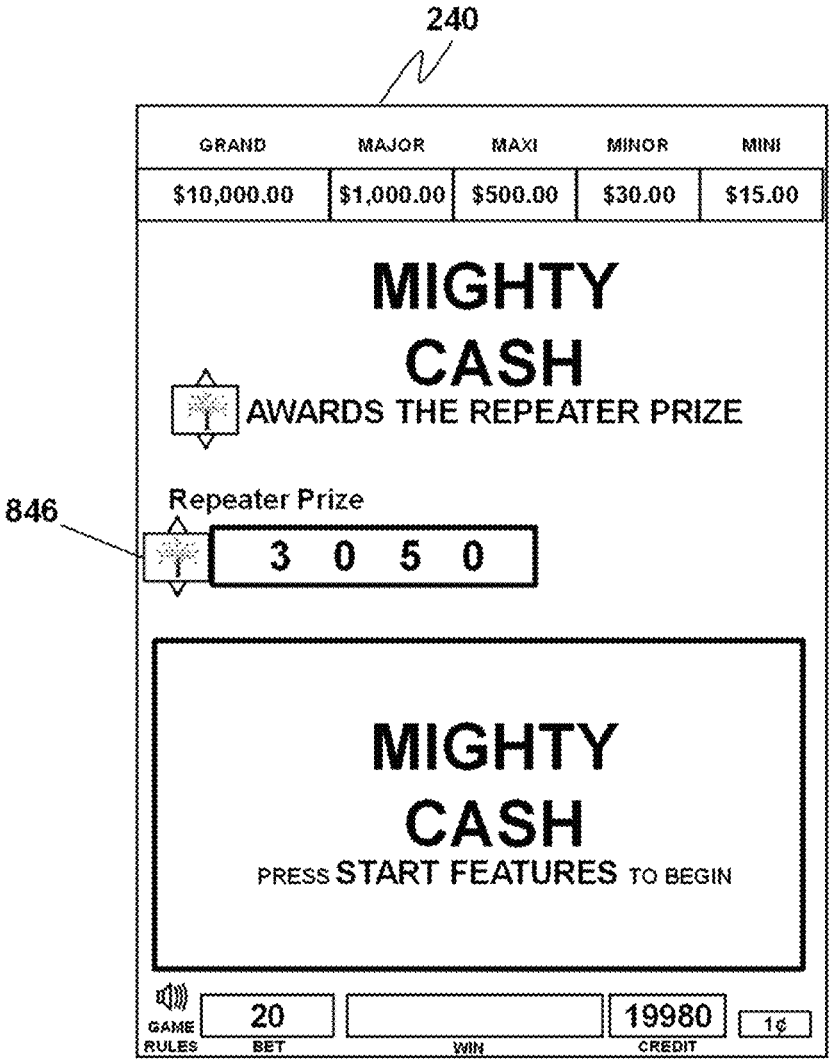

The game then transitions to the feature game. FIG. 8F is a screen shot of a transition screen that may be shown on the display 240 when transitioning from the base game to the feature game. The transition screen may prompt the player to make an input, such as to press a start button to begin the feature game.

FIGS. 8G to 8M are screen shots illustrating play of the feature game. The feature game is in the form of a hold and spin game in which any configurable symbols from the triggering game outcome are retained on the display and the player is awarded an additional number of spins (e.g., 6 in the illustrated example) during which the player tries to accumulate more of the configurable symbols. The display includes a spin counter 858 that displays an indication of the number of spins remaining in the feature game. The display may also include a configurable symbol counter 852 (see, e.g., FIG. 8H) that displays the number of configurable symbols that have been collected by the player. The configurable symbol counter may be initially set following the triggering game outcome and may be updated following each spin during the feature game.

Figure 8G:
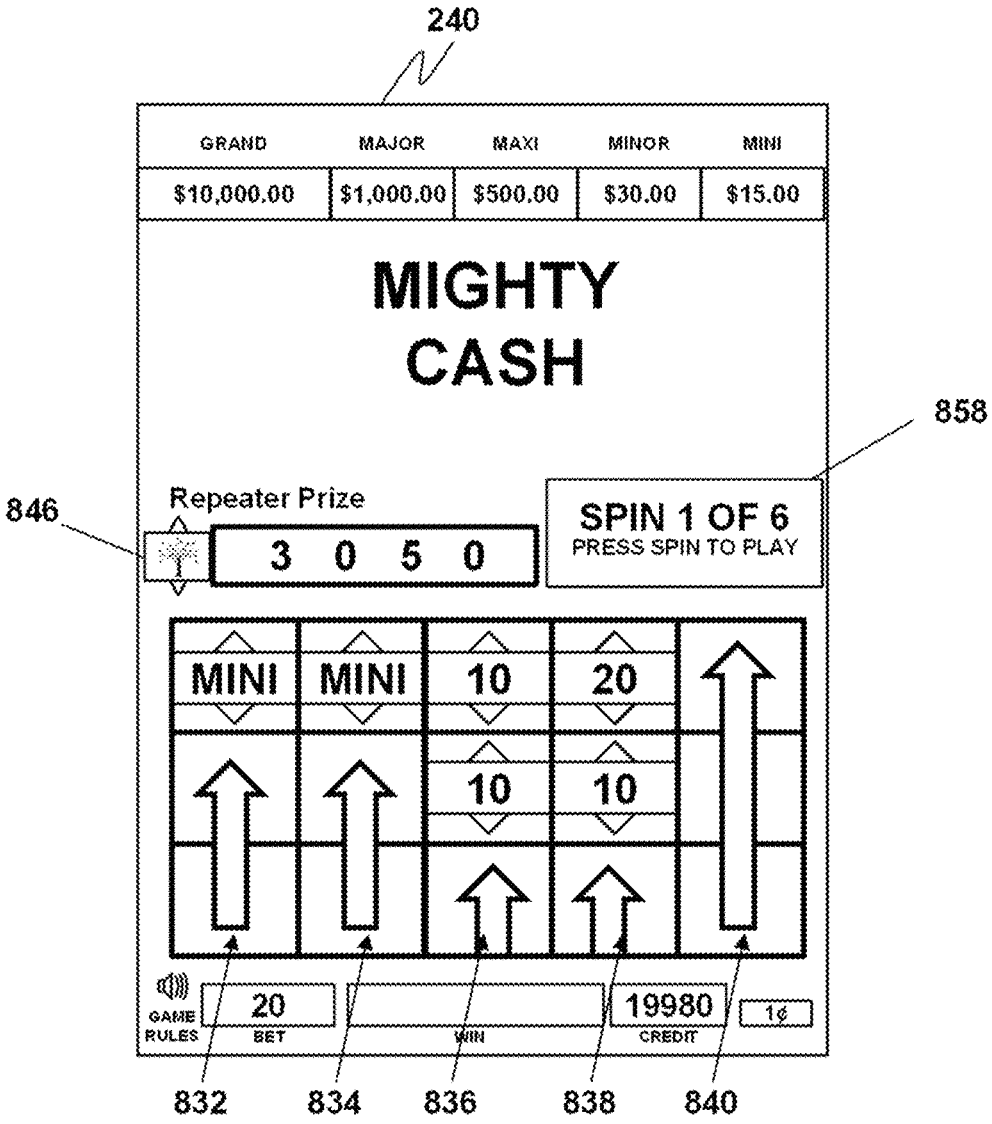
Figure 8H:
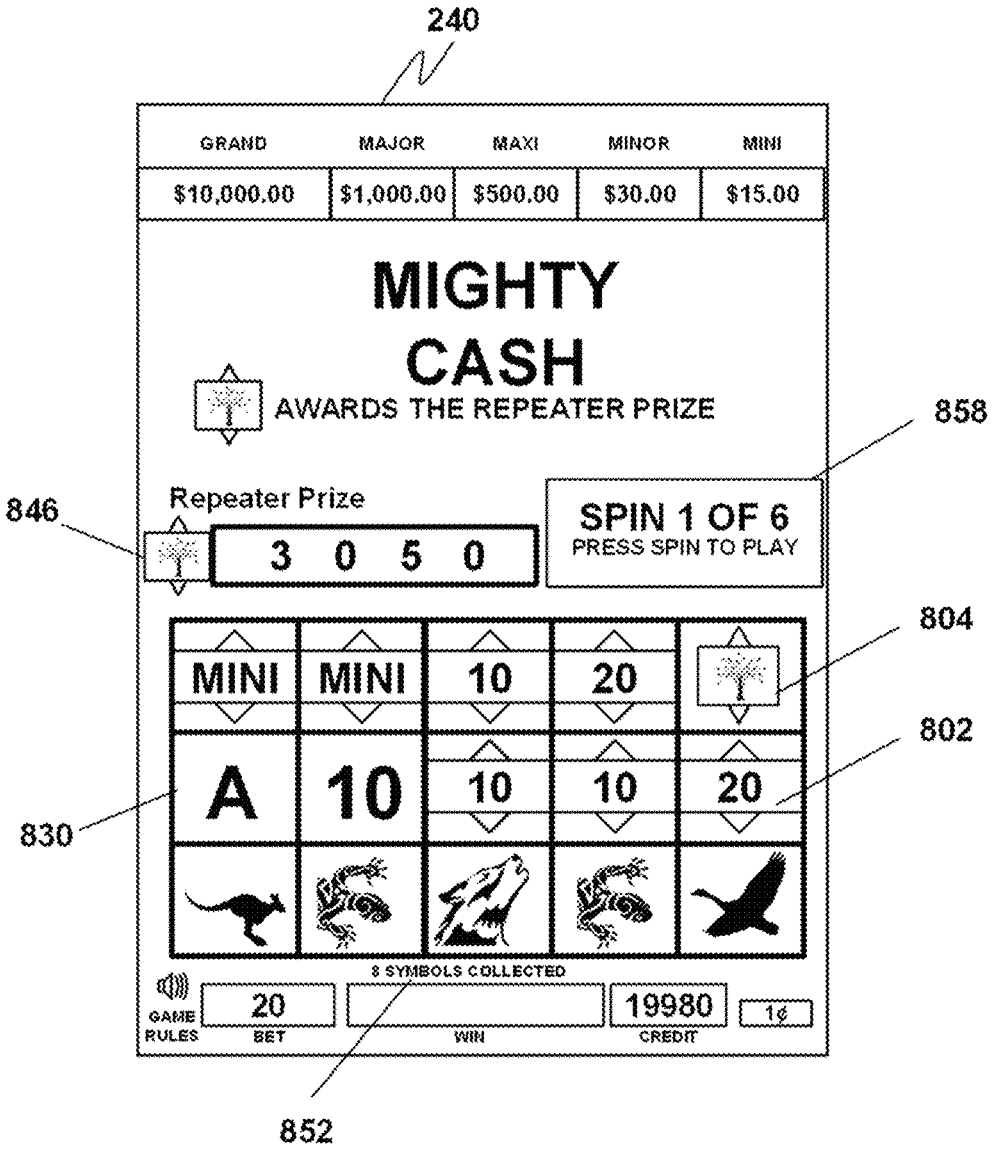
Figure 8I:
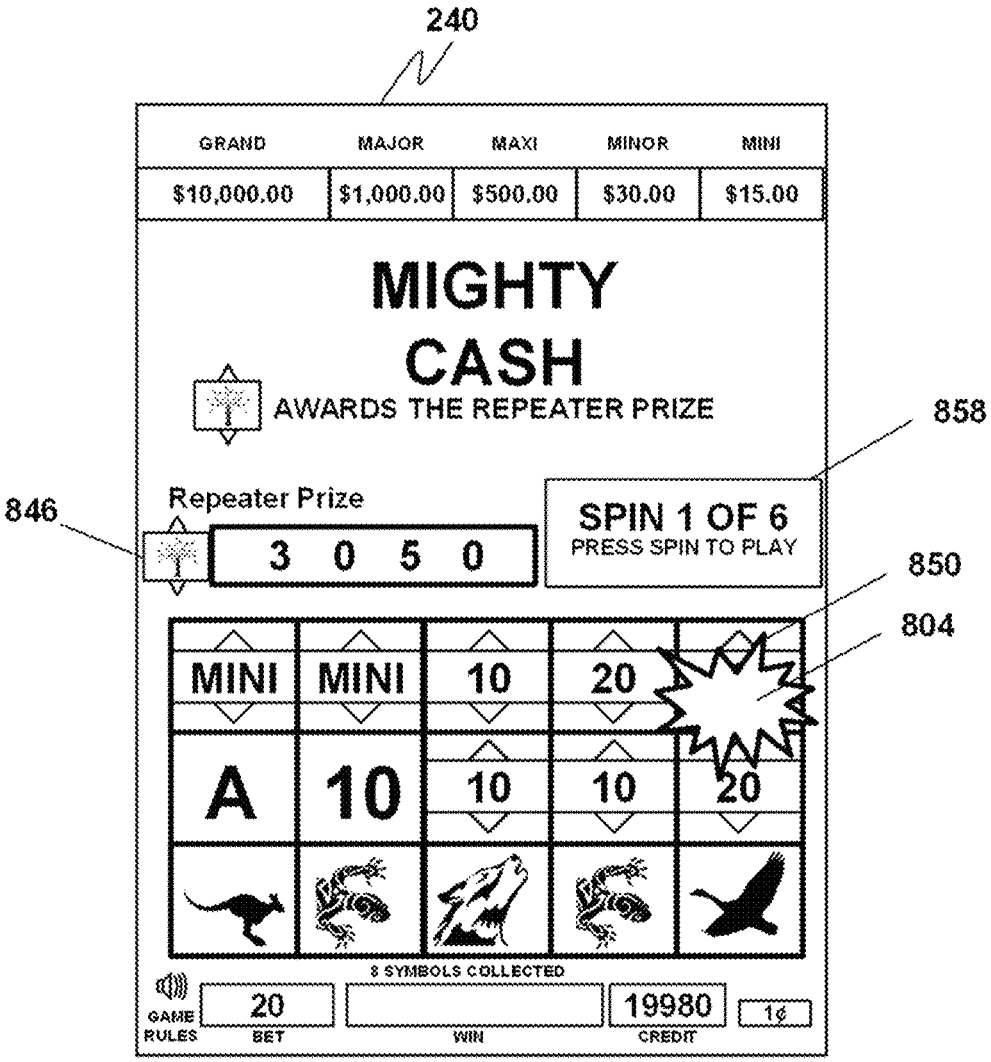
Figure 8J:
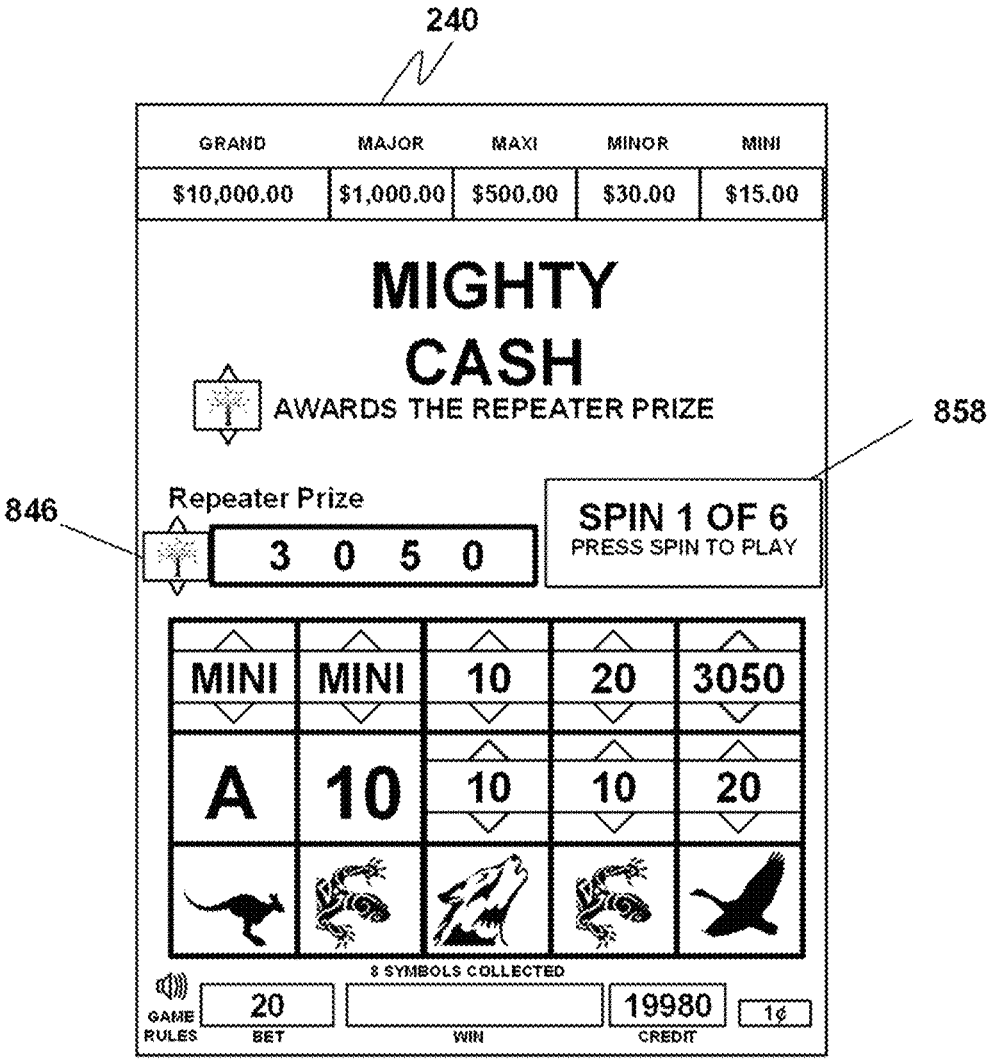

FIG. 8G shows the reels 832-840 spinning during a first spin of the feature game. As shown, the configurable symbols that appeared in the triggering game outcome are held in place on the display while the reels are shown spinning in the other symbol positions. FIG. 8H illustrates reels 832-840 in their stopped position to provide a game outcome following the first spin of the feature game. As shown in FIG. 8H, the first spin has resulted in the award of two additional configurable symbols, namely, a 20 credit value symbol 802 and a repeater symbol 804. The repeater symbol 804 may be modified to display its value (3050 credits in this example) before the next spin. For example, as is shown in FIGS. 8I and 8J, an animation 850 may display a rocket (now shown) or other element moving from the repeater prize meter 846 to the repeater symbol 804 where it explodes to reveal the repeater symbol modified to display its value. When a spin results in the award of more than one repeater symbol, the repeater symbols may be modified simultaneously or sequentially to display their values.

Figure 8K:
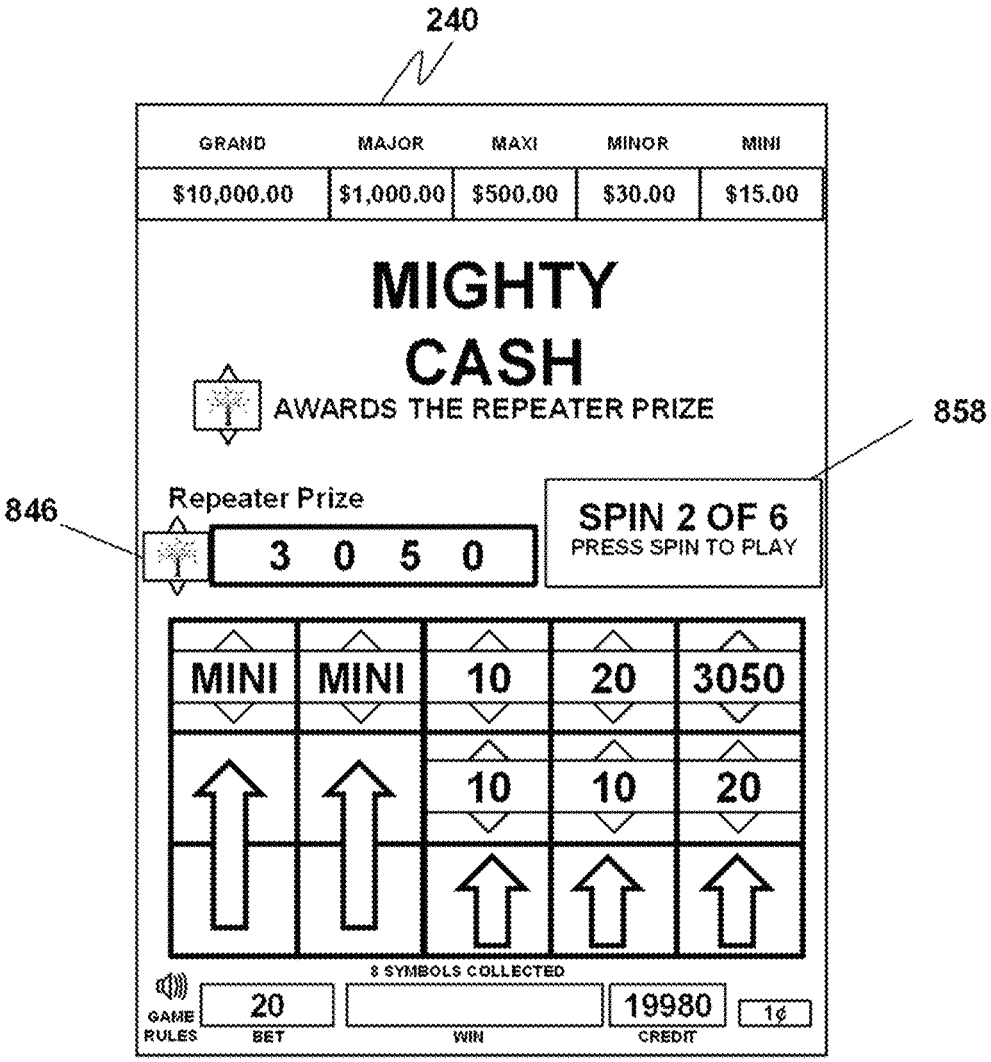
Figure 8L:
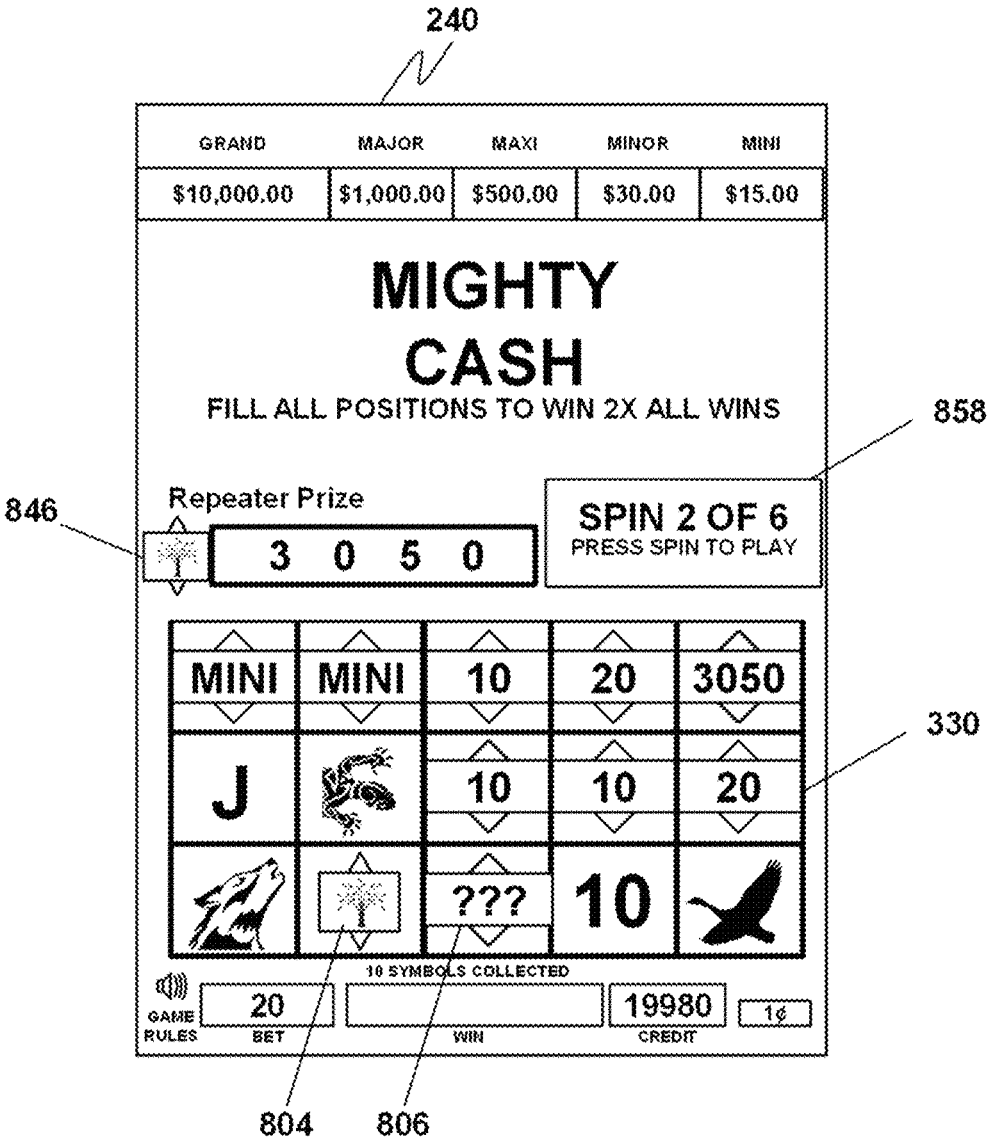

The player is then prompted to initiate a second spin of the feature game. During the second spin, the configurable symbols that were previously awarded (collected) are held in place on the display matrix and the reels are shown spinning in the other symbol positions of the display matrix. FIG. 8K shows the display during the second spin of the feature game, and FIG. 8L shows the reels in their stopped position to provide a game outcome following the second spin of the feature game. As shown in FIG. 8L, the second spin has resulted in the award of two additional configurable symbols, namely, another repeater symbol 804 and a mystery symbol 806. As discussed above, the value of the mystery symbol may be determined using a valuation game, such as a spinning wheel game. (See, e.g., FIG. 9).

Figure 8M:
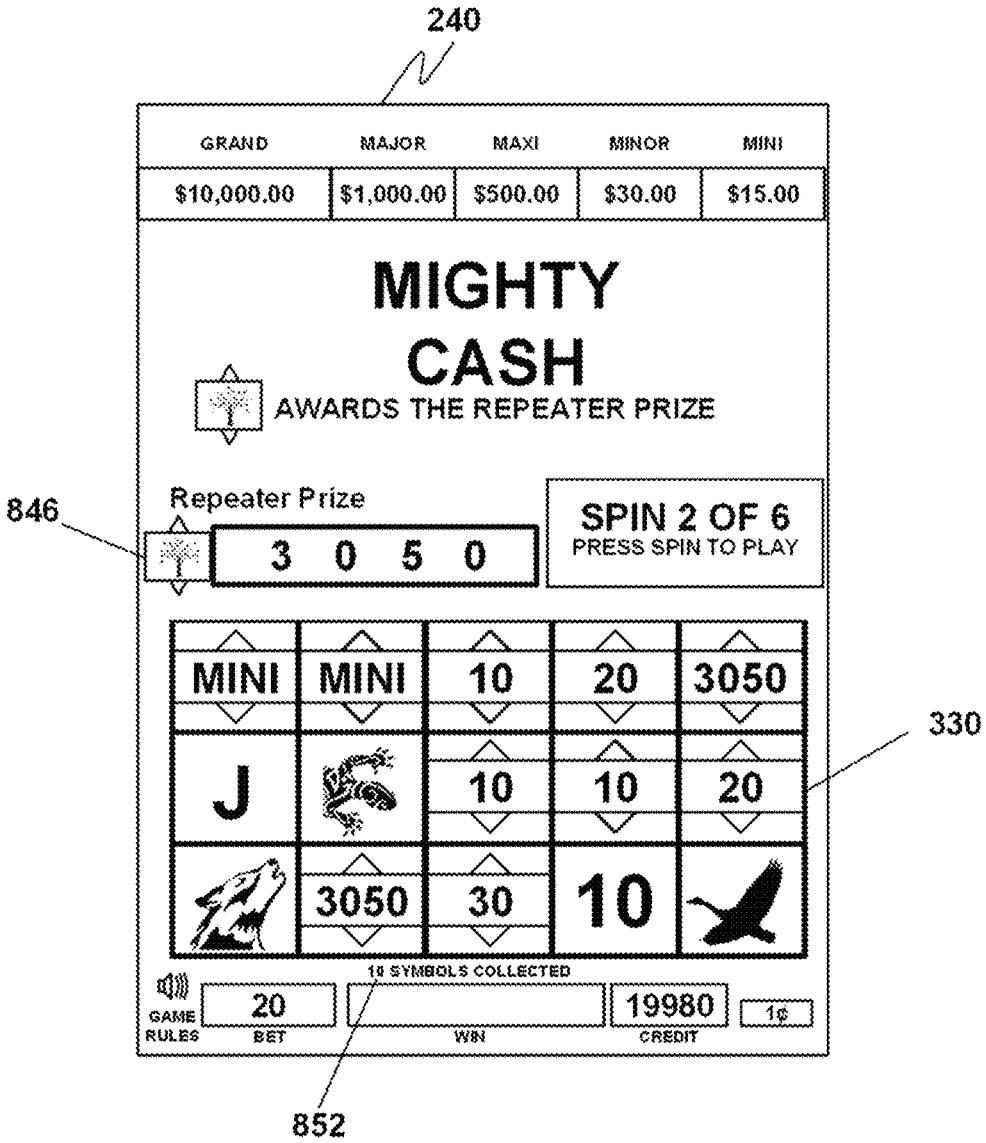

FIG. 8M shows the display after the repeater and mystery symbols that were awarded during the second spin have been modified to show their determined values, e.g., 3050 credits for the repeater symbol and 30 credits for the mystery symbol.

The feature game continues in the manner described until all of the spins have been completed. Once the feature game is completed, the controller determines and pays out a feature game award. For example, if the matrix 830 is not fully populated with configurable symbols, the player may be awarded a prize amount corresponding to the accumulated value of the displayed configurable symbols.

Figure 9B:
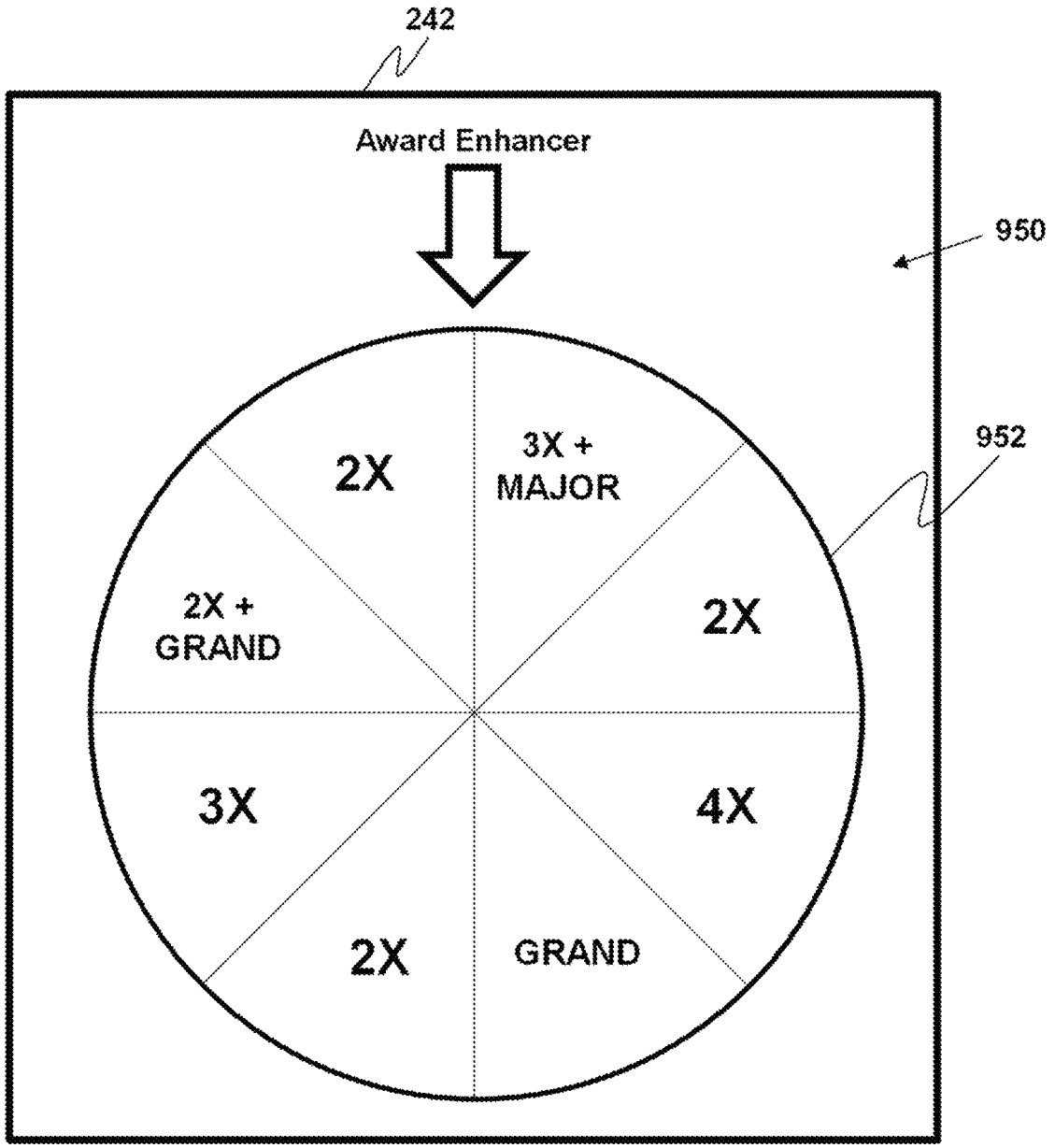

In various embodiments, if the display matrix 330 is completely filled with configurable symbols, the player may be awarded an enhanced award. In some embodiments, the enhanced award may be a fixed prize such as a 2× multiplier of the accumulated value or the award of a jackpot, such as the Grand jackpot. In some embodiments, the enhanced award may be determined via a second valuation game. The second valuation game may be similar to the first valuation game, but may provide different and/or enhanced values from those used in the first valuation game. For example, as shown in FIG. 9B, the second valuation game may be conducted using a second spinning wheel display 950 with a segmented wheel 952 that may include multipliers (i.e., 2× or 3×) or multipliers with jackpots (i.e., 2×+Grand or 3×+Major). The multiplier value indicated by the spin of the second spinning wheel display affects the sum total value of all "hold" value symbols collected in the hold and spin game (i.e., "2×" will double the sum total value); the jackpot enhances the hold and spin award by the amount of the jackpot (i.e., $50, $500 or $5000 will be added to the sum total value).

In certain embodiments, once the play of all the spins of the feature game is completed, the gaming device 200 may determine whether to provide an additional quantity of spins of the feature game. In one or more embodiments, the gaming device 200 can randomly select the additional quantity of spins to be provided. In certain other embodiments, the gaming device 200 can present a quantity of picks and receive player input. The selected pick is then revealed by the gaming device 200 and the additional quantity of spins corresponding to the player pick is provided. In certain embodiments, the gaming device 200 can first determine whether to provide the additional quantity of spins and then do a second determination to determine the quantity to be provided. It will be apparent to those skilled in the art that there are various ways, such as a wheel game, etc., that may be used to determine and present the additional quantity of plays.

Figure 10A:
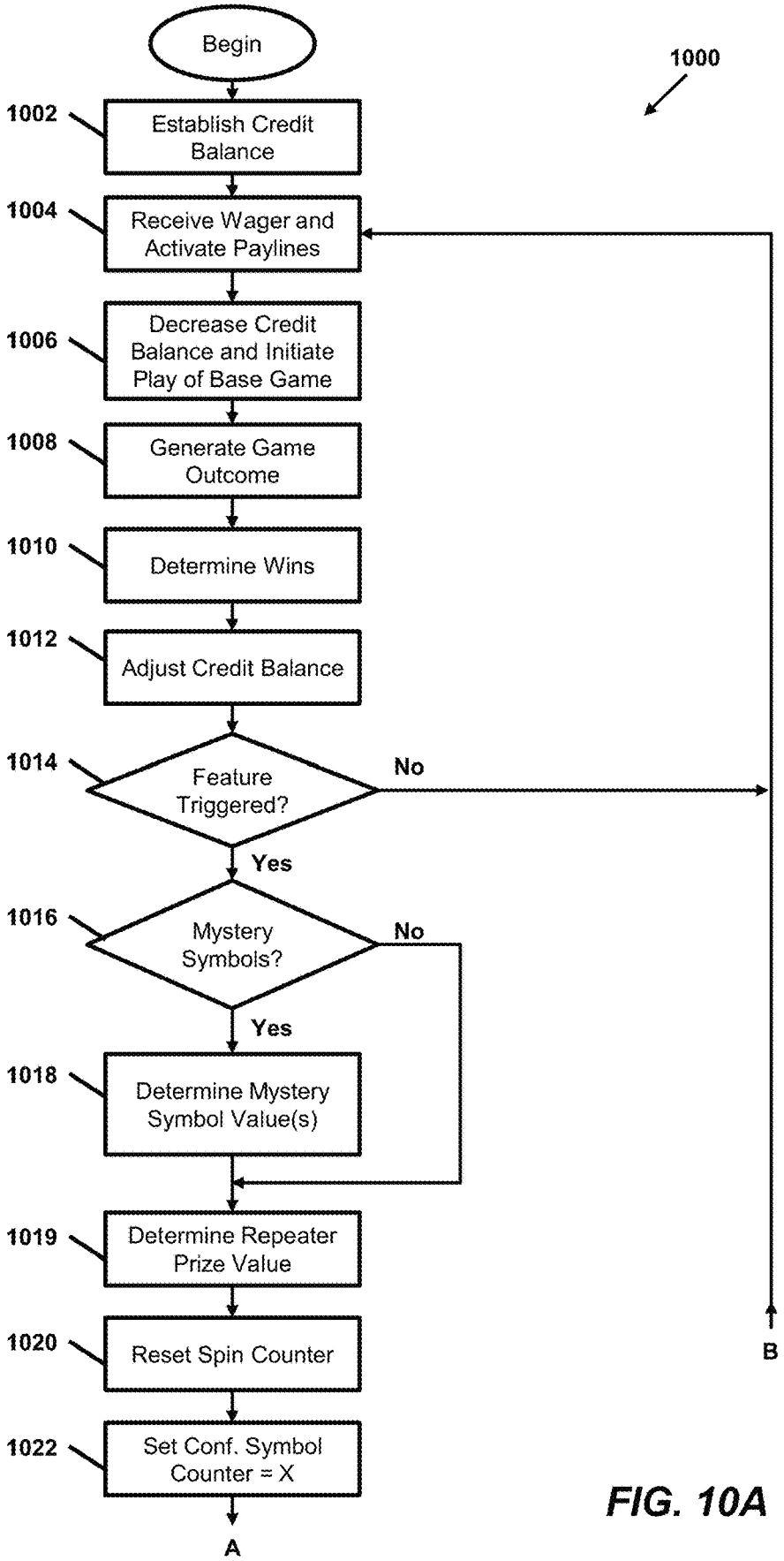
FIGS. 10A and 10B are flow diagrams for an example embodiment of a process for operating the EGM of FIG. 2A in accordance with various aspects of the present disclosure.
Figure 10B:
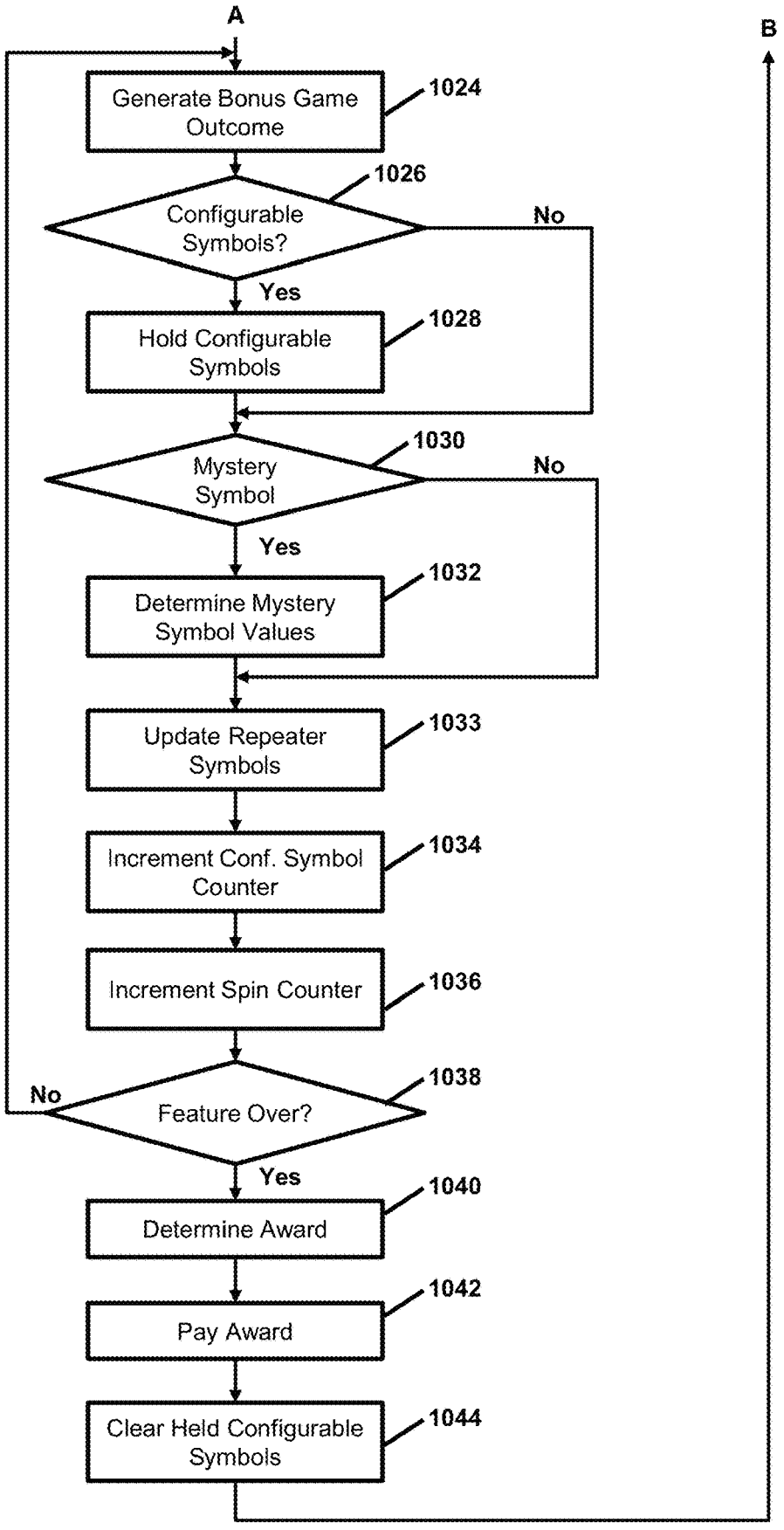

Examples of play of the base and feature game with repeater and mystery symbols will now be described with additional reference to the flowchart 1000 shown in FIGS. 10A and 10B. At 1002, the gaming device 200 may establish an associated credit value on a credit meter. To this end, a player may insert a physical item having monetary value into a credit input mechanism, such as the ticket reader 224 or bill validator 234, of the gaming device 200. In response to the received physical item, the gaming device 200 may increase a credit value of the credit meter 815 (see FIG. 8A) based on the monetary value of the physical item.

At 1004, the gaming device 200 may receive a wager and may activate one or more paylines, such as paylines $\mathbf{801}_1$, $\mathbf{801}_2$, $\mathbf{801}_3$. For example, in some embodiments, the gaming device 200 allows the player to selectively activate a number of paylines via the player input buttons 236. In other embodiments, the paylines may be automatically activated by the gaming device 200 without player input. A player may also use the player input buttons 236 to specify a value of an amount to be wagered on each active payline with the wager being funded by the credit value of the credit meter.

The gaming device 200 may display a message such as "Press SPIN to play" in a message box, e.g., on the primary game display 240. When the player presses a SPIN button, e.g., in the player input buttons 236, the gaming device 200, at 1006, may decrease the player's credit balance by the specified wager and initiate play of a spinning reel game by spinning reels 832-840. (See, e.g. FIG. 8A).

Next, at 1008, the gaming device 200 may stop the reels 832-840 based on one or more random values generated by RNG 212 to obtain a base game outcome comprising a matrix 830 of symbols. (See, e.g., FIG. 8B). In other embodiments, the gaming device 200 may stop the reels 832-840 based on information received from central determination gaming system server 106.

The gaming device 200, at 1010, may then determine whether the symbols displayed in the display matrix 830 include one or more winning symbol combination. For example, at 1010, the gaming device 200 may determine if there are any winning combinations of symbols along one of the activated paylines. Winning symbol combinations along the activated paylines may result in the award of prize(s) by increasing the credit value of the credit meter based on the prize(s) for such winning combination(s).

At 1012, the gaming device 200 may adjust the credit balance on the credit meter 535 in accordance with any winning symbol combinations that were identified in 1006. The gaming device 200 may also control the display 240 to provide a message reflective of the game outcome. For example, when the game outcome includes one or more winning symbol combinations, the display 240 may display a message such as "Congratulations—You Won X Credits!" (where X is the number of credits won by the player). Conversely, when the game outcome does not include any winning symbol combinations, a message such as "Sorry—You Didn't Win—Spin Again" may be displayed to the player.

At 1014, the gaming device 200 determines whether a feature triggering event occurred. The game triggering event may occur, for example, on the occurrence of a predetermined combination of symbols, or at random, or by some other process. As discussed above, in the embodiment of FIGS. 8A-8I, a feature game is triggered by the appearance of 6 or more configurable symbols in a base game outcome. For example, the base game outcome shown in FIG. 8B triggers the feature game because it includes at least six (6) configurable, i.e., symbols, in the form of a mystery symbol, a MINI jackpot symbol, and four value symbols (10 credits, 10 credits, 10 credits, and 20 credits). When a trigger event occurs, the gaming device 200 displays a message such as "Congratulations, You Triggered The HOLD AND SPIN FEATURE Game" on the primary game display 240. In various embodiments, the minimum number of configurable symbols needed to trigger the feature game may be predetermined, randomly determined, based on a wager amount, or based on a denomination, etc.

If the feature game is not triggered, the process returns to 1004 to allow the player to continue playing the base game. Alternatively, when a feature trigger occurs, the gaming device 200 may transition to a feature game as described below.

Prior to transitioning to the feature game, the gaming device 200 may, at 1016 and 1018, determine the value(s) of any mystery symbols that were displayed in the base game outcome that triggered the feature game. As discussed above, the gaming device 200 may determine the values to be assigned to the mystery symbols using a valuation game that may be displayed, for example, on the spinning wheel display 946 (see, e.g., FIG. 9A). Upon determining values for any displayed mystery symbols, the gaming device 200 may cause the display 240 to replace the mystery symbols with their respective determined values. (See, e.g., FIGS. 8B and 8C, which illustrate the mystery symbol 806 being updated to MINI jackpot symbol). Although not illustrated, an animation may be shown when updating the display matrix 830 to show values assigned to mystery symbols.

At 1019, the gaming device 200 determines the repeater prize value and sets the repeater prize meter 846 in accordance with the determined value. In the illustrated embodiment, the repeater prize value is determined as the sum of the configurable symbols (including the determined value of any mystery symbols) that triggered the feature game. Accordingly, in the above example, the repeater prize meter 846 is set to 3050 credits, which is the sum (1500+1500+10+10+10+20) of the six (6) configurable symbols that triggered the feature game. (See, e.g., FIG. 8E).

Before beginning the hold and spin feature game, the gaming device 200 also resets the spin counter 858 to its starting value at 1020. In the illustrated embodiment, the feature game provides 6 (six) rounds/spins, so the spin counter 858 is reset to indicate that this is spin 1 of 6.

In transitioning from the base game to the feature game, the gaming device 200 may cause the display 240 to provide a transition screen. (See, e.g., FIG. 8F). When the player presses a Start Feature button, e.g., on the player input buttons 236, the game transitions the display 240 to present the hold and spin feature game. (See, e.g., FIG. 8G).

The gaming device 200 may display a message such as "Press SPIN to Play" on the display 240. When the player presses the SPIN button, the gaming device 200, at 1024, controls the display matrix 830 to show reels 310A-310E as spinning (see, e.g., FIG. 8G) and stopping (based on one or more random values generated by RNG 212) to obtain a game outcome. (See, e.g., FIG. 8H). As noted above, the symbol set in the feature game utilizes configurable and non-configurable symbols.

The gaming device 200, at 1026, may then determine whether the feature game outcome from the first spin includes any new configurable symbols. In the illustrated example, the first spin has resulted in the award of two additional configurable symbols, namely, a 20 credit value symbol 802 and a mystery symbol 806. (See FIG. 8H).

Next, at 1028, any configurable symbols shown in the game outcome are held on the display matrix 830.

At 1030, the gaming device 200 determines if the game outcome includes any mystery symbols. If no mystery symbols are present, control moves to 1033. Conversely, if the displayed game outcome incudes one or more mystery symbols, control moves to 1032 where the gaming device 200 determines the value(s) to be assigned to the mystery symbols. The value of the mystery symbol may, for example, be determined using a valuation game, such as the first spinning wheel game. (See, e.g., FIG. 9A).

At 1033, the gaming device 200 determines if the spin resulted in the award of any new repeater symbols. Any new repeater symbols 804 may be modified to display its value (3050 credits in this example) before the next spin. (See, e.g., FIGS. 8I and 8J). As noted above, when a spin results in the award of more than one repeater symbol, the repeater symbols may be modified simultaneously or sequentially to display their values At 1034, the gaming device increments the configurable symbol counter 852 to reflect the number of configurable symbols that have been collected thus far by the player. Next, at 1036, the gaming device 200 optionally increments the feature game spin counter 858.

Next, at 1036, the gaming device 200 optionally increments the feature game spin counter 858. At 1038, the gaming device 200 determines if the feature game is over. Specifically, the feature game ends in this example if no spins remain or if the matrix 330 has been filled with configurable symbols.

If the feature game is not over, control returns to 1024 where the gaming device 200 waits for the player to press the spin button to generate another feature game outcome. The feature game continues in the manner described until all of the spins have been completed or the display matrix is filled with configurable symbols.

Once the feature game is completed, control moves to 1040 where the gaming device 200 determines the award to be paid to the player in connection with the feature game. If the matrix is not completely filled with configurable symbols, the award may be determined by summing the credits of the configurable symbols that were awarded and held during the feature game. An enhanced award may be provided for completely filling the display matrix 830 with configurable symbols. In some embodiments, the enhanced award may be a fixed prize such as a 2× multiplier of the accumulated value. In some embodiments, the enhanced award may be determined via a second valuation game, such as the second spinning wheel game. (See, e.g., FIG. 9B).

Upon determining the award, control moves to 1042 where the gaming device 200 pays out any awards to the player, e.g., by adding the awarded credits to the credit balance on the credit meter 535. Next, at 1044, the gaming device 200 clears the held configurable symbols and control returns to 1002 where the player may continue to play the base game.

Reel-Specific Multipliers

FIGS. 11A to 11I represent screen shots of a display, such as the primary game display 240, at different phases during play of a base game and an ensuing hold and spin feature game according to some embodiments of the present disclosure. The game in these embodiments is illustrated as having a glamor theme, where the game symbols display glamor-related elements. In this regard, the non-configurable symbols may, for example, include people, watches, diamonds, lips, lipstick, earrings, etc. (See, e.g. FIG. 11A). As in the prior embodiments, the configurable symbols 1102 are illustrated as a rectangle overlying a diamond (See, e.g., FIG. 11A). As discussed above, some embodiments may include multiple types of configurable symbols, such as value symbols, repeater symbols, mystery symbols, and/or jackpot symbols.

These embodiments are similar to the embodiments described above with reference to FIGS. 6A-8M, except that these embodiment include one or more reel-specific multipliers that are accumulated during play of the base game and are applied to determine an award amount at the end of the hold and spin feature game.

FIG. 11A to 11E illustrate the primary game display 240 during play of the base game. Briefly, the display 240 presents a game outcome using a 3×5 display matrix 1104, where each column represents a different reel 1108*a*, 1108*b*, 1108*c*, 1108*d*, 1108*e*. The reels 1108*a*-1108*e* are displayed as spinning and then stopping to present a matrix of display symbols representing a game outcome.

The display 240 also includes a plurality of multiplier meters 1112*a*-1112*e*. In the illustrated embodiment, each multiplier meter 1112*a*-1112*e* is associated with a respective reel 1108*a*-1108*e* of the display matrix 1104. In particular, a first multiplier meter 1112*a* is associated with the first reel 1108*a*, a second multiplier meter 1112*b* is associated with the second reel 1108*b*, a third multiplier meter 1112*c* is associated with the third reel 1108*c*, a fourth multiplier meter 1112*d* is associated with the fourth reel 1108*d*, and a fifth multiplier meter 1112*e* is associated with the fifth reel 1108*e*. As shown, each meter 1112*a*-1112*e* is displayed above its respective reel 1108*a*-1108*e* to visually indicate that a given meter is associated with a specific reel.

In other embodiments, one or more multiplier meters may be associated with multiple reels. For example, in some embodiments, a first multiplier meter may be associated with the first reel, a second multiplier meter may be associated with the second, third and fourth reels, and a third multiplier meter may be associated with the fifth reel. In such an embodiment, the first and third meters may be adjusted based on multiplier symbols that appear in the first and fifth reels, respectively, while the second multiplier meter may be adjusted based on multiplier symbols that appear in any of the middle, i.e., second, third, and fourth reels.

In some embodiments, each of the multiplier meters 1112*a*-1112*e* may be initially set to a default value, such as a 1x (e.g., no) multiplier value. For example, in FIG. 11A each multiplier meter 1112*a*-1112*e* displays a star symbol (or other indicia) to indicate that no multiplier has been accumulated for a respective reel. However, in some implementations each of the multiplier meters 1112*a*-1112*e* may be initially set to randomly-determined values.

Figure 11A:
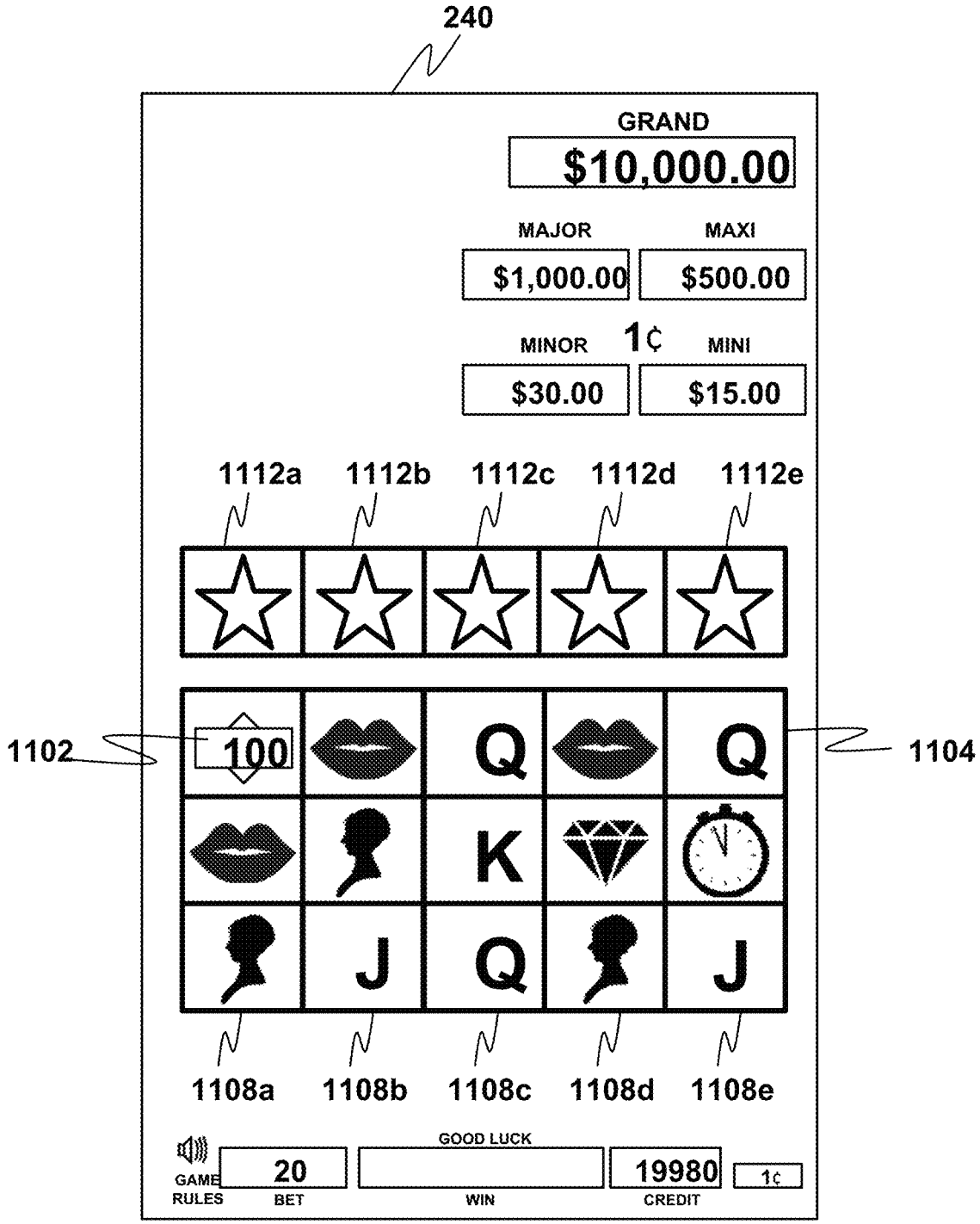
FIGS. 11A to 11I represent screen shots illustrating certain aspects of embodiments that include reel specific multiplier meters.
Figure 11B:
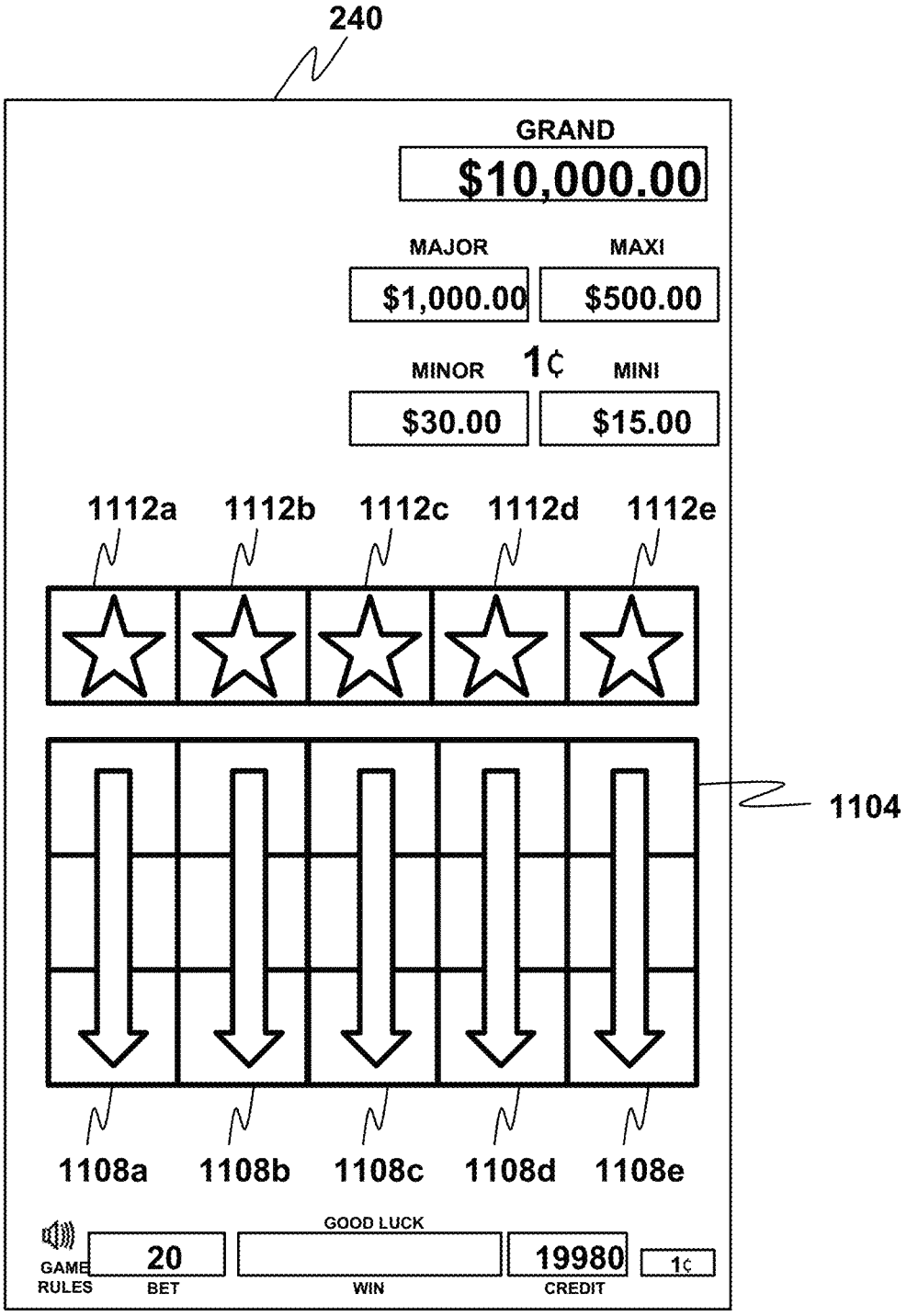
Figure 11C:
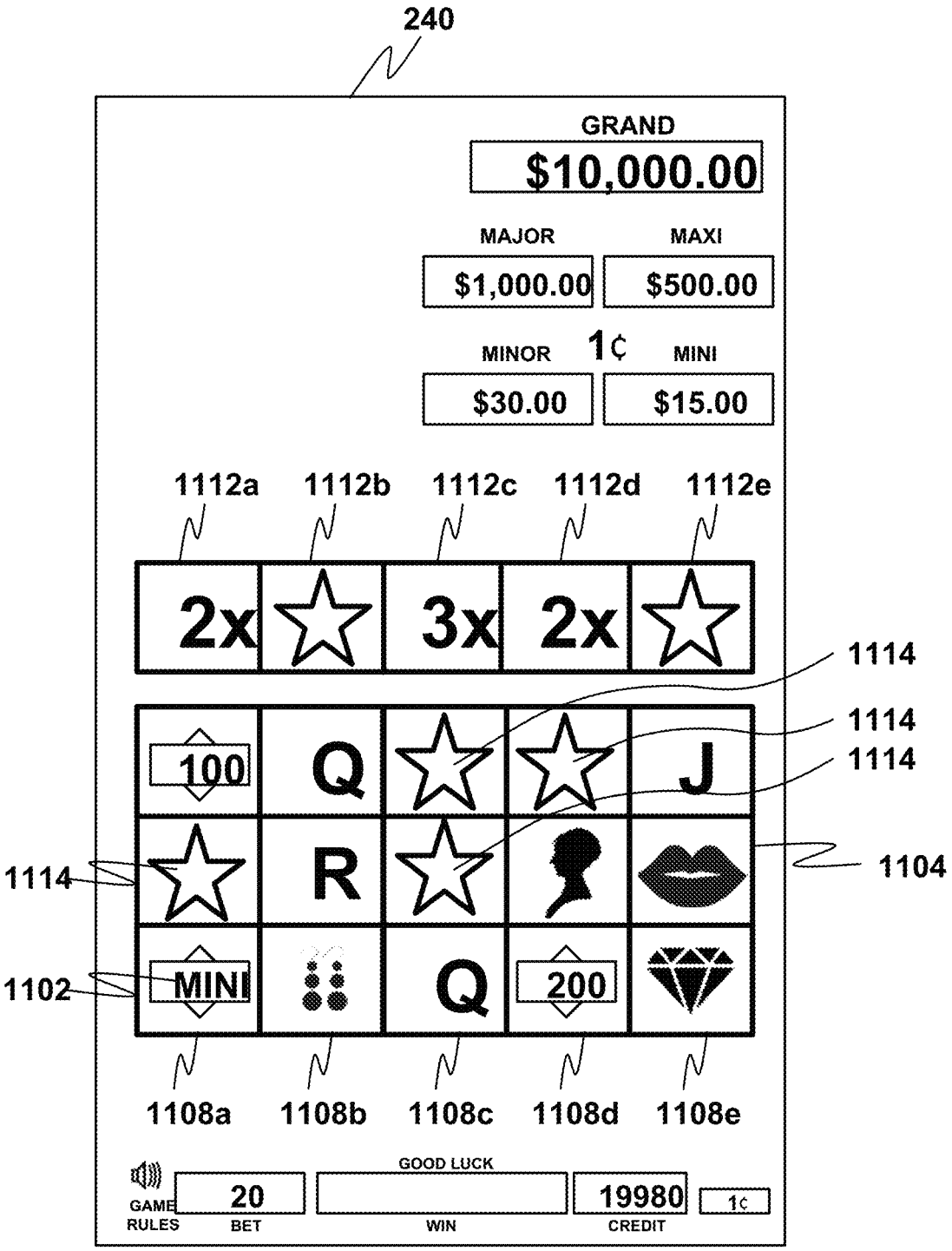

The multiplier meters 1112*a*-1112*e* may be adjusted in response to events occurring during play of a base game. For example, in some embodiments, the base game may include multiplier symbols that increment (or decrement) one or more of the multiplier meters when they appear in a base game outcome. In this regard, FIG. 11B shows the reels spinning during a play of the base game and FIG. 11C shows the reels stopped to display a first base game outcome. Referring to FIG. 11C, the multiplier symbols may include dynamic multiplier symbols 1114, which are shown as star symbols in the illustrated example. When a dynamic multiplier symbol 1114 appears in a base game outcome, it causes an associated multiplier meter to be incremented by a determined amount (e.g., by one, by two, by three, etc.). In the illustrated embodiment a multiplier meter 1112*a*-1112*e* is incremented each time a dynamic multiplier symbol is displayed on its respective reel 1108*a*-1108*e* in a base game outcome. For example, the base game outcome in FIG. 11C includes one dynamic multiplier symbol (star) 1114 in the first reel 1108*a*. As a result, the gaming device increments the first multiplier meter 1112*a* by one, i.e., from no multiplier to a 2× multiplier. Likewise, the third reel 1108*c* displays two dynamic multiplier symbols 1114, which causes the third multiplier meter 1112*c* to be incremented by two, i.e., from no multiplier to a 3× multiplier. Another dynamic multiplier symbol is displayed on the fourth reel 1108*d*, which causes the fourth multiplier meter 1112*d* to increment by one, i.e., from no multiplier to a 2× multiplier. In some examples, the value of each configurable symbol in a display symbol column may change according to an adjustment of the multiplier value of the multiplier meter associated with the display symbol column. For example, a control system of a gaming device may cause the display 240 to change the displayed value of the upper configurable symbol on the first reel 1108*a* from 100 to 200, corresponding with the 2× multiplier shown in the first multiplier meter 1112*a*. The control system may cause the display 240 to change the displayed value of the configurable symbol on the fourth reel 1108*d* from 200 to 400, corresponding with the 2× multiplier shown in the fourth multiplier meter 1112*d*. In some such examples, the control system may cause the display 240 to change the displayed value of the lower configurable symbol on the first reel 1108*a* from MINI to 2X MINI, corresponding with the 2× multiplier shown in the first multiplier meter 1112*a*. The second and fifth reels 1108*b*, 1108*e* do not include any multiplier symbols. Accordingly, the second and fifth display meters 1112*d*, 1112*e* remain unchanged, e.g., from their default settings.

Figure 11D:
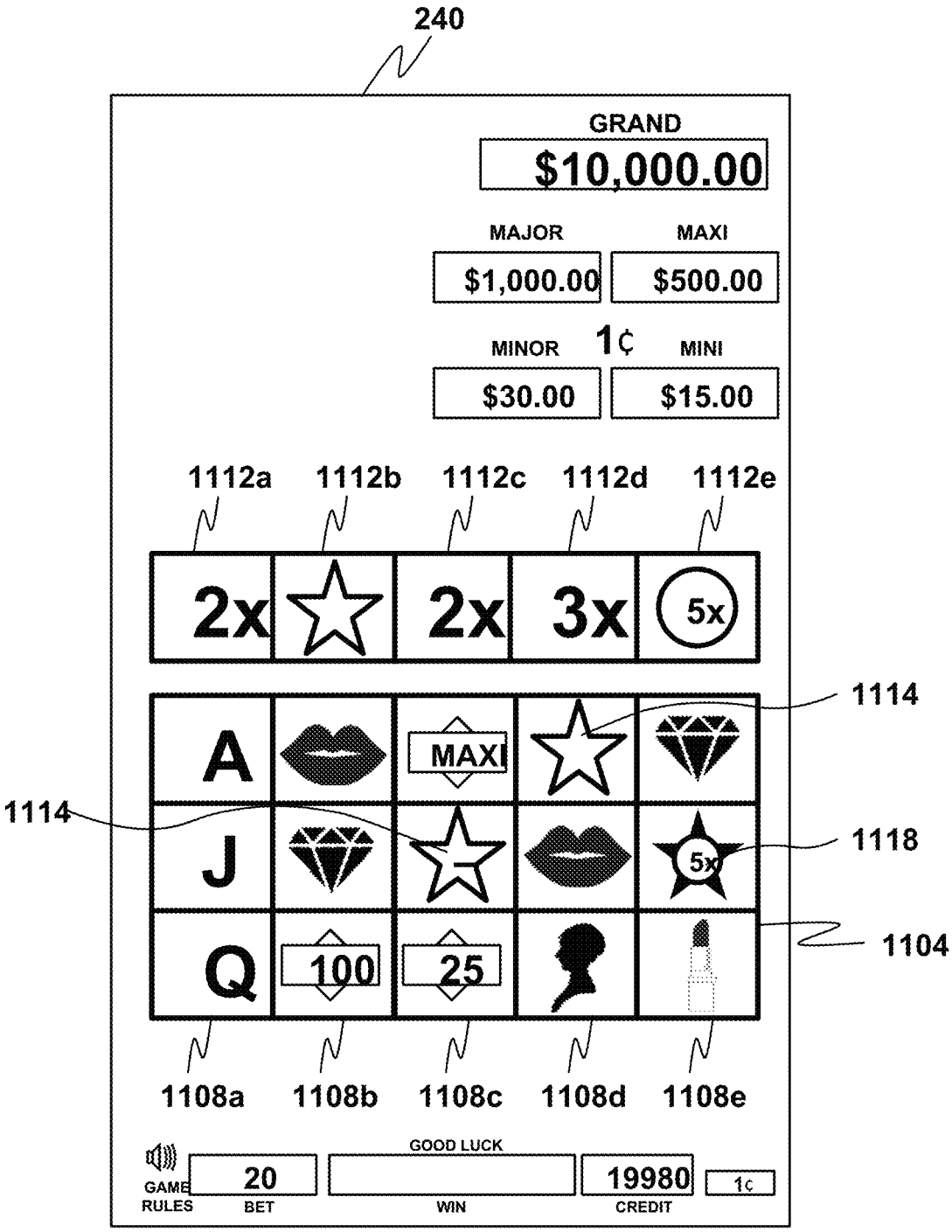

FIG. 11D shows a second base game outcome which occurs following the first base game outcome of FIG. 11C. As shown in FIG. 11D, some embodiments may also include static multiplier symbols 1118. In the illustrated example, a static multiplier symbol 1118 is designated by a star symbol overlaid by a circle that displays a respective multiplier value, such as 2×, 3×, 4×, 5×, etc. In this regard, the second base game outcome includes a 5× static multiplier symbol 1118 on the fifth reel 1108*e*. As a result, the fifth multiplier meter 1112*e* is updated to indicate that a 5× multiplier is associated with the fifth reel 1108*e*. In some such embodiments, a static multiplier symbol value may "lock" the respective multiplier meter at the awarded multiplier until the multiplier meter is reset (e.g., following the triggering and completion of a feature game) or otherwise unlocked. A locked multiplier meter may be visually altered, e.g., by highlighting, a color, indicia, or otherwise, to indicate its locked status. For example, in the illustrated example, the fifth multiplier meter 1112*e* displays the 5× multiplier in a circle to indicate that this value is locked. A meter may be "locked" at a static multiplier value in a variety of ways. For example, in some embodiments, the game is controlled such that multiplier symbols are not displayed in a column with a locked meter until the locked multiplier meter is reset or otherwise unlocked. In other embodiments, multiplier symbols may still be displayed or a reel with a locked meter, but their appearance may not result in any adjustment of the locked multiplier meter until the meter is reset or otherwise unlocked.

In some embodiments, the dynamic multiplier symbols 1114 may include both incrementing dynamic multiplier symbols and decrementing dynamic multiplier symbols. In such embodiments, the dynamic multiplier symbols may include further indicia to designate whether they function to increment or decrement a multiplier meter. For example, a dynamic multiplier (e.g., star) symbol may display a + (plus) sign to indicate that it increments a multiplier meter or a − (minus) sign to indicate that it decrements a multiplier meter. For example, the second base game outcome shown in FIG. 11D includes a decrementing dynamic multiplier symbol 1114 in the third reel 1108*c*, which causes the third multiplier meter 1112*c* to be decremented by one, e.g., from a 3× multiplier to a 2× multiplier.

Some implementations may involve decrementing or re-setting a multiplier value after presenting a predetermined number of base game instances. For example, after presenting the predetermined number of base game instances, a control system may control the display 240 to cause the fourth multiplier meter 1112*d* to be decremented by one, e.g., from a 3× multiplier to a 2× multiplier. The predetermined number may vary according to the particular implementation. In some examples, the predetermined number may be 4, 5, 6, 7, 8, 9 or 10 base game instances. Alternatively, or additionally, some implementations may involve re-setting the multiplier value after presenting a predetermined number of base game instances. Some such implementations may involve re-setting the multiplier value to a default value (such as a 1× value), whereas other such implementations may involve re-setting the multiplier value to a randomly-determined value. Embodiments that include both decrementing and re-setting may, in some examples, reference one predetermined number of base game instances for decrementing and another predetermined number of base game instances for re-setting. According to some examples, if the predetermined number of base game instances results in a trigger of a feature game round, multiplier values will not be decremented or re-set until after the feature game round has been completed.

During play of the base game, in some examples the multiplier meters may continue to be adjusted in response to the appearance of multiplier symbols in one of the ways just described. When a feature game is triggered, the multipliers shown on the meters 1112*a*-1112*e* may be applied to determine an award in connection with play of the feature game.

Figure 11E:
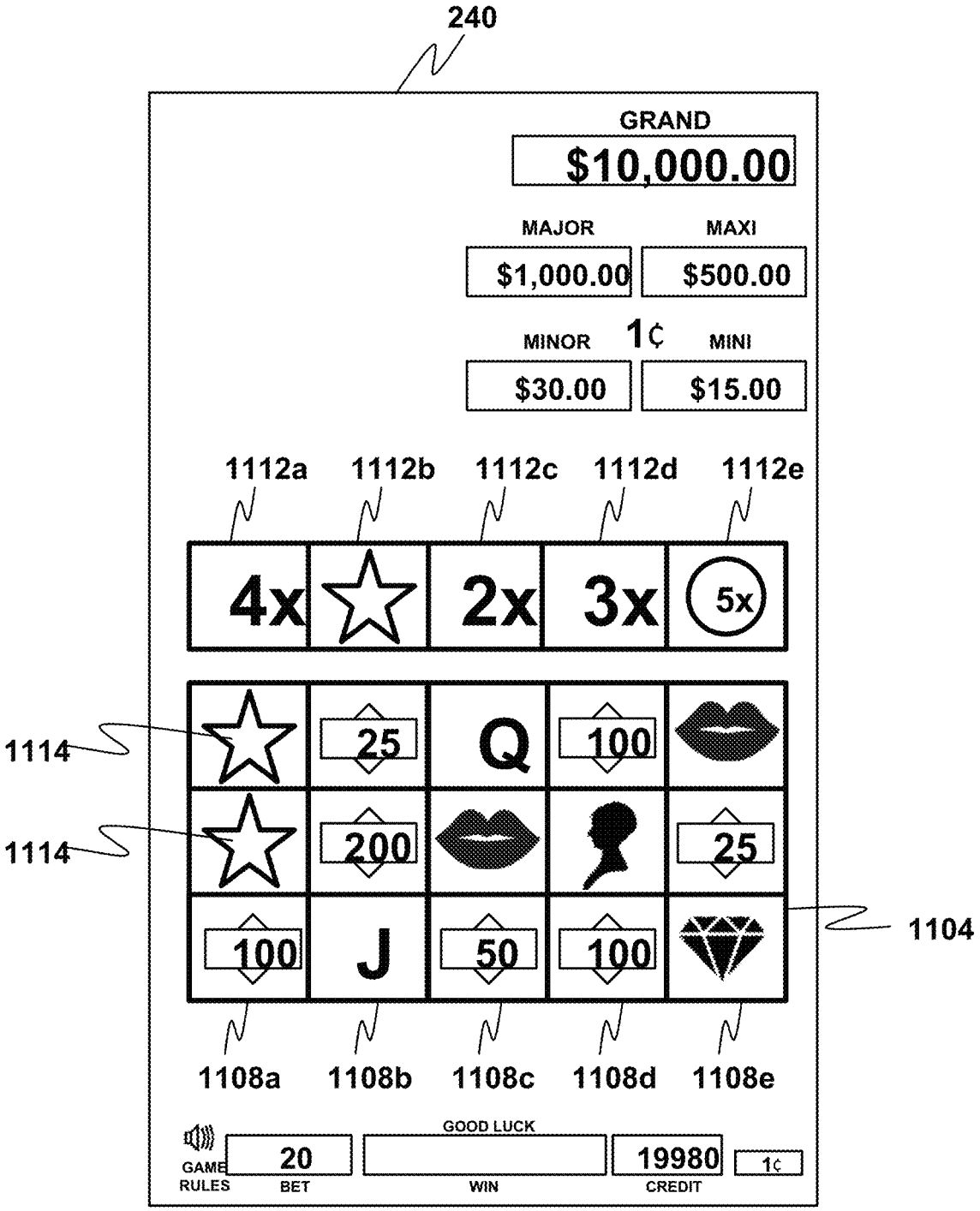

By way of example, FIG. 11E shows a third base game outcome that triggers the feature game because it includes the determined number of configurable symbols, e.g., at least 6 (six) in this example. The third base game outcome also includes two dynamic multiplier symbols 1114 in the first reel 1108*a*. As a result, the first multiplier meter is incremented by two, i.e., from a 2× multiplier to a 4× multiplier.

The game then transitions to the feature game. FIGS. 11F to 11I represent screen shots illustrating play of feature game that was triggered in FIG. 11E. The feature game is in the form of a hold and spin game in which any configurable symbols from the triggering base game outcome are retained on the display matrix 1104 and the player is awarded an additional number of spins (e.g., 8 in the illustrated example) during which the player tries to accumulate more of the configurable symbols. A spin meter 1130 may be displayed to indicate the number of spins remaining in the feature game.

Figure 11F:
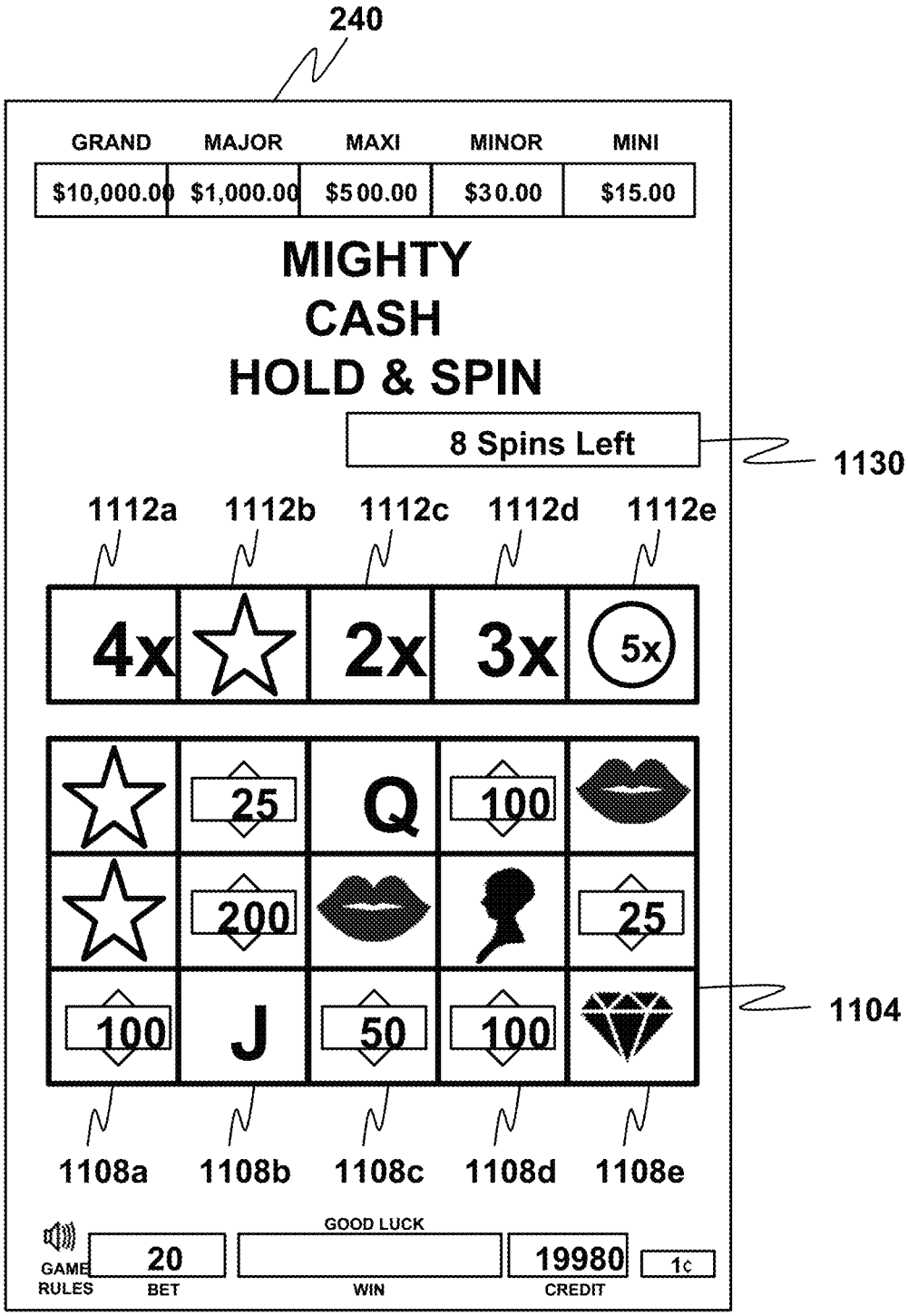
Figure 11G:
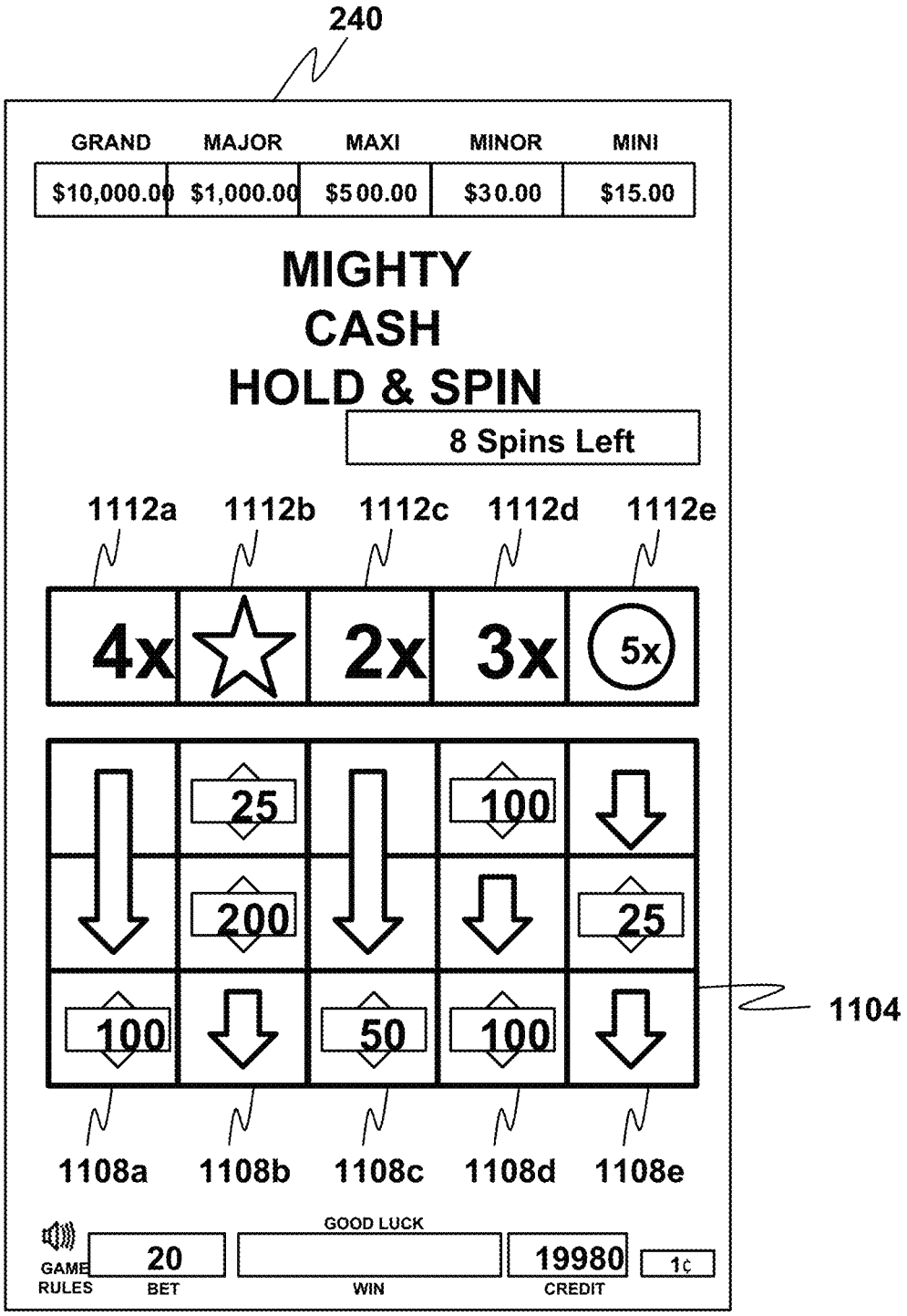
Figure 11H:
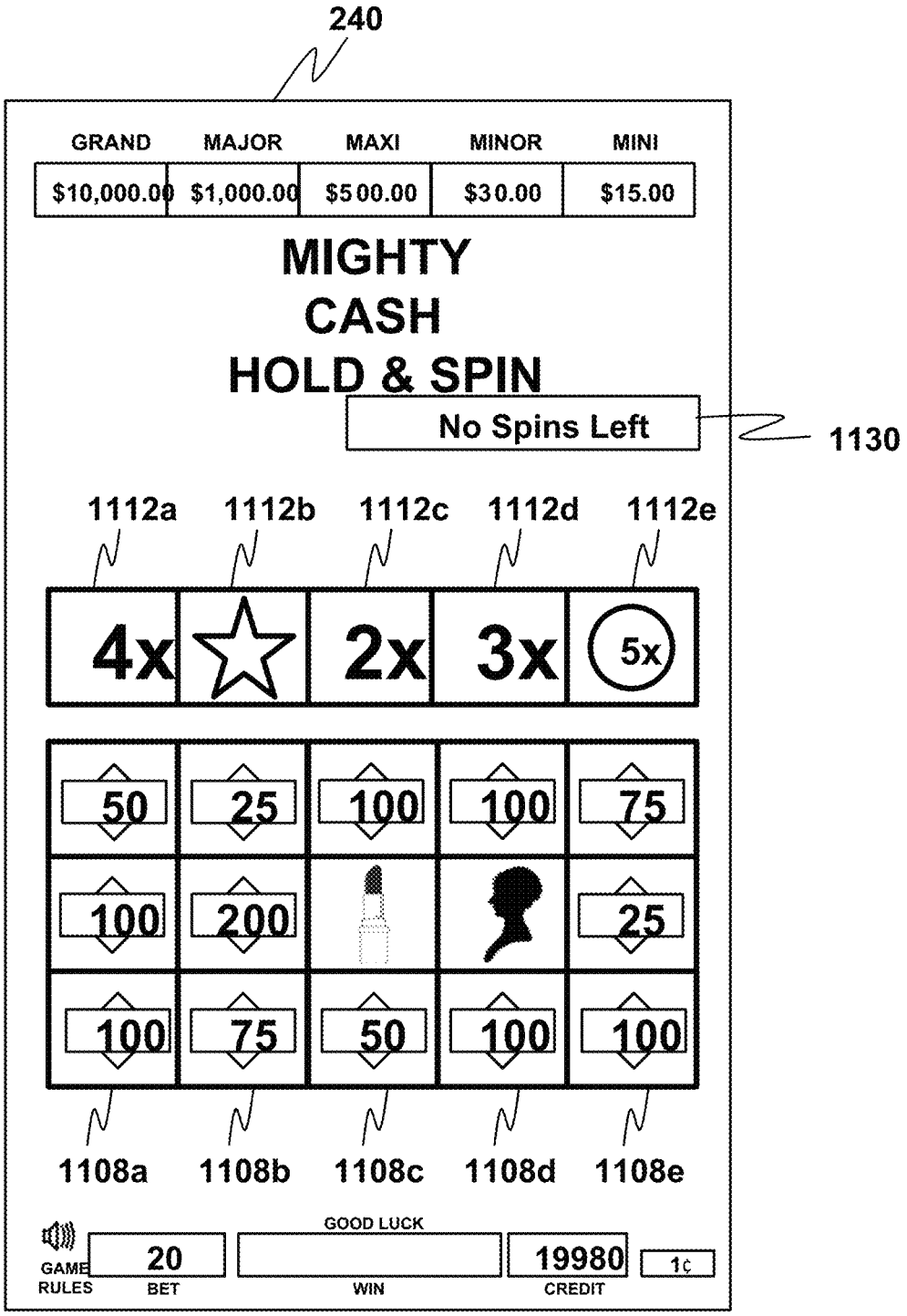

FIG. 11F shows the display 240 at the start of the hold and spin feature, FIG. 11G shows the display during the first spin of the feature, and FIG. 11H shows the display following completion of the first spin of the feature. In this example, the player collected a total of 13 configurable symbols, including seven during the triggering base game outcome and an additional six during the hold and spin feature.

Figure 11I:
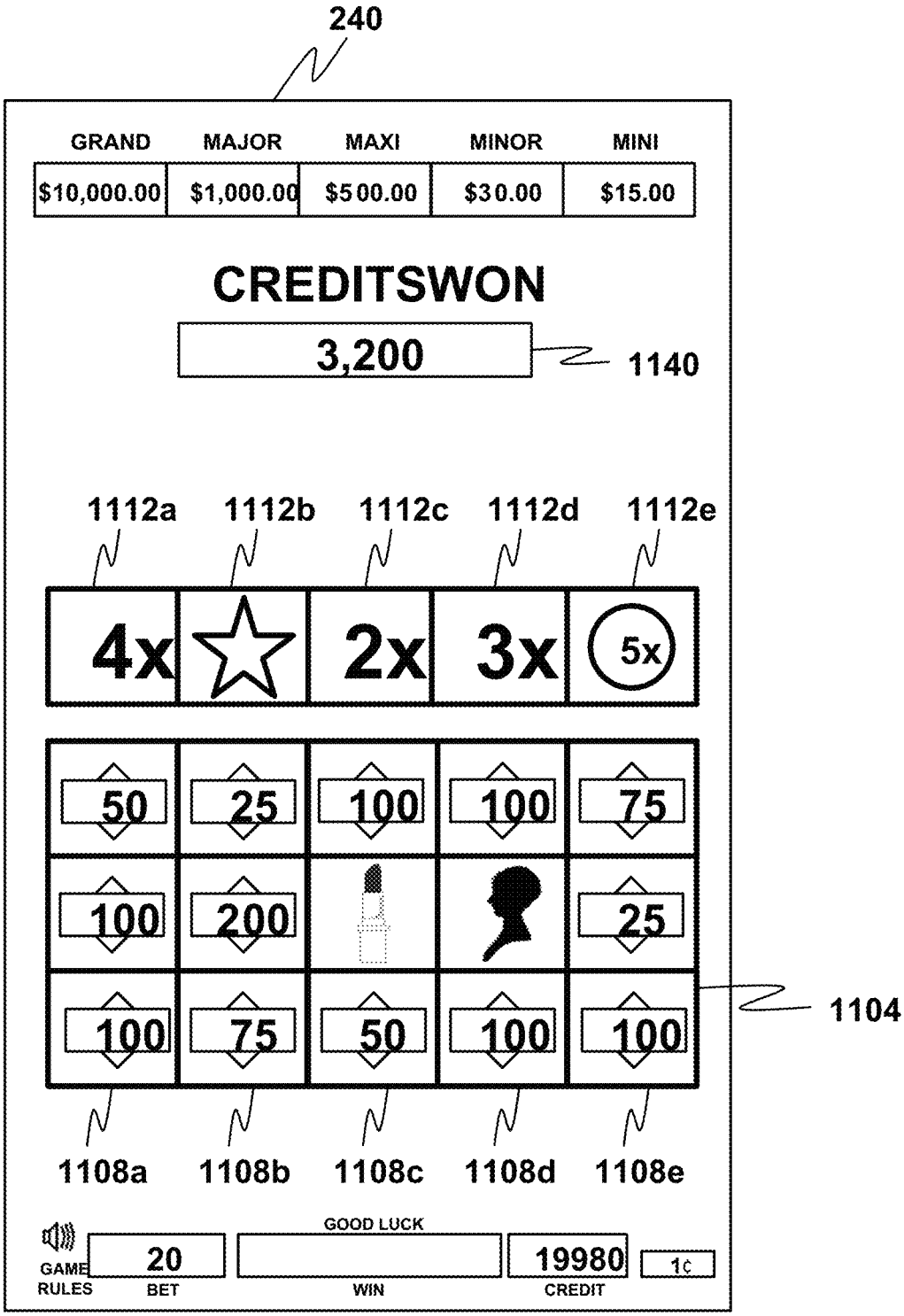

Once the feature game is completed, in this example the controller determines and pays out a feature game award. In some embodiments, the multiplier values carried by the meters may be applied to the values of the held symbols in a respective reel to determine the amount to be awarded to the player. In the illustrated example, the 250 credits carried by the held symbols on the first reel 1108*a* are multiplied by the 4× multiplier from the first multiplier meter 1112*a*, resulting an award of 1000 credits. The 300 held credits on the second reel 1108*b* are not enhanced because the second multiplier meter 1112*b* does not carry a multiplier. The third reel 1108*c* displays 150 held credits and the associated third multiplier meter 1112*e* is set at a 2× multiplier, resulting in an award of 300 credits. The 200 credits held on the reel 1108*d* are multiplied by the 3× multiplier carried on the fourth multiplier meter 1112*d*, resulting in an award of 600 more credits. Likewise, the 200 credits held on the fifth reel 1108*e* are multiplied by the 5× multiplier carried on the fifth multiplier meter 1112*e*, resulting in an award of 1000 more credits. Accordingly, after applying the multipliers, the feature game in this example results in an award of 3200 credits (e.g., $32.00 in the example where each credit is valued at 1 cent as shown in FIG. 11I).

An animation may be provided to visually display the credits from the held symbols being accumulated on a credit meter 1140 before the display matrix 1104 is cleared. For example, an animation may display rockets (not shown) or other elements sequentially moving from each respective configurable symbol to the credit meter 1140. When a respective rocket reaches the meter, it may explode and the value from the originating configurable symbol may be added to the prize meter. When a multiplier is applicable, the animation may be repeated, e.g., twice for a 2× multiplier, three times for a 3× multiplier, etc. The award meter 1140 may show the collected credits or the cash equivalent to the collected credits.

Figure 11J:
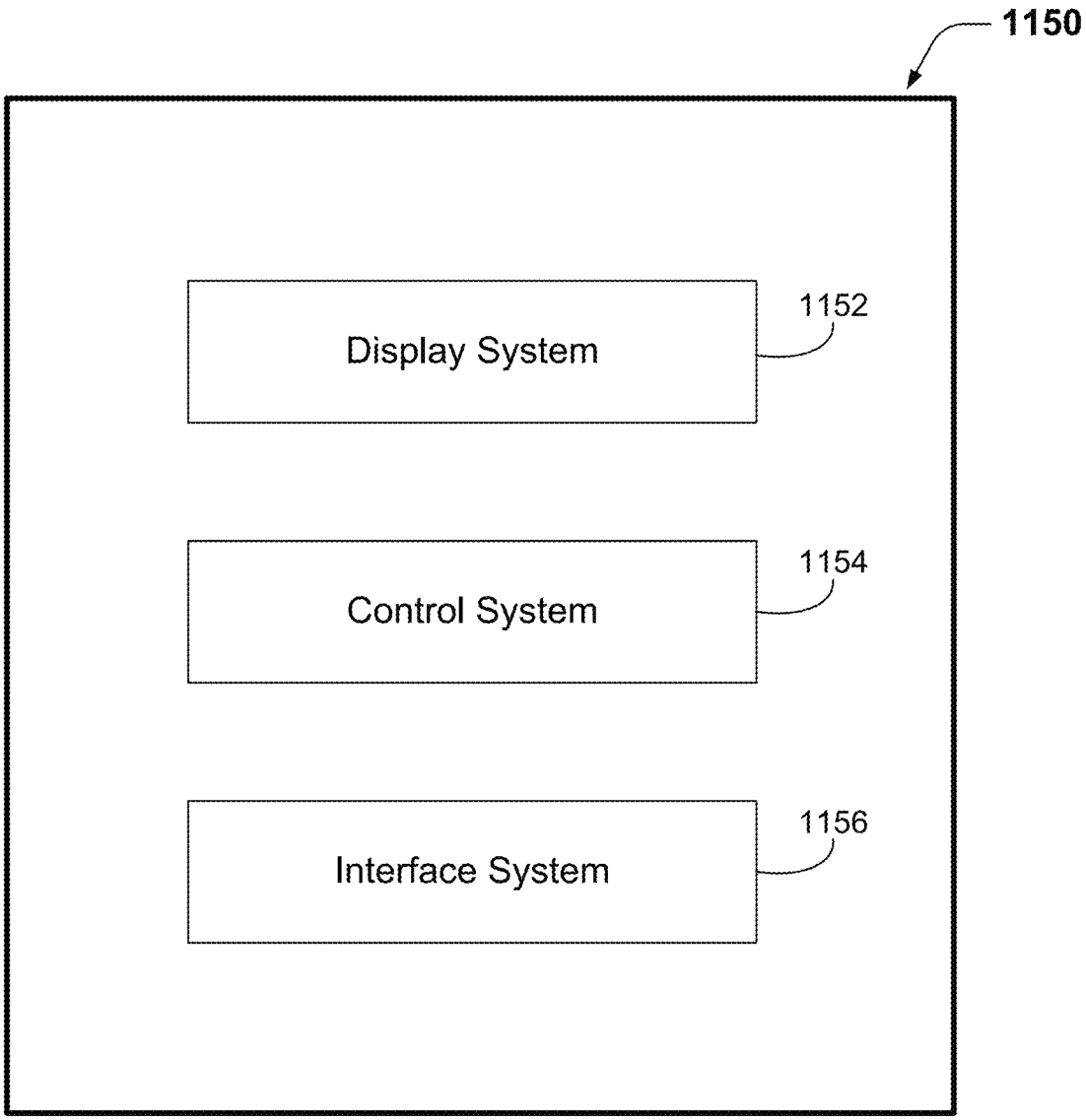
FIG. 11J is a block diagram that shows blocks of an apparatus according to one example.

FIG. 11J is a block diagram that shows blocks of an apparatus according to one example. According to some examples, the apparatus 1150 may be, or may include, a gaming device. In some examples, the apparatus 1150 may be an EGM such as those described above with reference to FIGS. 1 and 2A. However, in alternative examples, the apparatus 1150 may be a mobile device such as described above with reference to FIG. 2B or an EUD as described above with reference to FIG. 2C.

In this example, the apparatus 1150 includes a display system 1152 and a control system 1154 that is configured to communicate with the display system 1152. In this example, the control system 1154 is configured to communicate with the display system 1152 via wired communication, e.g., via electrical signals. In alternative implementations, the control system 1154 may be configured to communicate with the display system 1152 via wireless communication. Accordingly, at least a portion of the control system 1154 may be coupled to the display system 1152. As used herein, the term "coupled to" has a meaning that could include being physically coupled for wired communication or being configured for wireless communication.

The control system 1154 may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. Although the interface system 1156 is shown as being separate from the control system 1154, in some implementations the interface system 1156 may be part of the control system 1154. In some implementations, the interface system 1156 may include the entire control system 1154. The control system 1154 also may include (and/or be configured for communication with) one or more memory devices, such as one or more random access memory (RAM) devices, read-only memory (ROM) devices and/or other types of non-transitory media. In some implementations, at least a portion of the control system 1154 may be implemented as a register. Accordingly, the apparatus 1150 may have a memory system that includes one or more memory devices, though the memory system is not shown in FIG. 11J.

The control system 1154 may be capable of performing, at least in part, the methods disclosed herein. In some examples, the control system 1154 may be capable of performing at least some of the methods described herein according to instructions (e.g., software) stored on non-transitory media. For example, the control system 1154 may be configured for controlling the display system 1152 and/or for receiving and processing data from at least a portion of the display system 1152, e.g., as described below.

The display system 1152 may include, one or more liquid crystal displays (LCDs), plasma displays, light-emitting diode (LED) displays, microLED displays or organic light-emitting diode (OLED) displays. According to some implementations, the display system 1152 may include at least one flexible display, such as a flexible OLED. Although shown as separate components in FIG. 11J, the display system 1152 may, in some examples, include at least a portion of the control system 1154. For example, the display system 1152 may include one or more processors, microprocessors, programmable logic devices, discrete gates or transistor logic, etc.

In the example shown in FIG. 11J, the apparatus 1150 includes an interface system 1156. In some examples, the interface system may include a wireless interface system. In some implementations, the interface system 1156 may include a network interface, an interface between the control system 1154 and the display system 1152, an interface between the control system 1154 and a memory system and/or an interface between the control system 1154 and an external device interface (e.g., a port or an applications processor). In some examples, the interface system 1156 may include one or more user interfaces, such as a touch screen, one or more buttons, a gesture recognition system, a voice recognition system, etc.

According to some implementations, the apparatus 1150 may be a single device, whereas in other implementations the apparatus 1150 may be a system that includes more than one device. Accordingly, the terms "apparatus" and "system" may sometimes be used interchangeably herein. In other examples, the apparatus 1150 may be a component of another device. For example, in some implementations at least a portion of the display system 1152 and/or the control system 1154 may be included in more than one apparatus. For example, in some implementations at least part of the control system 1154 may reside in a server, such as a central determination server, a server that tracks feature award credits, etc. Some implementations of the apparatus 1150 may not include a display system. In some such implementations, the control system 1154 may be configured for controlling the display system of another device.

Figure 11K:
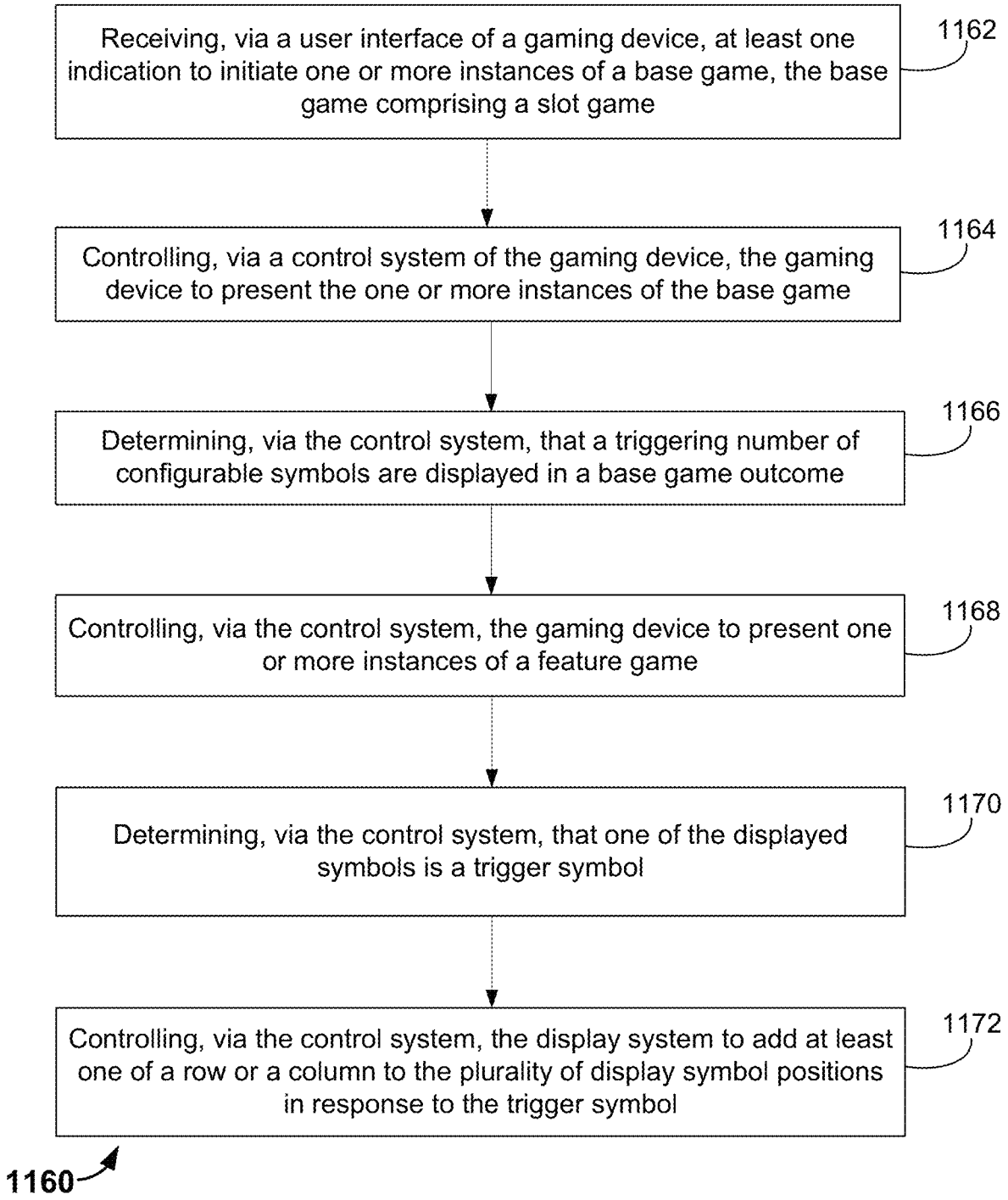
FIG. 11K is a flow diagram that shows blocks of a method according to one example.

FIG. 11K is a flow diagram that shows blocks of a method according to one example. In some examples method 1160 may be performed, at least in part, by an apparatus such as that described above with reference to FIG. 11J. In some examples, the method 1160 may be performed by a control system (e.g., the control system 1154 of FIG. 11J) according to software stored upon one or more non-transitory storage media. As with other methods described herein, the number and sequence of blocks shown in FIG. 11K are merely examples. Similar disclosed methods may include more or fewer blocks. Moreover, at least some of the blocks may occur in a different sequence than the sequence that is shown in a flow diagram. Some aspects of method 1160 are described below with reference to FIGS. 11K-13H.

According to this example, block 1162 involves receiving, via a user interface of a gaming device, at least one indication to initiate one or more instances of a base game. In this example, the base game is, or includes, a slot game. For example, the user input may be received by the control system 1154 of FIG. 11J, via a user interface of the interface system 1156. Block 1162 may, for example, involve receiving an indication that a user has pressed a "play" button of an EGM, receiving an indication that the user has touched an area of a touch screen that corresponds to a displayed image of a "play" button, etc. In some such implementations, block 1162 may involve verifying that there is sufficient credit for at least one instance of the base game.

According to this implementation, block 1164 involves controlling, via a control system of the gaming device, the gaming device to present the one or more instances of the base game. In some examples, block 1164 may involve determining a base game outcome and corresponding display symbols. The display symbols may, for example, be selected from a symbol set that includes configurable symbols and non-configurable symbols. In some instances, the configurable symbols and non-configurable symbols may be such as those disclosed herein, whereas in other examples one or more of these symbols may differ from those disclosed herein. In some instances, block 1164 may involve controlling the display system of the gaming device to display the corresponding display symbols at a plurality of display symbol positions on a display device of the display system. The plurality of display symbol positions may be arranged in a plurality of display symbol rows and display symbol columns.

According to this example, block 1166 involves determining, via the control system, that a triggering number of configurable symbols are displayed in a base game outcome. As noted elsewhere in this disclosure, the triggering number of configurable symbols may vary according to the particular implementation. In some instances, the triggering number of configurable symbols may be 6, whereas in other examples the triggering number of configurable symbols may be more than 6 or fewer than 6.

In this example, block 1168 involves controlling, via the control system, the gaming device to present one or more instances of a feature game. Presenting an instance of the feature game may involve holding each displayed configurable symbol at its corresponding display symbol position. Presenting an instance of the feature game may involve selecting and displaying replacement symbols for non-configurable symbols in a plurality of display symbol positions not occupied by the held configurable symbols.

According to this implementation, block 1170 involves determining, via the control system, that one or more of the displayed symbols is a trigger symbol. According to this example, block 1172 involves controlling, via the control system, the display system to add at least one of a row or a column to the plurality of display symbol positions in response to the trigger symbol.

In some implementations, the one or more trigger symbols land during a base game. According to some such implementations, the one or more trigger symbols may be among the triggering number of configurable symbols displayed in a base game outcome. Accordingly, in some such implementations block 1170 may be performed before block 1168. In some such examples, the one or more trigger symbols may cause the initiation of a feature game round with an expanded matrix, which may have additional rows and/or columns of configurable symbols. In some instances, the one or more trigger symbols may cause additional rows of configurable symbols to be displayed. The number of additional rows may, for example, correspond to the number of trigger symbols. However, in some instances the trigger symbol may be selected and displayed during an instance of a feature game.

Figure 12A:
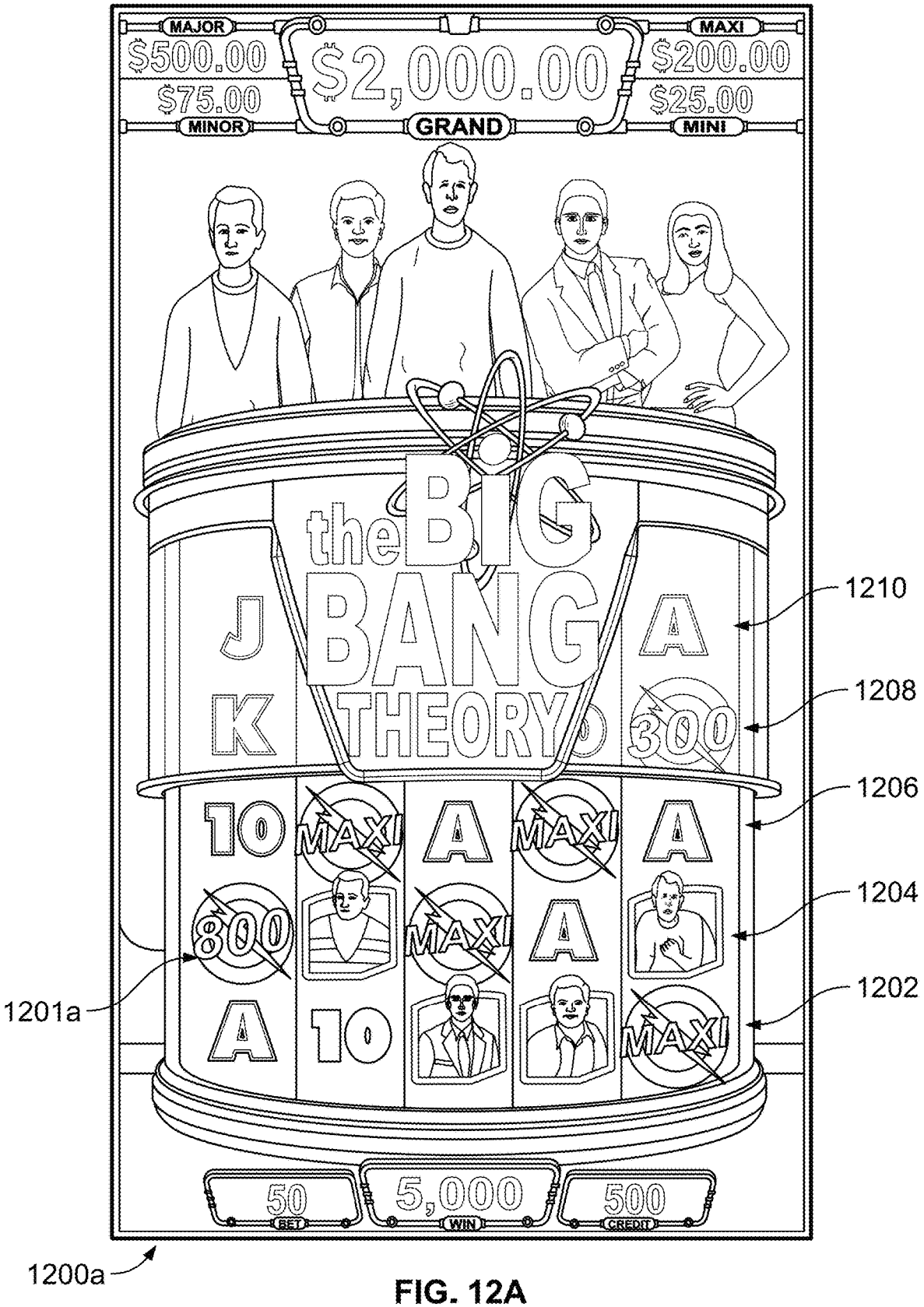
FIG. 12A shows an example of a base game outcome in which a trigger symbol is a configurable symbol.

According to some examples, the trigger symbol may be a configurable symbol, e.g., a particular type of configurable symbol. FIG. 12A shows an example of a base game outcome in which a trigger symbol is a configurable symbol. In this example, the trigger symbol 1201*a* is a gold configurable symbol, which has a value of 800 in this example. In other examples, the trigger symbol may be a configurable symbol having a higher or lower value and/or a different color. In still other examples, the trigger symbol may be a non-configurable symbol. Some examples are described below with reference to FIGS. 13A-13H. At the time depicted in FIG. 12A, the active display symbol positions of GUI 1200*a* include 3 rows (rows 1202, 1204 and 1206) and 5 columns. At this time, rows 1208 and 1210 are inactive. According to this example, the trigger symbol is one of the triggering number of configurable symbols displayed in a base game outcome. In this example, entering the feature game round is referred to as entering "Mighty Cash." In alternative implementations, a trigger symbol may only land during an instance of a feature game, not during an instance of a base game.

Figure 12B:
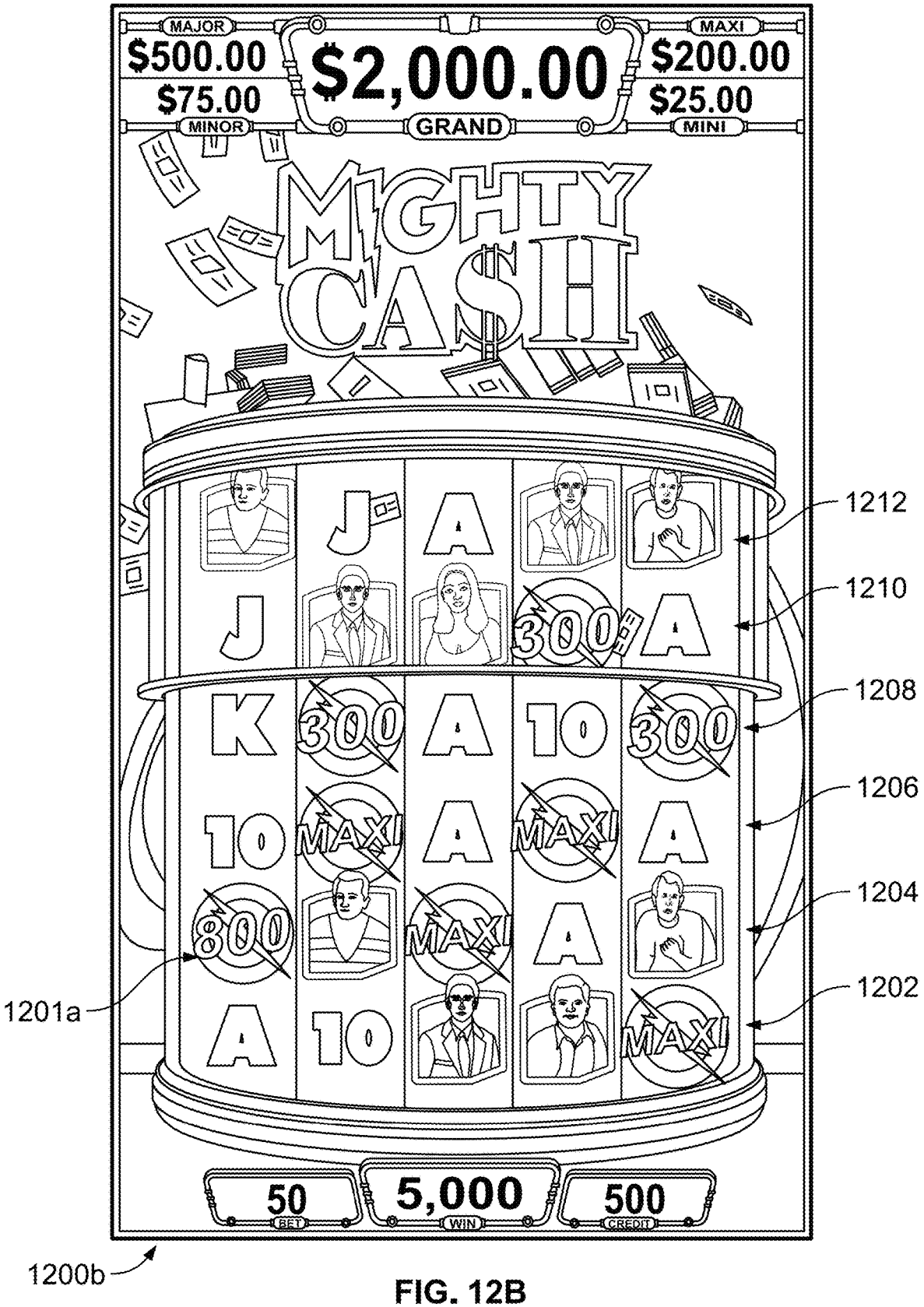
FIG. 12B shows an example of a GUI that may be displayed subsequent to a trigger symbol landing during a base game.

FIG. 12B shows an example of a GUI that may be displayed subsequent to a trigger symbol landing during a base game. In response to the trigger symbol the control system may cause the display system to add one or more rows and/or columns to the active display symbol positions. In the example shown in FIG. 12B, the control system has caused the display system to add row 1208 to the active display symbol positions, such that the active display symbol positions include 4 rows and 5 columns. According to this implementation, if two of the triggering number of configurable symbols displayed in a base game outcome are trigger symbols, two rows of active display symbol positions will be added. In this example, if three or more of the triggering number of configurable symbols displayed in a base game outcome are trigger symbols, three rows of active display symbol positions will be added.

In some alternative implementations, a trigger symbol may cause one or more additional columns of active display symbol positions to be added. In some implementations, certain trigger symbols may cause more than one row (or column) of active display symbol positions to be added. In some such implementations, one type of trigger symbol may cause one row (or column) of active display symbol positions to be added and another type of trigger symbol may cause two rows (or columns) of active display symbol positions to be added. According to some examples, a mystery trigger symbol may cause a previously undetermined number of rows (or columns) of active display symbol positions to be added. The number of extra rows or columns may, for example, be determined during a particular game instance. According to some examples, if the triggering number of configurable symbols displayed in a base game outcome includes a trigger symbol, this will also cause one or more additional free instances of a feature game round to be awarded.

Figure 12C:
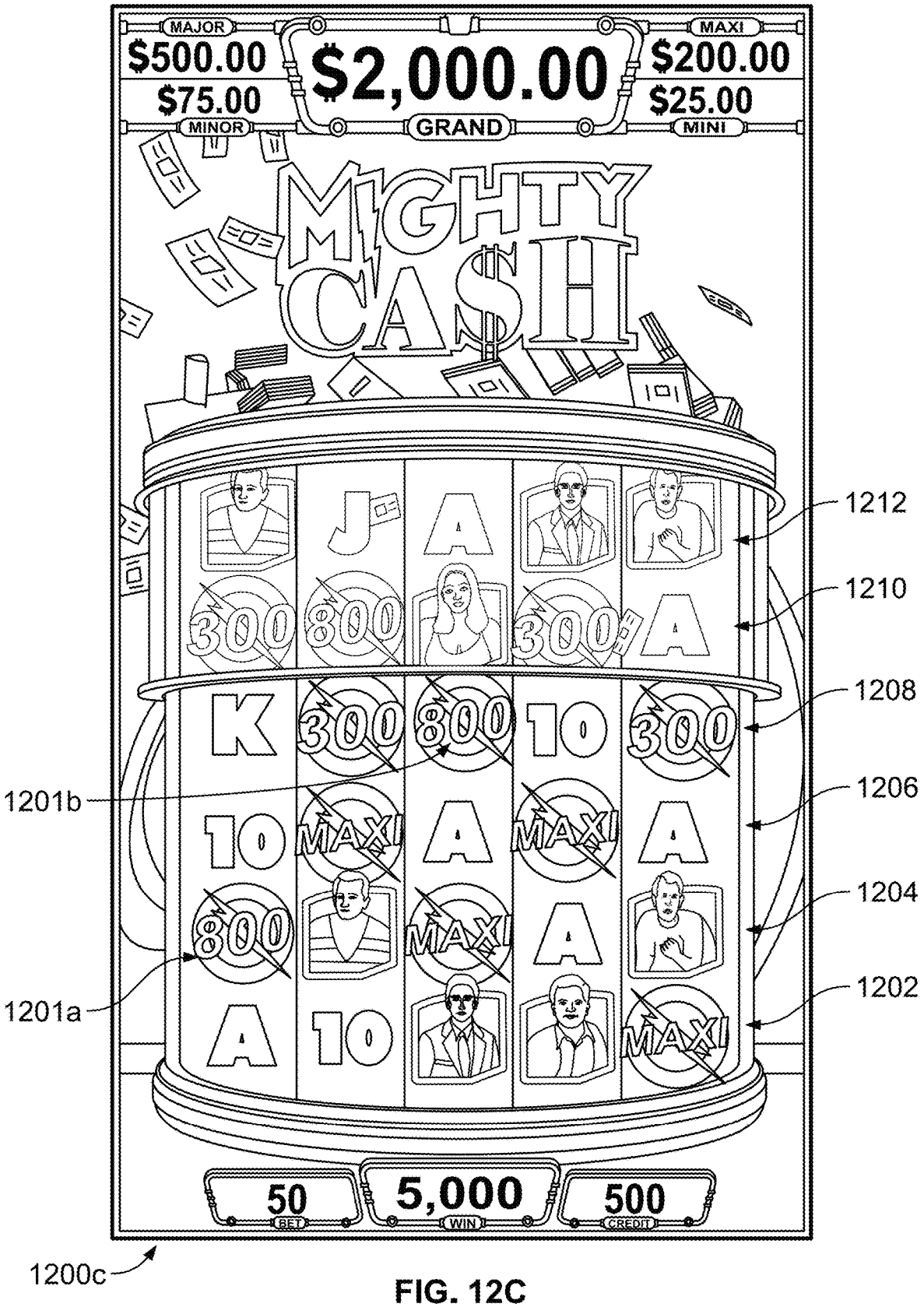
FIGS. 12C, 12D and 12E show examples of GUIs that may be displayed subsequent to the GUI shown in FIG. 12B.
Figure 12D:
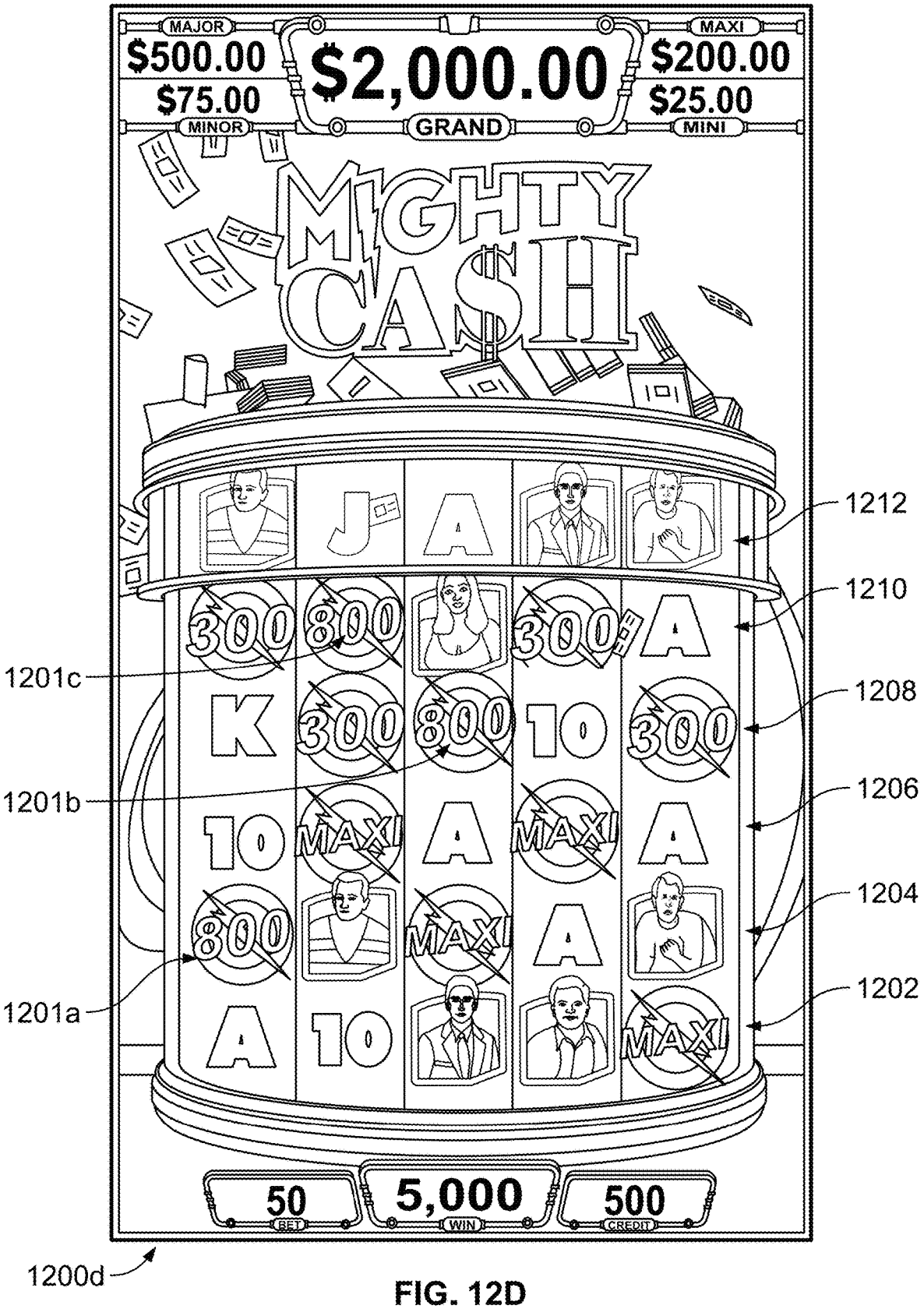
Figure 12E:
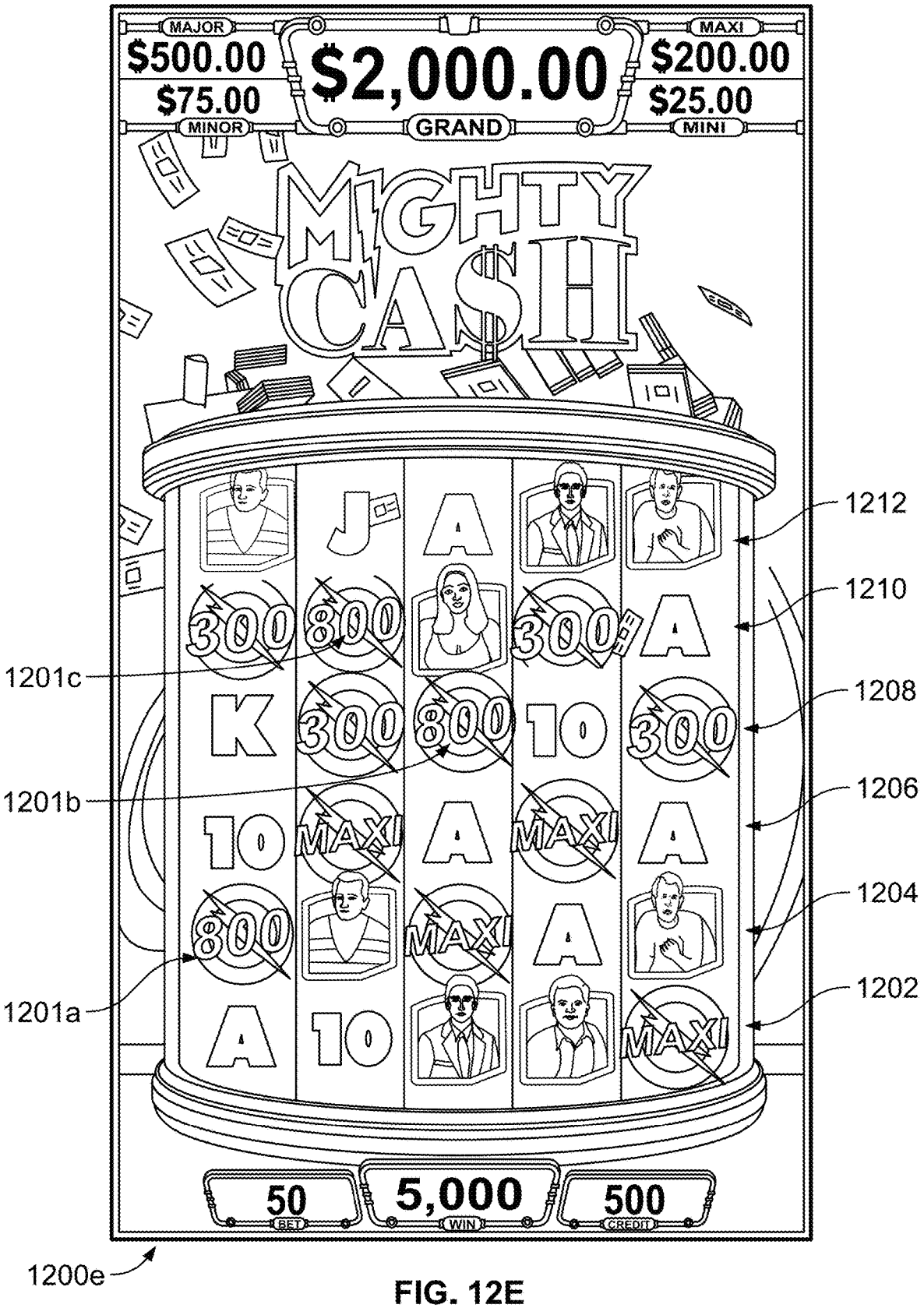

FIGS. 12C, 12D and 12E show examples of GUIs that may be displayed subsequent to the GUI shown in FIG. 12B. As noted above, in some examples one or more trigger symbols may be selected and displayed during an instance of a feature game. In some such examples, even if one or more trigger symbols were included in the triggering number of configurable symbols displayed in a base game outcome, one or more trigger symbols also may be selected and displayed during an instance of a feature game. In the example, shown in FIG. 12C, an additional trigger symbol (trigger symbol 1201*b*) has landed during an instance of a feature game after row 1208 has been added to the active display symbol positions. Because the trigger symbol 1201*b* has landed in a row that is now active, an additional row of active display symbol positions (row 1210) will be added (see GUI 1200*d* of FIG. 12D). In the example shown in FIG. 12C, the GUI 1200*c* had included the trigger symbol 1201*c* before row 1210 became active. When row 1210 becomes active (as shown in GUI 1200*d* of FIG. 12D), the trigger symbol 1201*c* is then in an active display symbol position. Therefore, according to the example shown in FIG. 12E, an additional row of display symbol positions (row 1212) becomes active without requiring another spin or feature game instance to occur.

Figure 12F:
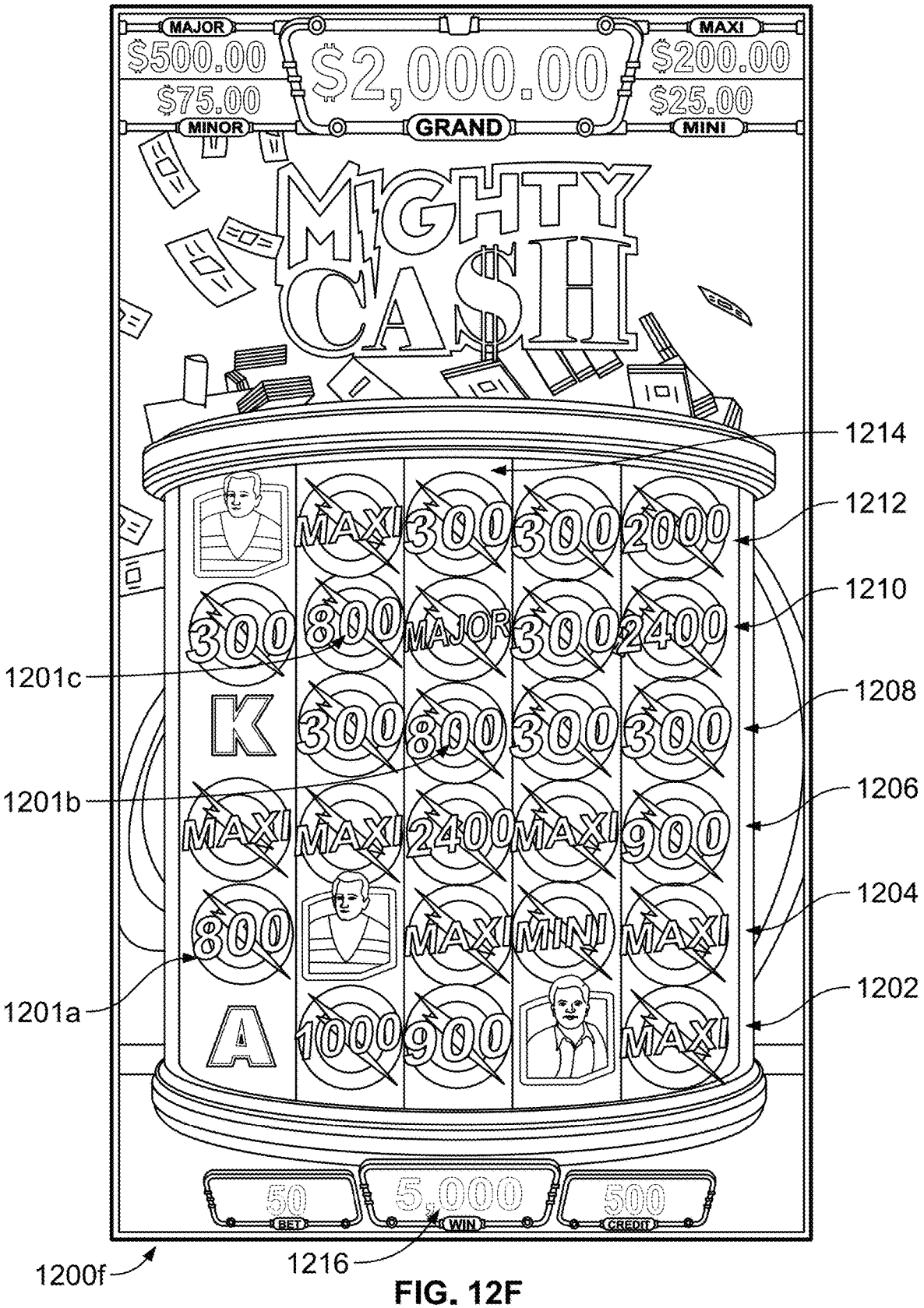
FIG. 12F shows an example of a GUI that may be displayed subsequent to the GUI shown in FIG. 12E.

FIG. 12F shows an example of a GUI that may be displayed subsequent to the GUI shown in FIG. 12E. In this example, the GUI 1200*f* includes one of a series of images presented on a display at the conclusion of a feature game round. According to this example, a light ray (like the light ray 1214 of GUI 1200*f*) is "zapped" upward from each configurable symbol and then the value of the configurable symbol is shown on the win meter 1216.

In some examples, a multiplier will be applied according to how many configurable symbols are presented on a display at the conclusion of a feature game round. The multiplier may, for example, increase according to the number of configurable symbols. In one non-limiting example, a 2× multiplier will be applied if the number of configurable symbols is in the range of 15-19, inclusive, a 3× multiplier will be applied if the number of configurable symbols is in the range of 20-24, inclusive, a 4× multiplier will be applied if the number of configurable symbols is in the range of 25-29, inclusive, and a 5× multiplier will be applied if the number of configurable symbols is 30. According to some examples, the value of a configurable symbol is "zapped" twice if a 2× multiplier is being applied, three times if a 3× multiplier is being applied, etc., with one zap for each multiplier instance. In some implementations, certain prizes (e.g., the Grand or highest-level jackpot) may be excluded from the multiplier's effect. In this example, the number of active display symbol positions reverts to a 3×5 matrix after the conclusion of the feature game round.

Figure 13A:
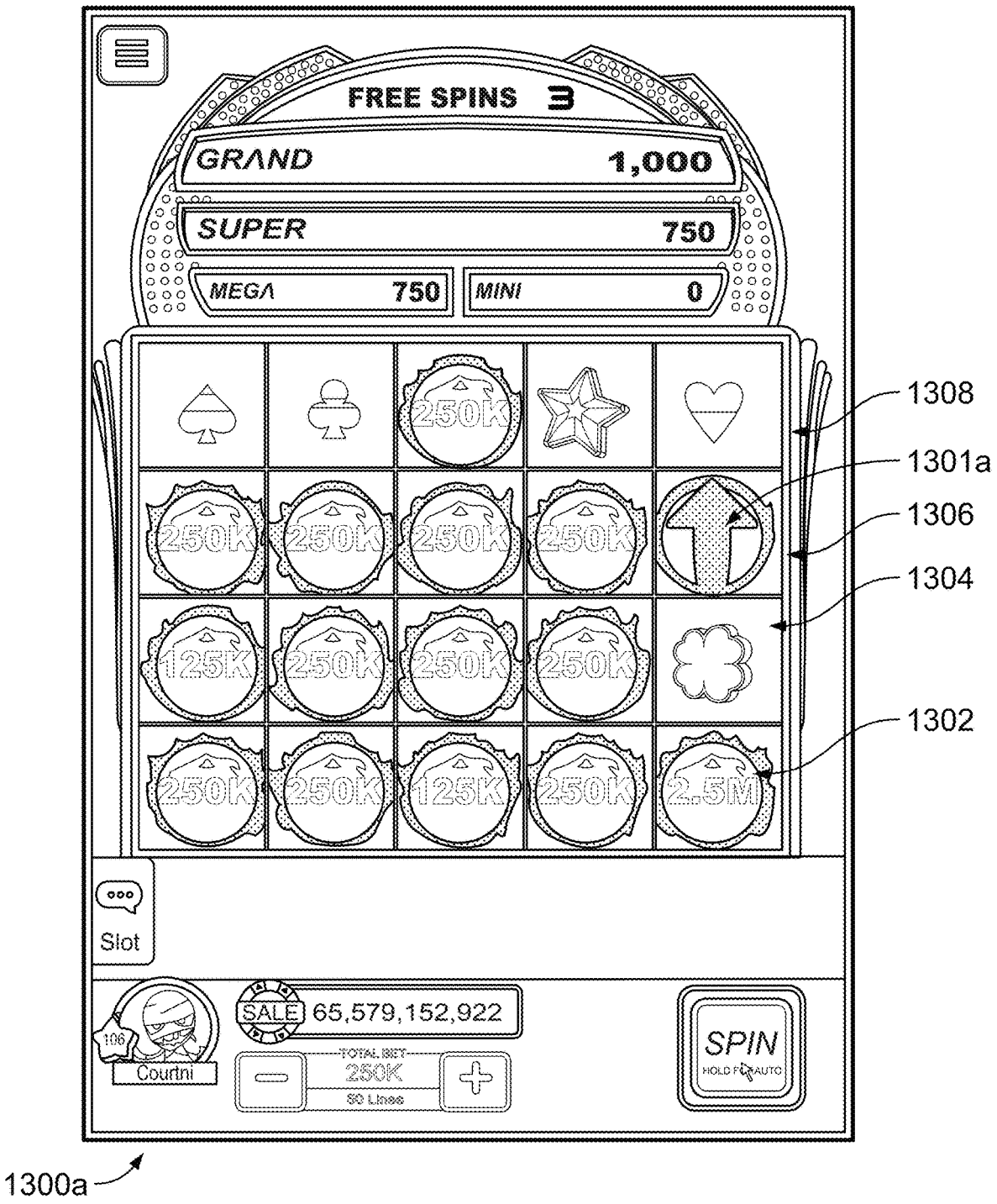
FIG. 13A shows an alternative example of a trigger symbol.

FIG. 13A shows an alternative example of a trigger symbol. According to this implementation, the trigger symbol is a particular type of non-configurable symbol. According to the example shown in the GUI 1300*a*, the trigger symbol 1301*a* is an arrow symbol. According to this example, the trigger symbol 1301*a* was selected and displayed during a previous instance of a feature game, at which time only rows 1302, 1304 and 1306 included active display symbols. According to this example, the trigger symbol 1301*a* caused an additional active display symbol row (row 1308) to be displayed.

Whether the trigger symbol is selected or displayed during a feature game or a base game, in some implementations the value of one or more displayed configurable symbols may be altered in response to the trigger symbol. A control system may be configured for controlling a display system to alter the displayed value of one or more configurable symbols in response to the trigger symbol.

In the examples shown in FIGS. 13A-13G, with each free spin of a feature game round, if an arrow trigger symbol lands the value of each currently-held configurable symbol is upgraded. In these examples, the value of each currently held configurable symbol is upgraded to the next configurable symbol value in an ascending sequence of configurable symbol values. According to these examples, a configurable symbol value of 125K upgrades to 250K, a configurable symbol value of 2.5 M upgrades to 3.75 M, a MINI progressive configurable symbol upgrades to a MEGA progressive configurable symbol in an ascending sequence of, in this example embodiment, of MINI, MEGA, SUPER, GRAND configurable symbol values, etc., in response to landing a trigger symbol. In other implementations, the value of configurable symbols may be increased or upgraded via different increments. For example, in some instances configurable symbols may be increased or upgraded according to a multiplier, e.g., by 1.5×, by 2×, by 2.5×, by 3×, etc. In some instances, configurable symbols may be increased or upgraded by a predetermined value, e.g., by 100 units, by 200 units, by 300 units, etc.

Moreover, in these examples an additional row of active display symbol positions is added each time a trigger symbol lands. According to these examples, the number of free spins is reset to 3 free spins each time a trigger symbol lands.

As noted above, FIG. 13A provides an example of game play in which the player has entered the feature game round and has already landed an arrow triggering symbol. At this stage, the player has received a first upgrade of configurable symbol values and a reel expansion of one row: the base game provides a 3×5 matrix of active display symbol positions which, with the landing of the arrow symbol, has grown by one row to a 4×5 matrix of active display symbol positions. The player has also played at least one free spin and landed at least one more configurable symbol (the 250K symbol in row 1308, column 3), which caused the Free Spins counter to be reset to 3 free spins.

Figure 13B:
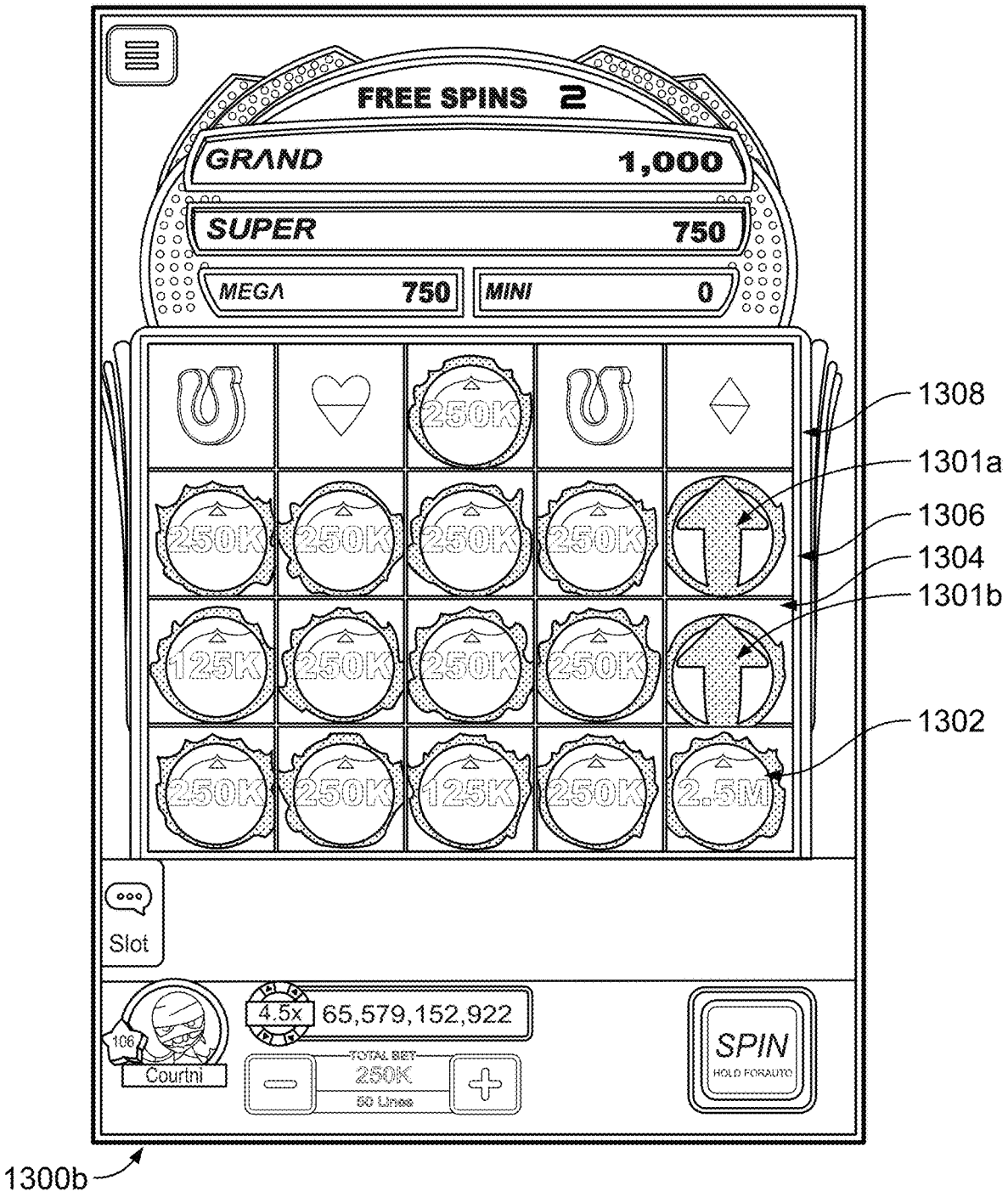
FIG. 13B provides an example of continued play of the feature game round.

FIG. 13B provides an example of continued play of the feature game round. In this example, a second arrow triggering symbol (the trigger symbol 1301*b*) has landed in row 1304, column 5).

FIGS. 13C, 13D, 13E, 13F, 13G and 13H provide examples of continued play of the feature game round. In these examples, the player is awarded an upgrade of all existing configurable symbols and an additional row of configurable symbols. In these examples, 125K symbols are upgraded to 250K, 250K symbols are upgraded to 500K and a 2.5 M symbol is upgraded to 3.75 M.

Figure 13C:
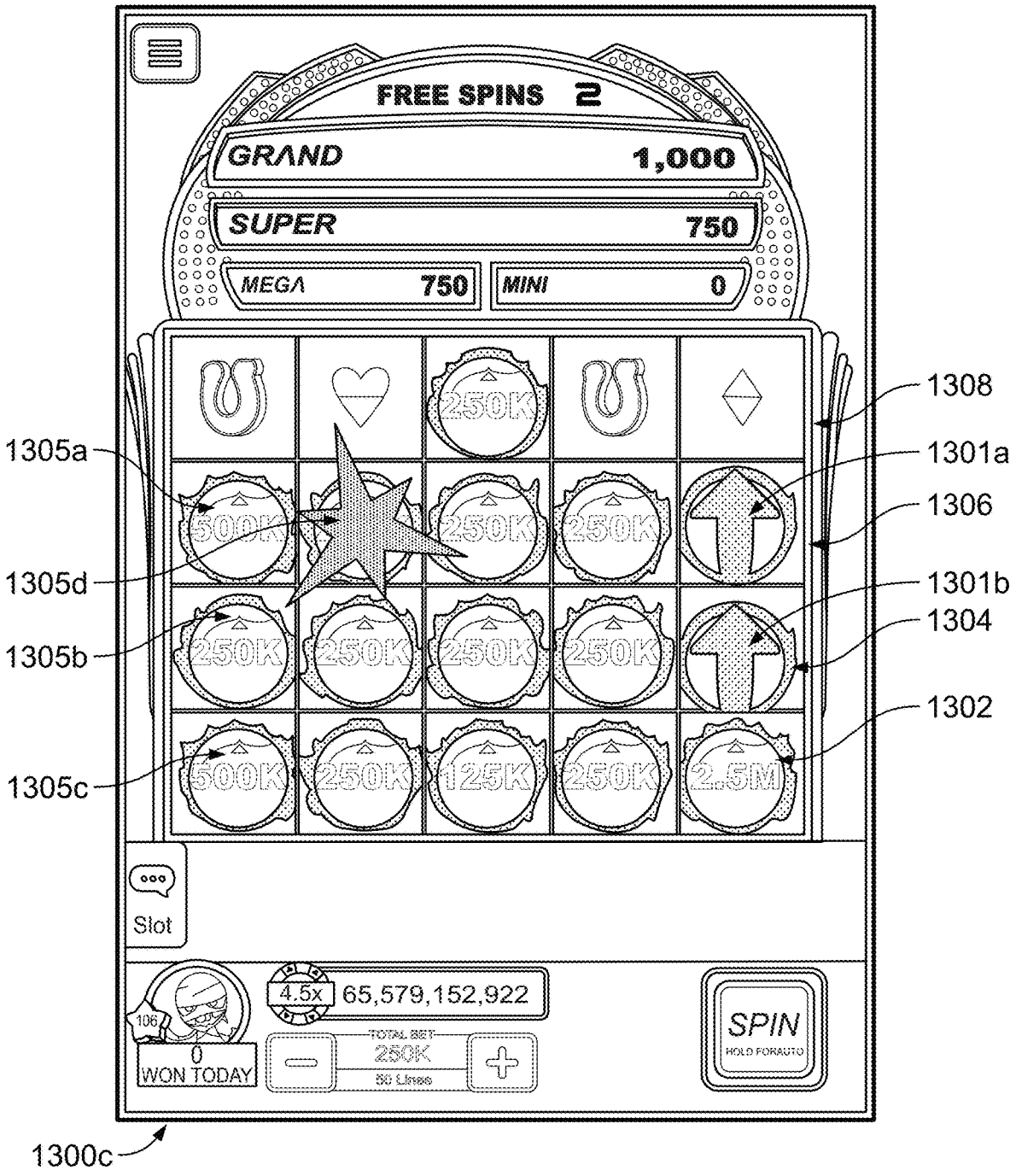
FIGS. 13C, 13D, 13E, 13F, 13G and 13H provide examples of continued play of the feature game round.
Figure 13D:
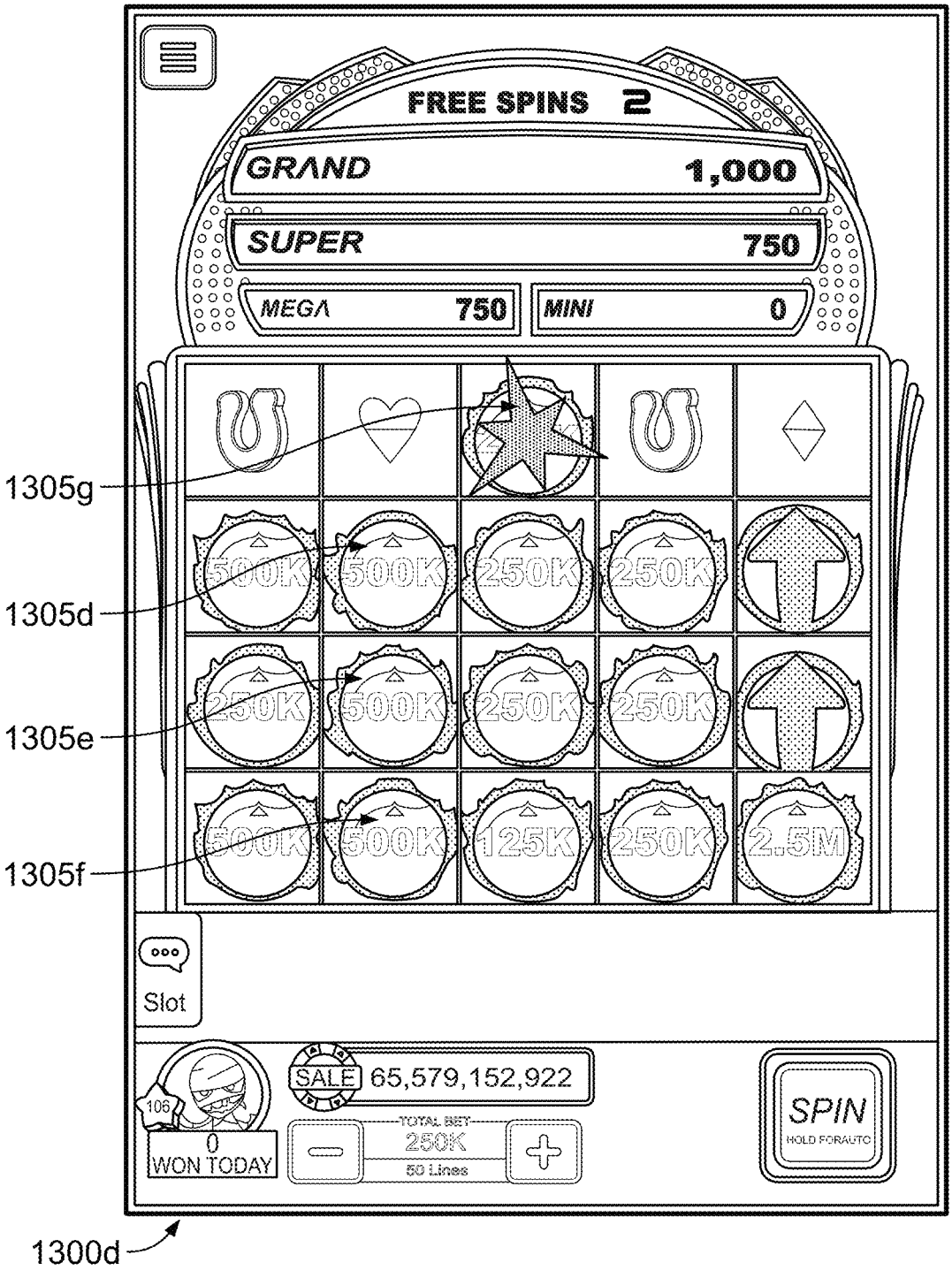
Figure 13E:
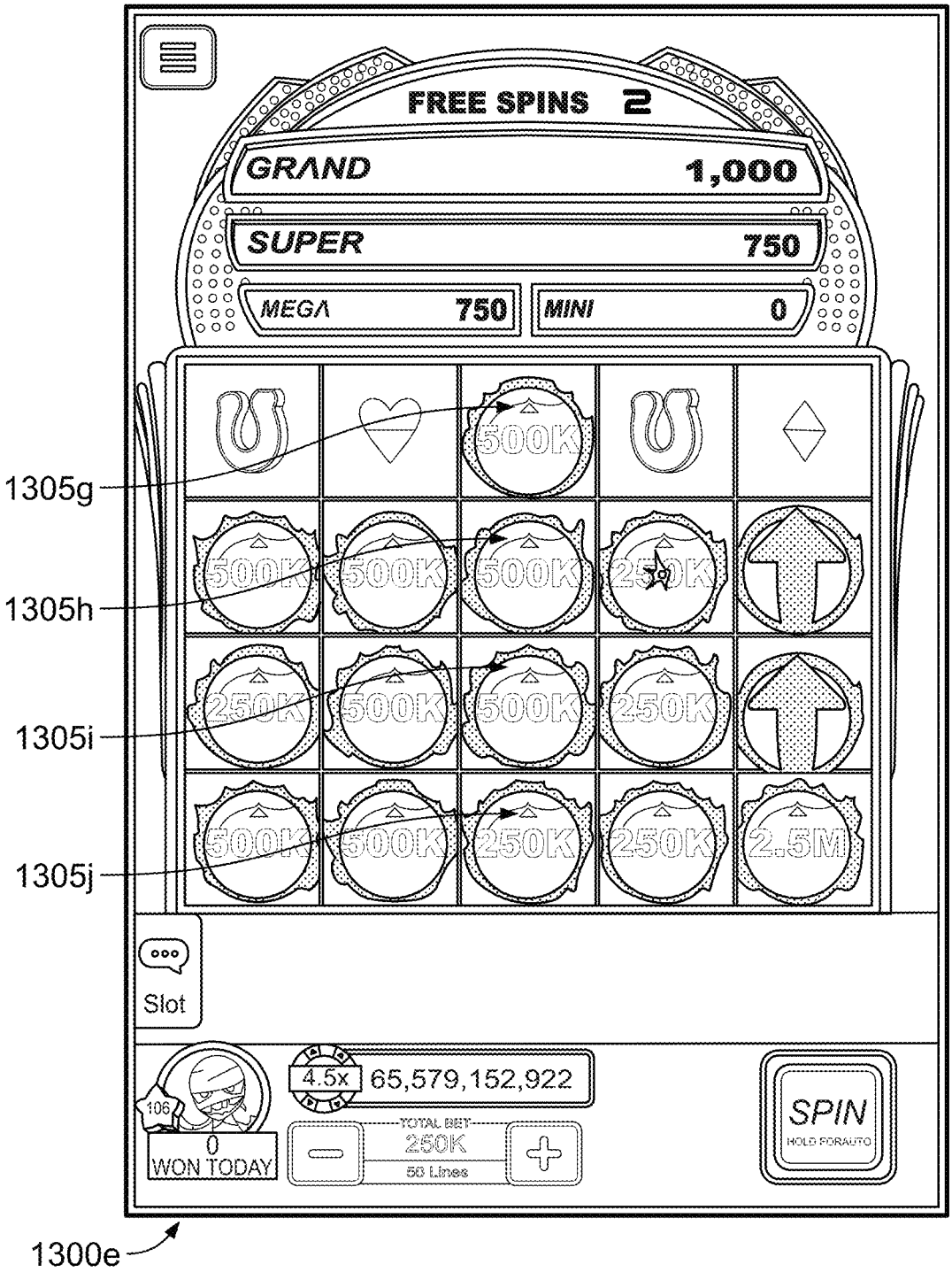
Figure 13F:
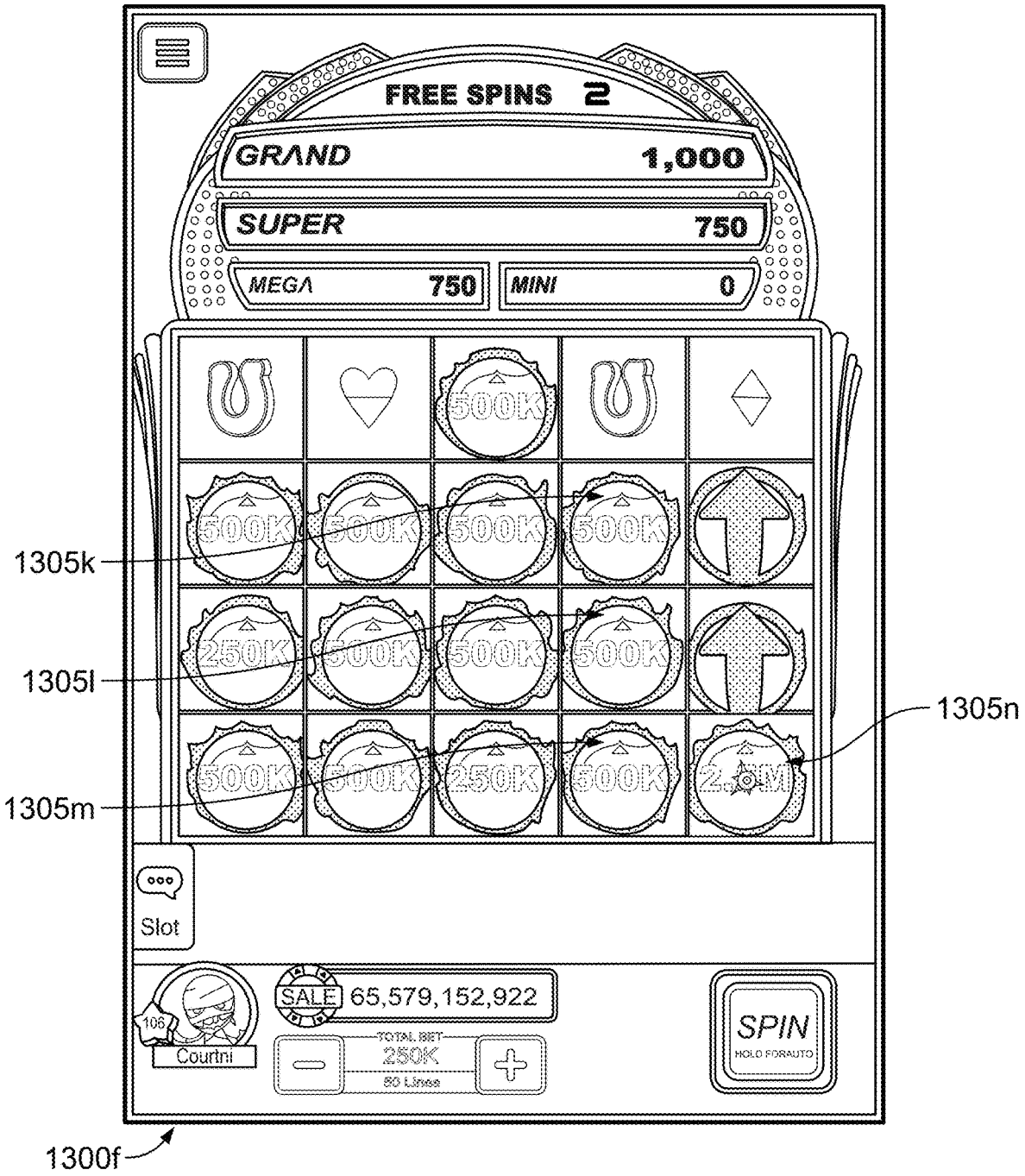

At the time depicted by GUI 1300*c* of FIG. 13C, the values of configurable symbols 1305*a*, 1305*b* and 1305*c* have already doubled. At this moment, the value of configurable symbol 1305*d* is in the process of being doubled. At the time represented by GUI 1300*d* of FIG. 13D, the values of configurable symbols 1305*d*, 1305*e* and 1305*f* have already doubled. At this moment, the value of configurable symbol 1305*g* is in the process of being doubled. At the time represented by GUI 1300*e* of FIG. 13E, the values of configurable symbols 1305*g*, 1305*h*, 1305*i* and 1305*j* have also doubled. At the time represented by GUI 1300*f* of FIG. 13F, the values of configurable symbols 1305*k*, 1305*l* and 1305*m* have also doubled. At this moment, the value of configurable symbol 1305*n* is in the process of being increased to 3.75 M. Other implementations may provide different values of the configurable symbols and/or different methods of upgrading.

Figure 13G:
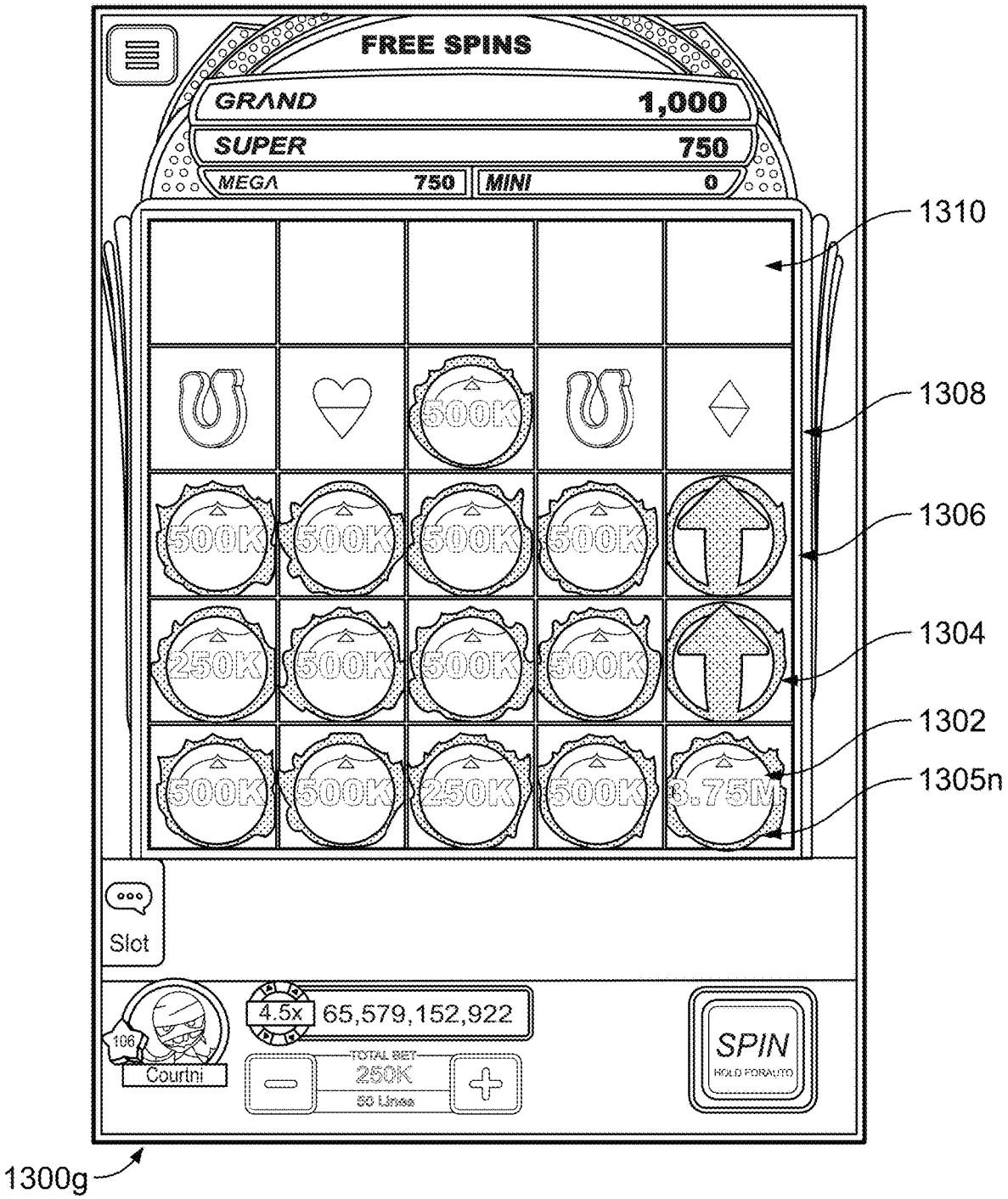
Figure 13H:
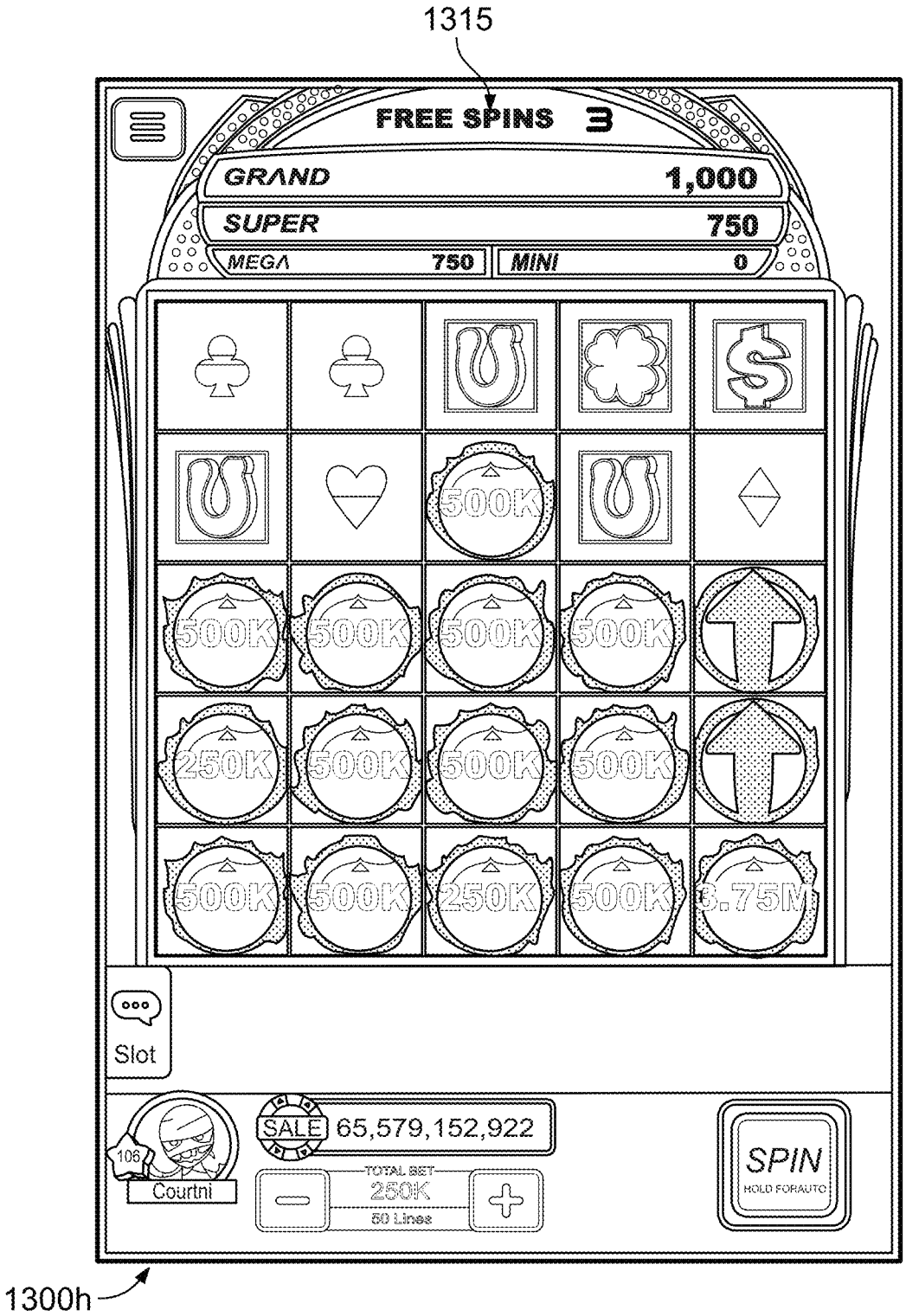

Subsequently, as shown in FIG. 13G, row 1310 has been added to the reel set so that the matrix of active display symbol positions has grown by one row, from a 4×5 matrix of active display symbol positions to a 5×5 matrix of active display symbol positions. Finally, as shown on GUI 1300*h* of FIG. 13H, the Free Spins counter 1315 has been reset to 3 free spins in this example. Therefore, the feature game round will include at least three additional feature game instances.

According to some implementations, the feature game round continues until either all remaining free spins have been played or all active display symbol positions in the matrix have been filled with configurable (or arrow) symbols. In some examples, after all free spins have been played or all active display symbol positions filled, the player is awarded the sum of the configurable symbols, the feature game round is complete and play returns to the base game.

In various embodiments, the trigger symbol may include one or more indicia that indicate whether to add one or more additional rows or one or more additional columns. For example, an up arrow trigger symbol may cause an additional row to be added above the current matrix of active display symbol positions. A left arrow trigger symbol may cause an additional column to be added to the left of the current matrix of active display symbol positions. In various embodiments, the trigger symbols may include one or more indicia that indicate the quantity of rows or columns to be added to the current matrix of active display symbol positions.

In various embodiments, the additional matrix may be displayed in a shaded or greyed out manner and as additional rows or columns are added, those rows or columns may become active. As seen in FIGS. 12C-12E, rows 1210 and 1212 of the matrix are shaded (covered) and as each of those rows becomes active, they are uncovered to indicate that they are active.

Reel Specific Value Meters

Figure 14A:
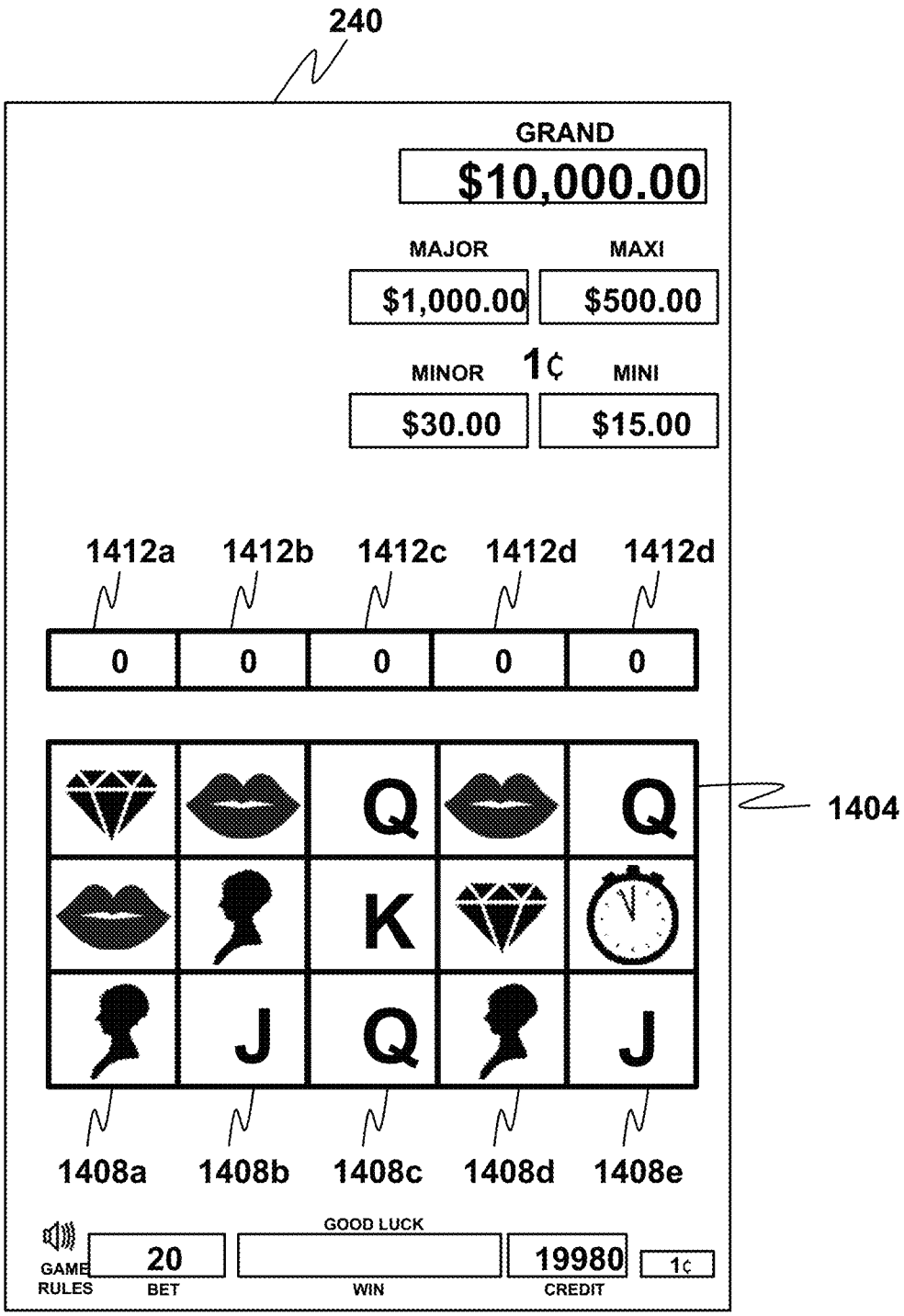
FIGS. 14A to 14C represent screen shots illustrating certain aspects of embodiments that include reel-specific value meters.

As will be appreciated, the concepts just described are not limited to reel specific multipliers. For example, FIG. 14A shows the primary game display 240 of a gaming device that includes reel specific value meters. Briefly, the display 240 presents a game outcome using a 3×5 display matrix 1404, where each column represents a different reel 1408*a*, 1408*b*, 1408*c*, 1408*d*, 1408*e*. The display 240 also includes a plurality of value meters 1412*a*-1412*e*. In the illustrated embodiment, each value meter 1412*a*-1412*e* is associated with a respective reel 1408*a*-1408*e*. In particular, a first value meter 1412*a* is associated with a first reel 1408*a*, a second value meter 1412*b* is associated with a second reel 1408*b*, a third value meter 1412*c* is associated with a third reel 1408*c*, a fourth value meter 1412*d* is associated with a fourth reel 1408*d*, and a fifth value meter 1412*e* is associated with a fifth reel 1408*e*. In other embodiments, one or more value meters may be associated with multiple reels.

In some embodiments, each of value meter 1412*a*-1412*e* may be initially set to a default value, such as zero, as is shown in FIG. 14A. In some embodiments, the value meters all have the same default value. In other embodiments, different default values may be used for some or all of the value meters.

The value meters 1412*a*-1412*e* may be adjusted in response to events occurring during play of a base game. For example, in some embodiments, the value meters 1412*a*-1412*e* may be adjusted based on values carried (e.g., credit values and or jackpots) by configurable symbols appearing in base game outcomes that do not trigger the feature game, e.g., base game outcomes with five (5) or fewer configurable symbols.

Figure 14B:
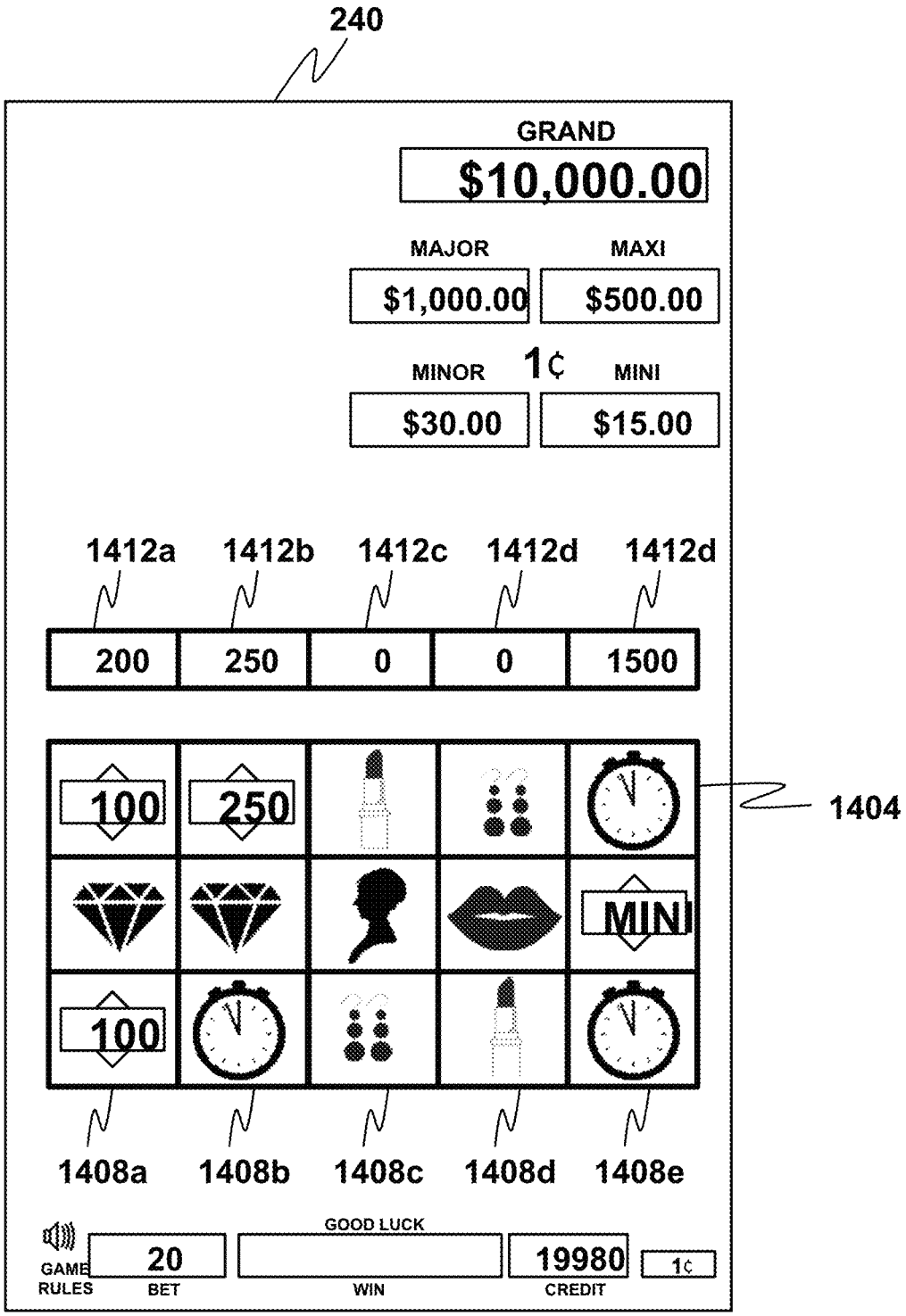

FIG. 14B is a non-triggering base game outcome that includes four configurable symbols, namely, two 100 credit configurable symbols on the first reel 1408*a*, a 250 credit value symbol on the second reel 1408*b*, and a MINI jackpot configurable symbol on the fifth reel 1408*e*. In such instances, the gaming device may add the value carried by a configurable symbol to the value meter associated with the reel that displays the configurable symbol. Accordingly, in this example, the first value meter 1412*a* is updated to 200 credits, the second value meter 1412*b* is updated to 250 credits, and the fifth value meter 1412*e* is updated to 1500 credits based on the $15.00 value of the MINI jackpot and a 1 cent bet denomination.

Figure 14C:
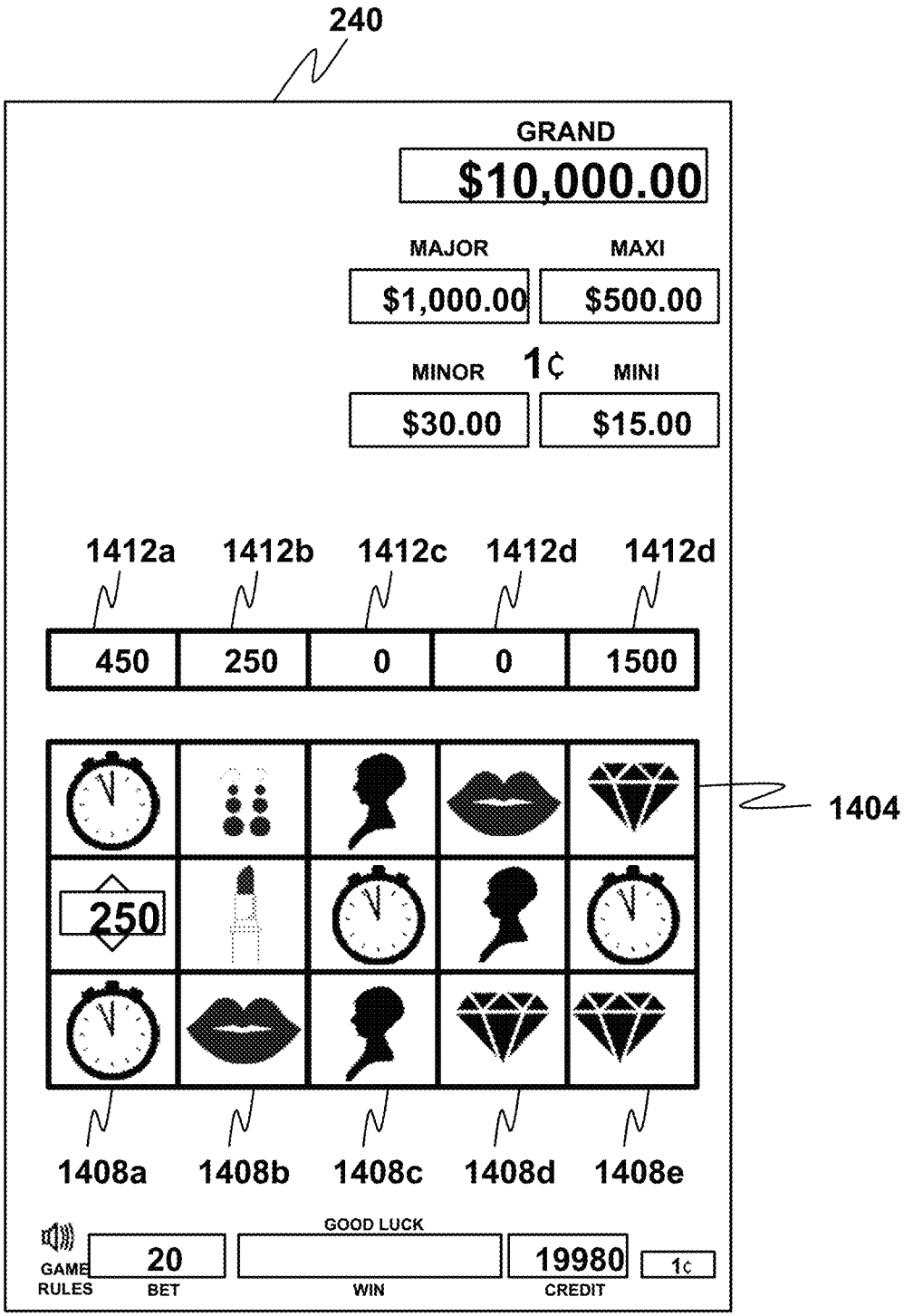

During ongoing play of the base game, the value meters 1412*a*-1412*e* may continue to be adjusted in response to the appearance of value symbols in the manner just described. FIG. 14C shows a second base game outcome that follows the base game outcome of FIG. 14B. This second base game outcome also does not include enough configurable symbols to trigger the feature game. Accordingly, the values carried by any displayed configurable symbols are credited to the appropriate value meters before another play of the base game. In this example, the first value meter 1412*a* is updated to 450 credits (based on the additional 250 credits carried by the configurable symbol on the first reel 1408*a*), while the other value meters 1412*b*-1412*e* remain unchanged.

In some embodiments, the symbol set may include symbols that cause the value meters 1412*a*-1412*e* to decrease and/or reset to zero. For example, some embodiments may include BUST symbols that reset a respective meter to zero when displayed on a respective reel in a base game outcome.

The gaming device may continue to update the value meters 1412*a*-1412*e* in this manner until a feature game is triggered, e.g., by the appearance of 6 or more configurable symbols in a base game outcome. In some embodiments, the credit values from a triggering base game outcome are not added to the value meters 1412*a*-1412*e*, e.g., because the player may be awarded such values in connection with a feature game award as described above. During play of the feature game, the player may also be awarded the values carried by one or more of the value meters. For example, in some embodiments, a player may be awarded the value carried by a value meter 1412*a*-1412*e* by filling a respective reel 1408*a*-1408*e* with configurable symbols during the hold and spin feature game.

In various embodiments, multiplier meters 1112*a*-1112*e* and/or value meters 1412*a*-1412*e* are maintained for each wager denomination offered by the gaming device For example, if the game is configured with three wager denominations, e.g., 1c, 5c and 25c, each wager configuration will have corresponding value meters 1112*a*-1112*e* and/or 1412*a*-1412*e*.

Enhanced Trigger Reel Feature

In some embodiments, one or more additional enhancing reels may be provided to enhance the player's chances of triggering the feature game and/or a resulting feature game award. For example, some embodiments may include an additional reel that may be selectively activated during play of the base game. In certain embodiments, the player may activate the additional reel by placing an additional wager, e.g., an ante bet, in connection with play of the base game. In some embodiments, the ante wager may, for example, be a fixed dollar or credit amount. In other embodiments, the ante wager may be a determined percentage (e.g., 50%, 75%, or 100%) of the base game wager.

The additional reel may provide for additional configurable symbols that increase the frequency and value of the hold and spin feature game. In some embodiments, the extra reel may contain only configurable symbols and blank symbols. In some embodiments, the extra reel may contain only configurable symbols. In some embodiments, in addition to the configurable symbols, the extra reel may contain high value symbols, scatter symbols, wild symbols, or any combination of these. When purchased, the extra reel may spin and work with the base game reels to trigger the feature game in the manner described above. In some embodiments, when the extra reel is not purchased, it remains stationary or is not displayed during base game play. In other embodiments, the extra reel may still spin when it is not purchased but it does not work with the base game reels, e.g., to trigger the feature game.

In alternative embodiments, the base game may use any number of extra reels (e.g., extra reels), charge any amount for each extra reel (e.g., 50% of the base game wager), put any number or type of symbols on an extra reel (e.g., only value symbols with jackpots), change symbols from spin to spin (e.g., value symbols may increase in value every 20 spins), and work with base game reels at any frequency (e.g., activates without ante bet every other spin).

Those of ordinary skill in the art will appreciate that (1) the number of configurable symbols required to trigger the feature game; (2) the number of free games awarded; (3) number of decrements of free game counter; (4) the number of configurable symbols that have to be displayed to win a prize or jackpot in the feature game; (5) the multiplier to apply; (6) the value of the mystery symbol; (7) the additional quantity of spins; (8) the prize value of the configurable symbols; (9) the number of increments or decrements of the progressive free spin counter; (10) the value of the multiplier on the multiplier symbol; (11) the value on the value symbols; (12) the number of extra reels; or (13) any other determination or variable described or contemplated in the present disclosure may at least in part be (a) randomly determined; (b) predetermined; (c) determined based on a wager amount and/or level; (d) centrally determined; (e) determined based on a generated symbol or symbol combinations; (f) determined based on player selection; (g) determined based on player skill; (h) determined based on a side wager or ante bet; (i) determined based on a status of the player; (j) determined as a combination of two or more determinations disclosed herein; etc.

It is to be understood that, if any prior art is referred to herein, such reference does not constitute an admission that the prior art forms a part of the common general knowledge in the art in any country.

In the claims which follow and in the preceding description, except where the context requires otherwise due to express language or necessary implication, the word "comprise" or variations such as "comprises" or "comprising" is used in an inclusive sense, i.e., to specify the presence of the stated features but not to preclude the presence or addition of further features in various embodiments of the disclosure.

The invention claimed is:

1. A gaming device, comprising:

a user interface system configured for receiving an indication to initiate one or more instances of a base game, the base game comprising a slot game;

a display system comprising one or more display devices; and a control system comprising one or more processors, the control system configured to, in association with presentation of the one or more instances of the base game:

control the display system to present a base game outcome and corresponding display symbols based on a random number generator (RNG) output from an RNG, the display symbols retrieved from a symbol set comprising configurable symbols and non-configurable symbols;

control the display system to display the corresponding display symbols at a plurality of display symbol positions on a display device of the display system, wherein the plurality of display symbol positions are arranged in a plurality of display symbol rows and columns;

dynamically assign a value to each configurable symbol that is in the base game outcome and display each configurable symbol that is in the base game outcome with the corresponding assigned value; and cause one or more instances of a feature game to be presented via the display system responsive to a triggering number of configurable symbols being displayed in an active area of the plurality of display symbol positions of the base game outcome, wherein the control system is further configured to, in association with presentation of the one or more instances of the feature game:

cause each displayed configurable symbol to be held at its corresponding display symbol position;

cause replacement symbols for non-configurable symbols in a plurality of display symbol positions not occupied by the held configurable symbols to be retrieved and displayed;

cause the active area of the plurality of display symbol positions to undergo a first expansion responsive to one of the symbols displayed in the active area of the plurality of display symbol positions being a trigger symbol by adding at least one of a row of display symbol positions or a column of display symbol positions to the active area of the plurality of display symbol positions in response to the display of the trigger symbol in the active area of the plurality of display symbol positions; and cause the active area of the plurality of display positions to undergo a second expansion responsive to one of the symbols displayed in the active area of the plurality of display symbol positions that was not within the active area of the plurality of display symbol positions prior to the first expansion of the active area of the plurality of display symbol positions also being the trigger symbol by further adding at least one of a row of display symbol positions or a column of display symbol positions to the expanded active area of the plurality of display symbol positions in response to the display of the trigger symbol in the active area of the plurality of display symbol positions that was not within the active area of the plurality of display symbol positions prior to the first expansion of the active area of the plurality of display symbol positions.

2. The gaming device of claim 1, wherein the control system is further configured to dynamically assign the corresponding value to each of the configurable symbols in the base game outcome by randomly selecting one of a plurality of defined multipliers and using the randomly selected multiplier as the value for that configurable symbol.

3. The gaming device of claim 2, wherein the control system is further configured to cause the value of each displayed configurable symbol to increment responsive to each instance of a trigger symbol being in a game outcome.

4. The gaming device of claim 2, wherein the control system is configured to cause the display system to display the selected value for each displayed configurable symbol before adding the at least one row or column to the active area of the plurality of display symbol positions.

5. The gaming device of claim 1, wherein the trigger symbol is one of the triggering number of configurable symbols displayed in the base game outcome.

6. The gaming device of claim 1, wherein the user interface system includes an interface for displaying a wager amount and wherein the triggering number of configurable symbols is based on the displayed wager amount.

7. The gaming device of claim 1, wherein the control system is further configured to cause a row or column to be added to the active area of the plurality of display symbol positions for each trigger symbol presented in the active area of the plurality of display symbol positions until a maximum number of active area rows or columns, respectively, is presented.

8. One or more non-transitory computer-readable media storing instructions which, when executed by one or more processors, cause the one or processors to:

receive an indication to initiate one or more instances of a base game, the base game comprising a slot game;

in association with presentation of the one or more instances of the base game:

control a display system to present a base game outcome and corresponding display symbols based on a random number generator (RNG) output from an RNG, the display symbols retrieved from a symbol set comprising configurable symbols and non-configurable symbols;

control a display system to display the corresponding display symbols at a plurality of display symbol positions on a display device of the display system, wherein the plurality of display symbol positions are arranged in a plurality of display symbol rows and columns;

dynamically assign a value to each configurable symbol that is in the base game outcome and display each configurable symbol that is in the base game outcome with the corresponding assigned value; and cause one or more instances of a feature game to be presented via the display system responsive to a triggering number of configurable symbols being displayed in an active area of the plurality of display symbol positions of the base game outcome, the non-transitory computer-readable media further storing additional instructions which, when executed by the one or more processors, cause the one or more processors, in association with presentation of the one or more instances of the feature game:

cause each displayed configurable symbol to be held at its corresponding display symbol position;

cause replacement symbols for non-configurable symbols in a plurality of display symbol positions not occupied by the held configurable symbols to be retrieved and displayed;

cause the active area of the plurality of display symbol positions to undergo a first expansion responsive to one of the symbols displayed in the active area of the plurality of display symbol positions being a trigger symbol by adding at least one of a row of display symbol positions or a column of display symbol positions to the active area of the plurality of display symbol positions in response to the display of the trigger symbol in the active area of the plurality of display symbol positions; and cause the active area of the plurality of display positions to undergo a second expansion responsive to one of the symbols displayed in the active area of the plurality of display symbol positions that was not within the active area of the plurality of display symbol positions prior to the first expansion of the active area of the plurality of display symbol positions also being the trigger symbol by further adding at least one of a row of display symbol positions or a column of display symbol positions to the expanded active area of the plurality of display symbol positions in response to the display of the trigger symbol in the active area of the plurality of display symbol positions that was not within the active area of the plurality of display symbol positions prior to the first expansion of the active area of the plurality of display symbol positions.

9. The one or more non-transitory computer-readable media of claim 8, further storing additional computer-executable instructions which, when executed by the one or more processors, cause the one or more processors to dynamically assign the corresponding value to each of the configurable symbols in the base game outcome by randomly selecting one of a plurality of defined multipliers and using the randomly selected multiplier as the value for that configurable symbol.

10. The one or more non-transitory computer-readable media of claim 9, further storing additional computer-executable instructions which, when executed by the one or more processors, cause the one or more processors to cause the value of each displayed configurable symbol to increment responsive to each instance of a trigger symbol being in a game outcome.

11. The one or more non-transitory computer-readable media of claim 9, further storing additional computer-executable instructions which, when executed by the one or more processors, cause the one or more processors to cause the selected value for each displayed configurable symbol to be displayed before adding the at least one row or column to the active area of the plurality of display symbol positions.

12. The one or more non-transitory computer-readable media of claim 8, wherein the trigger symbol is one of the triggering number of configurable symbols displayed in the base game outcome.

13. The one or more non-transitory computer-readable media of claim 8, further storing additional computer-executable instructions which, when executed by the one or more processors, cause the one or more processors to cause an interface for displaying a wager amount to be presented and wherein the triggering number of configurable symbols is based on the displayed wager amount.

14. The one or more non-transitory computer-readable media of claim 8, further storing additional computer-executable instructions which, when executed by the one or more processors, cause the one or more processors to cause a row or column to be added to the active area of the plurality of display symbol positions for each trigger symbol presented in the active area of the plurality of display symbol positions until a maximum number of active area rows or columns, respectively, is presented.

15. A method, comprising:

presenting, on a display system, a user interface system configured for receiving an indication to initiate one or more instances of a base game, the base game comprising a slot game;

in association with presentation of the one or more instances of the base game:

controlling the display system to present a base game outcome and corresponding display symbols based on a random number generator (RNG) output from an RNG, the display symbols retrieved from a symbol set comprising configurable symbols and non-configurable symbols;

controlling a display system to display the corresponding display symbols at a plurality of display symbol positions on a display device of the display system, wherein the plurality of display symbol positions are arranged in a plurality of display symbol rows and columns;

dynamically assigning a value to each configurable symbol that is in the base game outcome and display each configurable symbol that is in the base game outcome with the corresponding assigned value; and causing one or more instances of a feature game to be presented via the display system responsive to a triggering number of configurable symbols being displayed in an active area of the plurality of display symbol positions of the base game outcome, the method further comprising, in association with presentation of the one or more instances of the feature game:

causing each displayed configurable symbol to be held at its corresponding display symbol position;

causing replacement symbols for non-configurable symbols in a plurality of display symbol positions not occupied by the held configurable symbols to be retrieved and displayed;

causing the active area of the plurality of display symbol positions to undergo a first expansion responsive to one of the symbols displayed in the active area of the plurality of display symbol positions being a trigger symbol by adding at least one of a row of display symbol positions or a column of display symbol positions to the active area of the plurality of display symbol positions in response to the display of the trigger symbol in the active area of the plurality of display symbol positions; and causing the active area of the plurality of display positions to undergo a second expansion responsive to one of the symbols displayed in the active area of the plurality of display symbol positions that was not within the active area of the plurality of display symbol positions prior to the first expansion of the active area of the plurality of display symbol positions also being the trigger symbol by further adding at least one of a row of display symbol positions or a column of display symbol positions to the expanded active area of the plurality of display symbol positions in response to the display of the trigger symbol in the active area of the plurality of display symbol positions that was not within the active area of the plurality of display symbol positions prior to the first expansion of the active area of the plurality of display symbol positions.

16. The method of claim 15, further comprising dynamically assigning the corresponding value to each of the configurable symbols in the base game outcome by randomly selecting one of a plurality of defined multipliers and using the randomly selected multiplier as the value for that configurable symbol.

17. The method of claim 16, further comprising causing the value of each displayed configurable symbol to increment responsive to each instance of a trigger symbol being in a game outcome.

18. The method of claim 16, further comprising causing the display system to display the selected value for each displayed configurable symbol before adding the at least one row or column to the active area of the plurality of display symbol positions.

19. The method of claim 15, wherein the trigger symbol is one of the triggering number of configurable symbols displayed in the base game outcome.

20. The method of claim 15, wherein the user interface system includes an interface for displaying a wager amount and wherein the triggering number of configurable symbols is based on the displayed wager amount, the method further comprising causing a row or column to be added to the active area of the plurality of display symbol positions for each trigger symbol presented in the active area of the plurality of display symbol positions until a maximum number of active area rows or columns, respectively, is presented.

* * * * *